US012122570B2

(12) United States Patent
Robison et al.

(10) Patent No.: US 12,122,570 B2
(45) Date of Patent: Oct. 22, 2024

(54) PACKAGE WITH CHILD-SAFETY CLOSURE

(71) Applicant: Berry Global, Inc., Evansville, IN (US)

(72) Inventors: Jacob B. Robison, Marietta, PA (US); Adam D. Beaty, Lebanon, TN (US); Steven Gift, Lititz, PA (US); John A. Vassallo, Lititz, PA (US); Chelsea Howard, Chandler, IN (US)

(73) Assignee: Berry Global, Inc., Evansville, IN (US)

( * ) Notice: Subject to any disclaimer, the term of this patent is extended or adjusted under 35 U.S.C. 154(b) by 78 days.

(21) Appl. No.: 17/869,155

(22) Filed: Jul. 20, 2022

(65) Prior Publication Data

US 2023/0028311 A1 Jan. 26, 2023

Related U.S. Application Data

(60) Provisional application No. 63/224,157, filed on Jul. 21, 2021.

(51) Int. Cl.
*B65D 50/04* (2006.01)

(52) U.S. Cl.
CPC ..... *B65D 50/046* (2013.01); *B65D 2215/02* (2013.01)

(58) Field of Classification Search
CPC .. B65D 50/046; B65D 2215/02; B65D 41/06; B65D 41/065; B65D 41/04; B65D 41/0407; B65D 41/0414; B65D 41/0421; B65D 41/0428; B65D 41/0435; B65D 41/0442; B65D 41/045; B65D 41/0457; B65D 41/0464; B65D 41/0471; B65D 41/0478; B65D 41/0485; B65D 41/0492
USPC ..... 215/222, 332, 221, 214, 217
See application file for complete search history.

(56) References Cited

U.S. PATENT DOCUMENTS

| | | | | |
|---|---|---|---|---|
| 942,141 | A * | 12/1909 | Hoffman | B65D 41/06 215/332 |
| 4,373,641 | A * | 2/1983 | Banich, Sr. | B65D 41/0471 215/331 |
| 4,387,821 | A * | 6/1983 | Geiger | B65D 41/0478 215/332 |
| 5,899,348 | A * | 5/1999 | Konefal | B65D 50/046 215/221 |
| 7,097,058 | B2 * | 8/2006 | Wellman | B65D 47/103 215/217 |
| 2009/0140513 | A1 * | 6/2009 | Priebe | A61J 1/03 283/81 |
| 2009/0301985 | A1 | 12/2009 | Priebe | |
| 2010/0126955 | A1 | 5/2010 | Robinson | |
| 2010/0200533 | A1 | 8/2010 | Rice | |

(Continued)

FOREIGN PATENT DOCUMENTS

| | | | |
|---|---|---|---|
| FR | 2474451 A1 * | 7/1981 | |
| GB | 2203729 A * | 10/1988 | B65D 41/0471 |

OTHER PUBLICATIONS

International (PCT) Patent Application Search Report and Written Opinion for PCT/US22/37687 dated Oct. 18, 22, 10 pages.

*Primary Examiner* — Allan D Stevens
(74) *Attorney, Agent, or Firm* — Barnes & Thornburg LLP

(57) ABSTRACT

A child-resistant package includes a vial and a closure configured to mount on the vial to cover a mouth opening into a product-storage chamber of the vial. A child-resistant feature cooperates with the closure and the vial to block unwanted removal of the closure from the vial.

17 Claims, 38 Drawing Sheets

(56) References Cited

U.S. PATENT DOCUMENTS

| | | | | |
|---|---|---|---|---|
| 2011/0180540 | A1* | 7/2011 | Priebe | B65D 50/046<br>220/315 |
| 2019/0105234 | A1* | 4/2019 | Patel | A61J 1/03 |

* cited by examiner

PACKAGE WITH CHILD-SAFETY CLOSURE

PRIORITY CLAIM

This application claims priority under 35 U.S.C. § 119(e) to U.S. Provisional Application Ser. No. 63/224,157, filed Jul. 21, 2021, which is expressly incorporated by reference herein.

BACKGROUND

The present disclosure relates to packaging, and particularly to medical packaging. More particularly, the present disclosure relates to child-resistant packaging.

SUMMARY

According to the present disclosure, a child-resistant package comprises a vial and a closure coupled removably to the vial to cover a mouth opening into a product-storage chamber of the vial. The child-resistant package includes a child resistant feature designed to block unwanted removal of the closure from the vial.

In illustrative embodiments, the vial includes a side wall, a floor coupled to a lower end of the side wall, and a plurality of closure retainers coupled to an upper end of the side wall. In illustrative embodiments, the closure includes a top wall, a side wall, and a plurality of closure anchors coupled to an inside surface of the side wall. The plurality of closure anchors are configured to engage each of the plurality of closure retainers to pull the closure inwardly toward the vial into a fully-installed position covering and closing a mouth of the vial to establish a seal.

In illustrative embodiments, the child-resistant package further includes a closure-release control mechanism having a movable release element that is coupled to the vial and an upwardly sloping locking tab coupled to the movable release element. The movable release element is configured to permit the release of the closure from the vial upon the application of a radially inwardly directed force to the movable release element by a consumer. The locking tab is configured to engage one of the closure anchors to block removal of the closure from the vial until a downward force is applied by a consumer to the movable release element carried on the vial.

Additional features of the disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
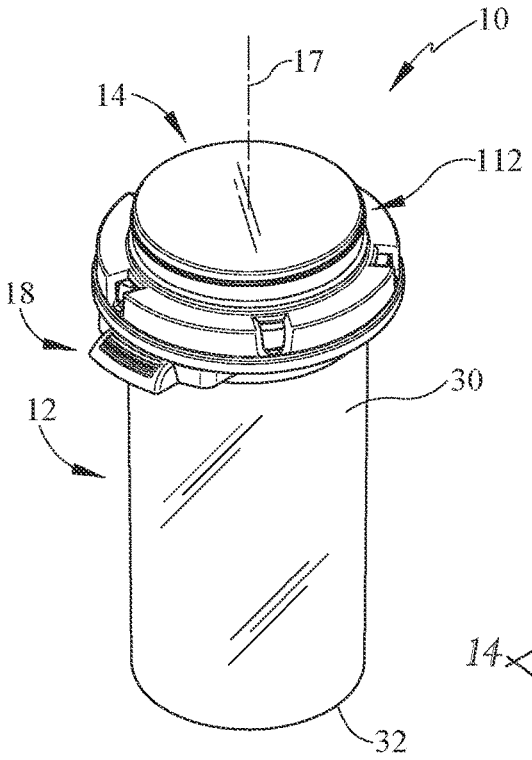
FIG. 1 is a perspective view of a child-resistant package in accordance with the present disclosure showing a vial, a closure mounted on the vial to cover a mouth opening into an interior region formed in the vial, and a closure-release control mechanism having a movable release element that is coupled to the vial and configured to disengage a locking tab coupled to the vial from a closure anchor included in the closure to permit the release of the closure from the vial.
Figure 2:
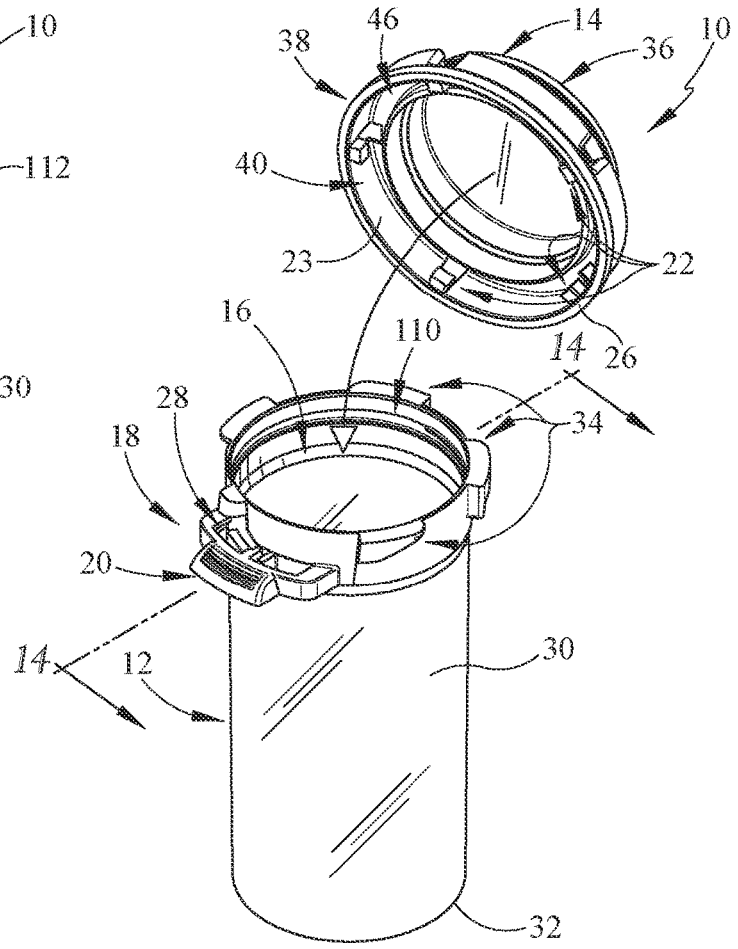
FIG. 2 is an exploded assembly view of the child-resistant package of FIG. 1, showing the closure separated from the vial to reveal a plurality of closure anchors coupled to a perimeter edge of a rim of the closure and showing the movable release element coupled to an annular flange of the vial and an inclined locking tab included in the closure-release control mechanism and configured to engage one of the plurality of closure retainers in the closure as suggested in FIGS. 6, 10, and 15 to block selectively removal of the closure from the vial until a downward directed push force is applied to the movable release element to disengage the locking tab from the closure anchor as shown in FIG. 16.

A child-resistant package 10 includes a vial 12, or container, and a closure 14 mounted on vial 12 to cover a mouth 15 opening into a product-storage chamber 16 formed in vial 12, as shown in the illustrative embodiment of FIGS. 1 and 2. A first embodiment of child-resistant package 10 is shown in FIGS. 1-18. A second embodiment of a child-resistant package 210 is shown in FIGS. 19-36. A third embodiment of a child-resistant package 310 is shown in FIGS. 37-54. A fourth embodiment of a child-resistant package 410 is shown in FIGS. 55-69.

Vial 12 is adapted to accept closure 14 to seal in the contents of vial 12. Product-storage chamber 16 is adapted to contain product, such as medication, and is sealed when closure 14 is coupled to vial 12. Child-resistant package 10 also includes a closure-release control mechanism 18 configured to control release of closure 14 from vial 12.

Vial 12 includes an annular sidewall 30, a floor 32 coupled to a lower end of side wall 30, and a plurality of closure retainers 34 coupled to an outer surface of an upper end of the side wall 30 as shown in FIG. 2. Side wall 30 extends vertically along an axis 17 of child-resistant package 10. Side wall 30 and floor 32 cooperate to define product-storage chamber 16 of vial 12. The plurality of closure retainers 34 extend outwardly away from axis 17 and are configured to cooperate with closure 14 to retain closure 14 on vial 12 in a full-installed position as shown in FIG. 1. Closure 14 is arranged to be coupled to vial 12 after rotation of closure 14 about axis of rotation 17, as shown, for example, in FIG. 1. Vial 12 does not include external threads and uses only the plurality of closure retainers 34 to mount closure 14 on vial 12 when the package 10 is being used in a child-resistant mode.

Closure 14 includes a round top wall 36 and an annular sidewall 38 that depends downwardly from top wall 36. Top wall 36 and side wall 38 form an interior region 40 of closure 14. Closure 14 does not include threads on side wall 38 within interior region 40 of closure 14, and, instead, further includes a plurality of closure anchors 22 that are coupled to an inside surface 23 of side wall 38 in interior region 40. The plurality of closure anchors 22 are configured to engage the plurality of closure retainers 34 so that closure 14 is retained to vial 12 after rotation of closure 14 about axis of rotation 17, as shown, for example, in FIG. 1.

Figure 16:
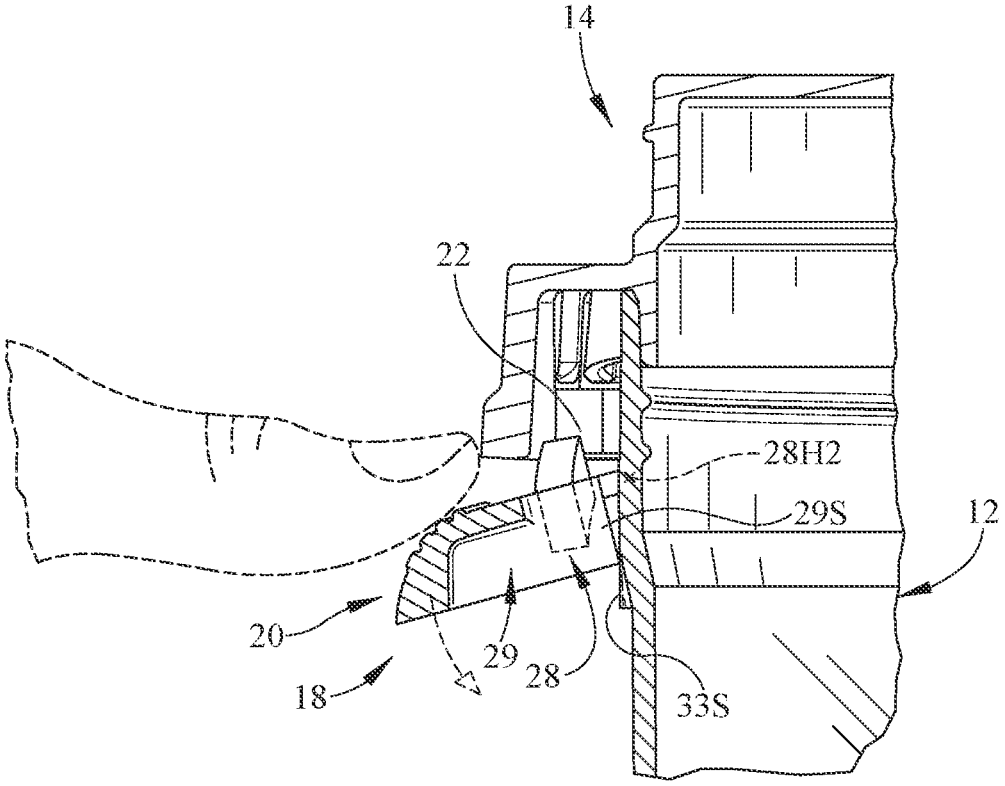
FIG. 16 is a cross-section of the portion of the package shown in FIG. 15 showing the thumb of the user pushing the closure release element downwardly to disengage the locking tab from the closure anchor so that the closure can be rotated in the counterclockwise direction to remove the closure from the vial for access to contents within the vial.
Figure 17:
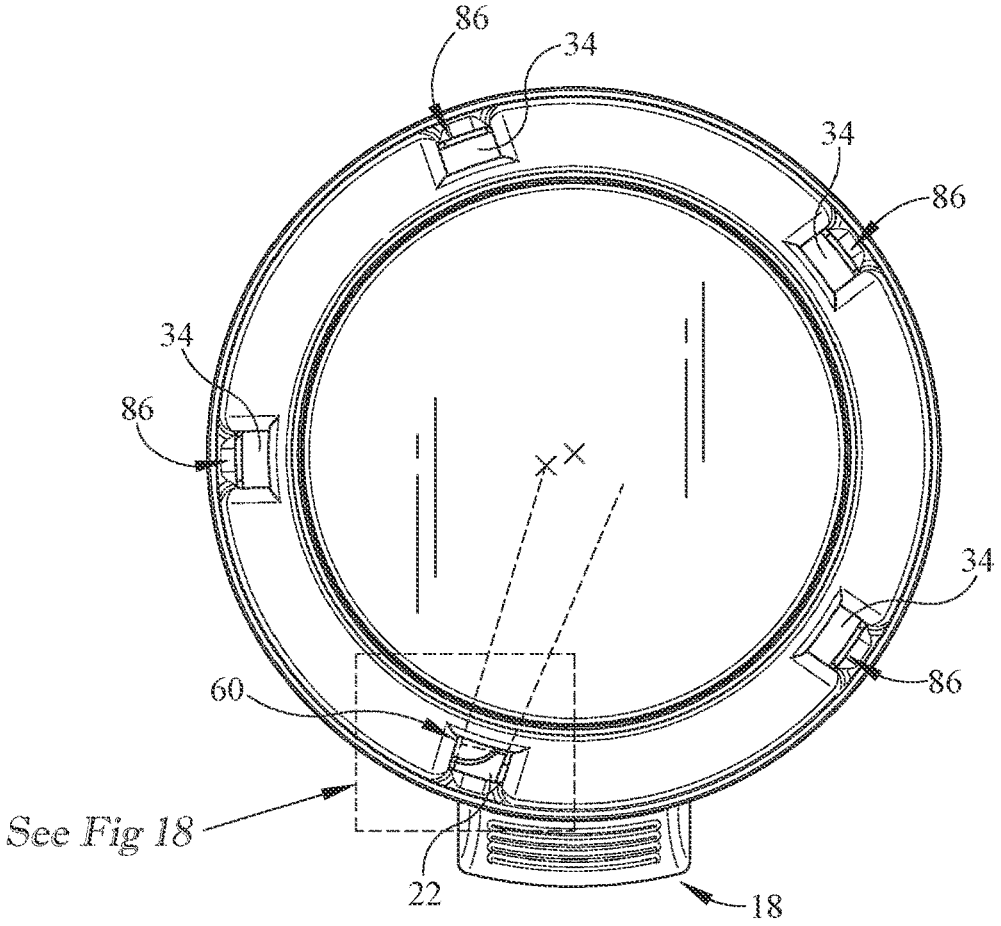
FIG. 17 is a top plan view of the package with the closure in the fully-installed position on the vial.

Closure-release control mechanism 18 comprises a movable release element 20 coupled to vial 12 and a locking tab 28 mounted on vial 12 for two-axis pivotable movement about a first horizontal pivot axis 28H1 during installation of closure 14 on vial 12 and about a second horizontal pivot axis 28H2 during removal of closure 14 from vial 12. Closure-release control mechanism 18 further comprises a plurality of radially inwardly extending closure anchors 22 coupled to a rim 26 of closure 14, as shown in FIG. 2. Removal of closure 14 from vial 12 is blocked when locking tab 28 included in closure-release control mechanism 18 and coupled to movable release element 20 is positioned to lie in the pathway of one of the plurality of closure anchors 22. When a consumer pushes movable release element 20 to flex downwardly as shown in FIG. 16, locking tab 28 moves out of the pathway of the one of the plurality of closure anchors 22 on closure 14 to permit counterclockwise rotation and removal of closure 14 from vial 12, as suggested in FIG. 16. Vial 12 also includes internal threads 110 that correspond to external threads 112 on an exterior surface of side wall 38 opposite interior region 40 of closure 14 to allow closure 14 to be coupled to vial 12 in a non-child resistant mode. To change closure 14 to the non-child resistant mode, closure 14 is removed from vial 12, inverted, and top wall 36 of closure 14 is inserted through open mouth 15 and coupled to vial 12 via threads 110, 112. When closure 14 is in the non-child resistant mode, closure-release control mechanism 18 does not work to block removal of closure 14 from vial 12.

Figure 3:
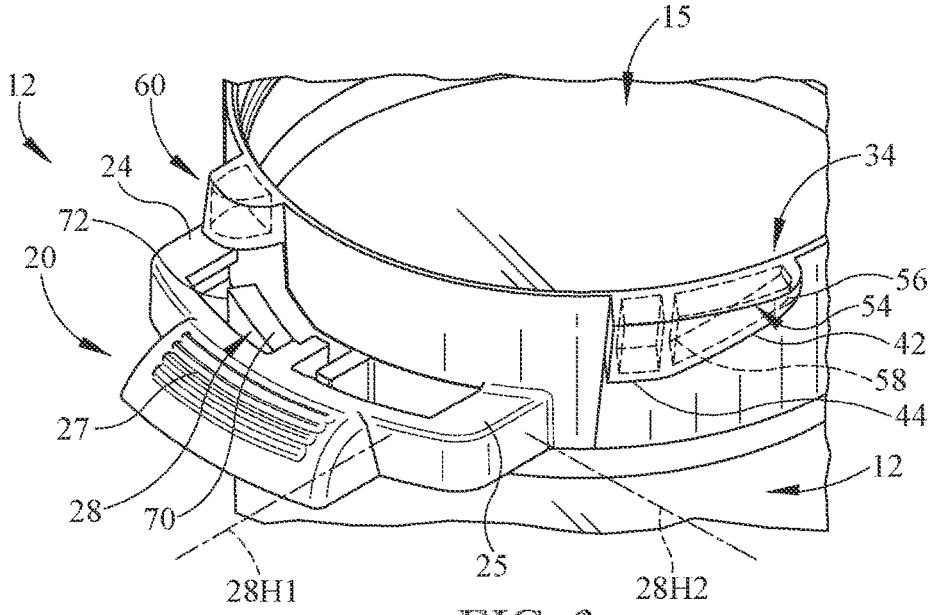
FIG. 3 is an enlarged perspective view of a portion of the vial of FIG. 2 showing the inclined locking tab positioned to lie between the movable release element and an annular sidewall included in the vial and showing that the vial includes a plurality of closure retainers coupled to the annular sidewall and adapted to engage a respective one of the plurality of closure anchors upon rotation of the closure in a clockwise direction relative to the vial until one of the closure anchors engages a circumferential surface of the inclined locking tab to block the closure from rotating in a counterclockwise direction until the downward push force is applied on the movable release element.
Figure 4:
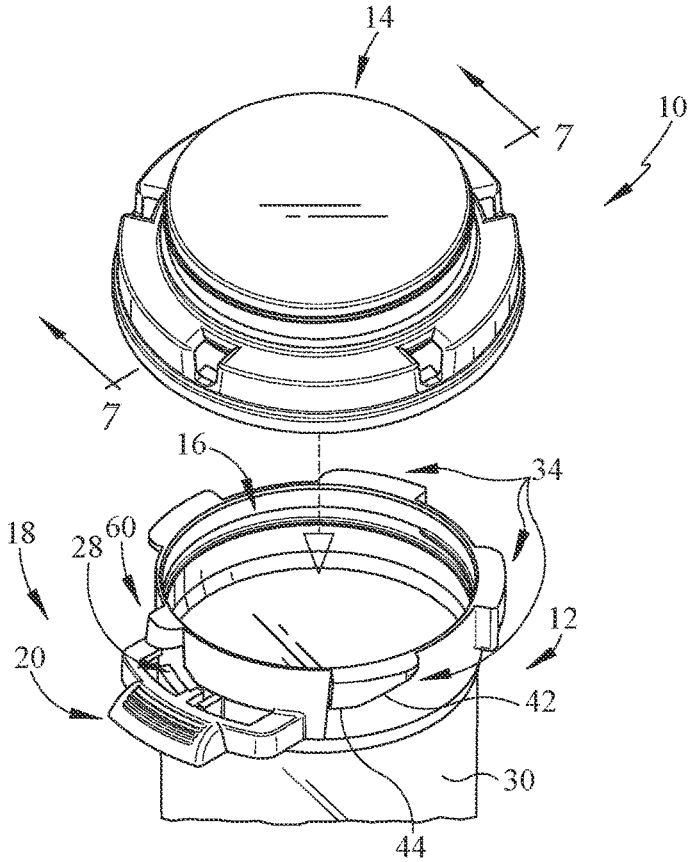
FIG. 4 is a partial perspective and exploded view of the package from FIG. 1 showing the closure removed from the vial and a downward arrow suggesting that, in order to close and lock the closure on the vial, the closure is lowered onto the vial with each of the closure anchors positioned between two adjacent closure retainers.

Movable release element 20 includes a pair of support arms 24, 25 and an actuator pad 27 as shown in FIG. 3. The pair of support arms 24, 25 extend radially outward from side wall 30 of vial 12 and are spaced apart from one another circumferentially about axis 17. Actuator pad 27 extends between and interconnects the pair of support arms 24, 25. Locking tab 28 is coupled to actuator pad 27, but may be coupled to one of the support arms 24, 25 in other embodiments. An operator may use the actuator pad 27 to deform the pair of support arms 24, 25 and pivot the locking tab 28 downwardly with the actuator pad 27 about second horizontal axis 28H2 out of the path of the plurality of closure anchors 22 so that closure 14 can be removed from vial 12. Actuator pad 27 further includes a plurality of ribs 21 as shown in FIGS. 12-14 to provide a gripping surface for the operator's thumb.

Figure 12:
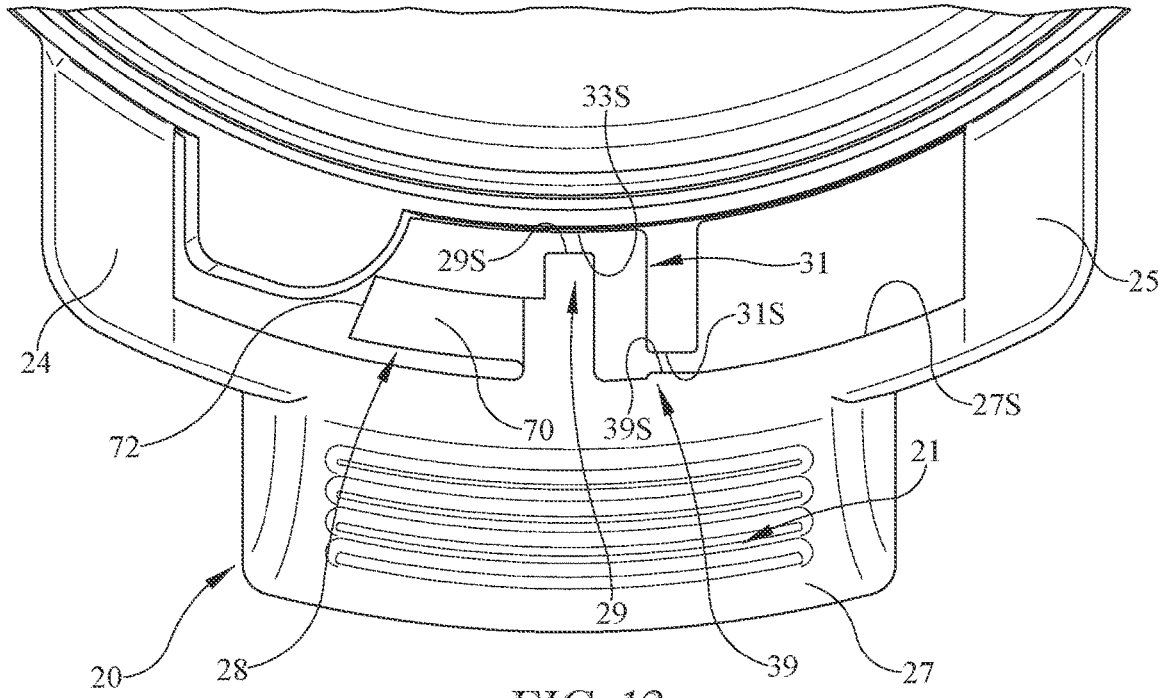
FIG. 12 is a top plan view of the closure-release control mechanism shown in FIG. 1 showing that closure-release control mechanism includes a first travel limiter coupled to the movable release element and adapted to engage a first companion travel-limiter wall coupled to the annular side wall of the vial, and a second travel limiter coupled to the annular side wall of the vial and adapted to engage a second companion travel-limiter wall coupled to the movable release element.
Figure 13:
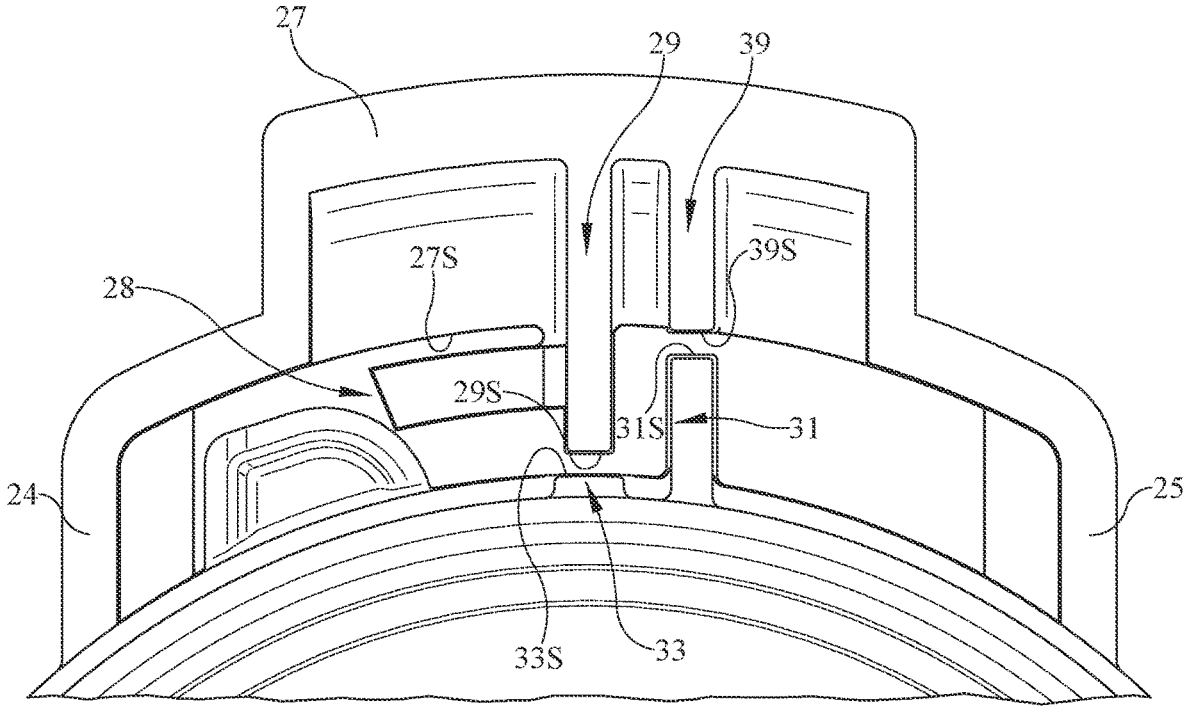
FIG. 13 is a bottom plan view of the closure-release control mechanism shown in FIG. 12.

Closure-release control mechanism 18 further includes one or more travel limiters 29, 31 and one or more companion travel-limiter walls 33, 39 as shown in FIGS. 12 and 13. In the illustrative embodiment shown in FIG. 12, closure-release control mechanism 18 includes a first travel limiter 29 coupled to and extending radially inward from actuator pad 27 of movable release element 20 and a second travel limiter 31 coupled to and extending radially outward from annular side wall 30 of vial 12 relative to axis 17. First travel limiter 29 is integrally coupled to locking tab 28 while second travel limiter 31 is integrally coupled to annular side wall 30.

Figure 14:
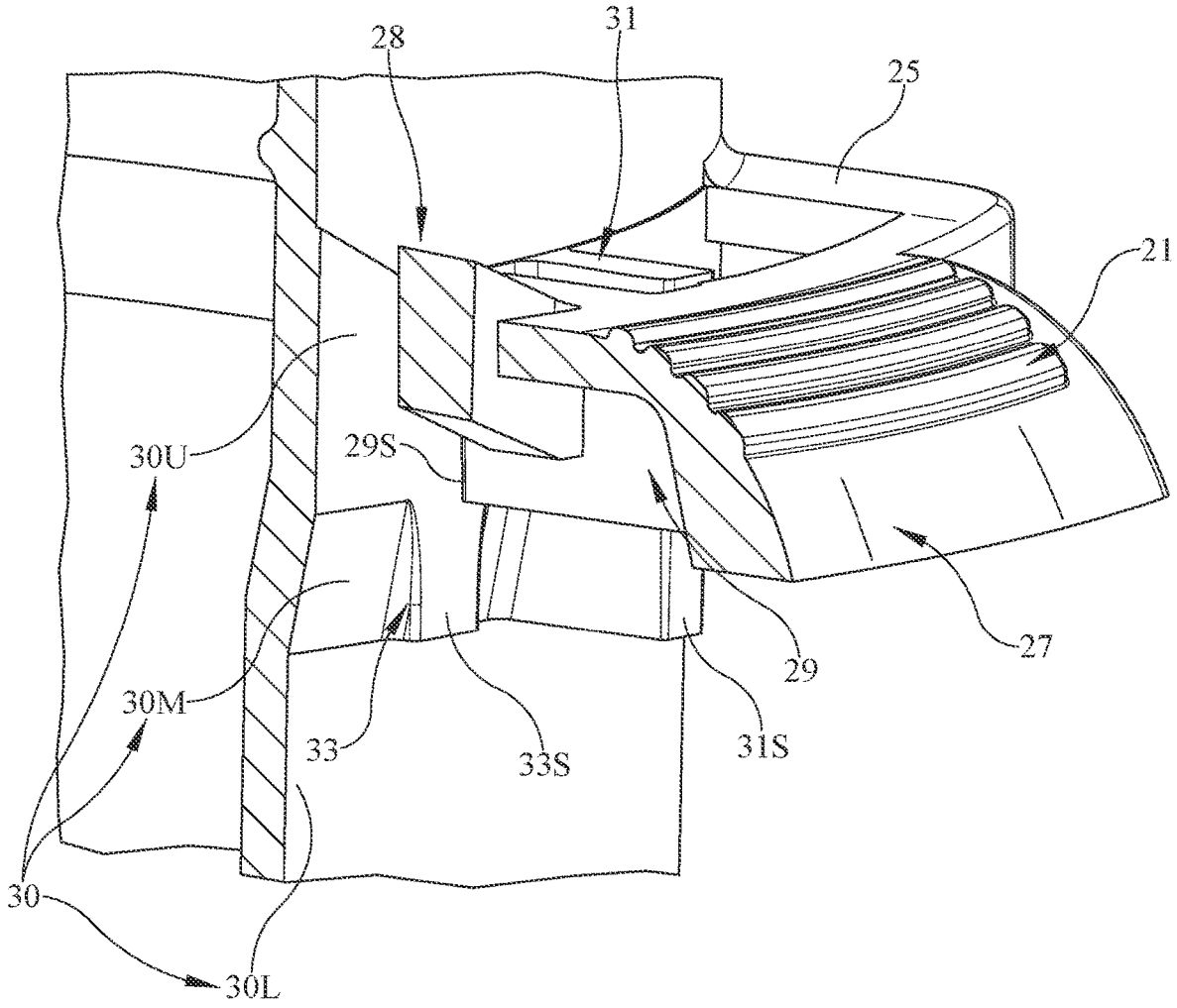
FIG. 14 is a sectional view of the closure-release control mechanism taken along line 14-14 shown in FIG. 2.
Figure 15:
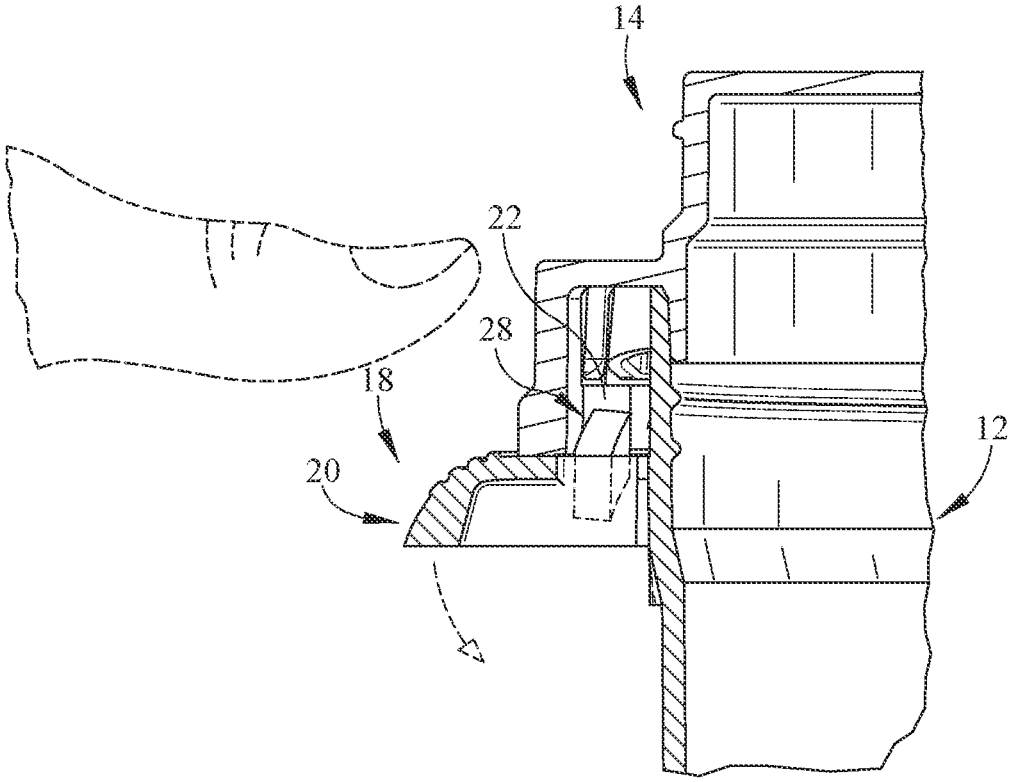
FIG. 15 is a cross-section of a portion of the package from FIG. 9 showing the closure in the fully-installed position and a thumb of a user being lowered toward the closure release element.

A first companion travel-limiter wall 33 is coupled to and extends radially outward from a middle section 30M of annular side wall 30 relative to axis 17 as shown in FIG. 14. First companion travel-limiter wall 33 includes a contacting surface 33S that is radially aligned with an upper section 30U of annular side wall 30 and parallel to a lower section 30L of annular side wall 30. A second companion travel-limiter wall 39 is coupled to and extends radially inward from a radially inward surface 27S of actuator pad 27. Second companion travel-limiter wall 39 includes a contacting surface 39S. Alternatively, the contacting surfaces 33S, 39S of companion travel-limiter walls 33, 39 may be surfaces of the annular side wall 30 or the actuator pad 27, respectively.

Contacting surface 33S is parallel to and spaced a first distance from a contacting surface 29S of first travel limiter 29 when the movable release element 20 is not deformed. Likewise, contacting surface 39S is parallel to and spaced a second distance from a contacting surface 31S of second travel limiter 31 when the movable release element 20 is not deformed. The first distance is about or equal to the second distance. The radial length of travel limiters 29, 31, and companion travel-limiter walls 33, 39 each may be any radial length between actuator pad 27 and annular side wall 30.

When an operator pushes movable release element 20 to flex downwardly, contacting surface 29S of first travel limiter 29 may engage contacting surface of 33S of first companion travel-limiter wall 33. Similarly, contacting surface 39S of second companion travel-limiter wall 39 may engage contacting surface 31S of second travel limiter 31. The engagement of the contacting surfaces 29S, 31S, 33S, and 39S blocks the actuator pad 27 from deforming beyond the elastic limit of the actuator pad 27. Thus. the travel limiters 29, 31 and companion travel-limiter walls 33, 39 cooperate to reduce wear on movable release element 20 and block breakage or permanent deformation of the pair of support arms 24, 25.

In the illustrative embodiment shown in FIGS. 12 and 13, first travel limiter 29 is arranged at a circumferential midpoint of the actuator pad 27. First companion travel-limiter wall 33 is circumferentially aligned with first travel limiter 29 relative to axis 17. Lock tab 28 is integrally coupled to and extends circumferentially from first travel limiter 29 towards support arm 24. Second companion travel-limiter wall 39 is coupled to actuator pad 27 and is positioned circumferentially between first travel limiter 29 and support arm 25. Second travel limiter 31 is circumferentially aligned with second companion travel-limiter wall 39 relative to axis 17. In other embodiments, first travel limiter 29 may be positioned at any point along the radially inward surface 27S of actuator pad 27 so long as it is circumferentially aligned with first companion travel-limiter wall 33 and/or contacting surface 33S. Likewise, in other embodiments, second companion travel-limiter wall 39 and/or contacting surface 39S may be positioned at any point along the radially inward surface 27S so long as it is circumferentially aligned with second travel limiter 31.

Each of the plurality of closure retainers 34 includes a closure-displacement ramp 42 and a closure-retainer surface 44 as shown in FIG. 3. Each closure-displacement ramp 42 is configured to engage one of the plurality of closure anchors as closure 14 is rotated in a closure-instillation direction toward the fully-installed position. Each closure-retainer surface 44 is configured to engage one of the plurality of closure anchors 22 in the installed position to block removal of closure 14 from vial 12 along axis of rotation 17.

Each of the plurality of closure retainers 34 is configured to pull closure 14 toward vial 12 as closure 14 is rotated in the closure-installation direction and at least some of the closure anchors 22 ride along a closure-displacement ramp 42 of each closure retainer 34. Closure 14 further includes an annular plug seal 46 and arranged to extend downwardly away from the top wall 36 through mouth 15 of vial 12 and into product-storage chamber 16 in the installed position. Annular plug seal 46 is adapted to engage an inner surface of side wall 30 of vial 12 to provide a liquid-and-air tight seal between closure 14 and vial 12.

Figure 8:
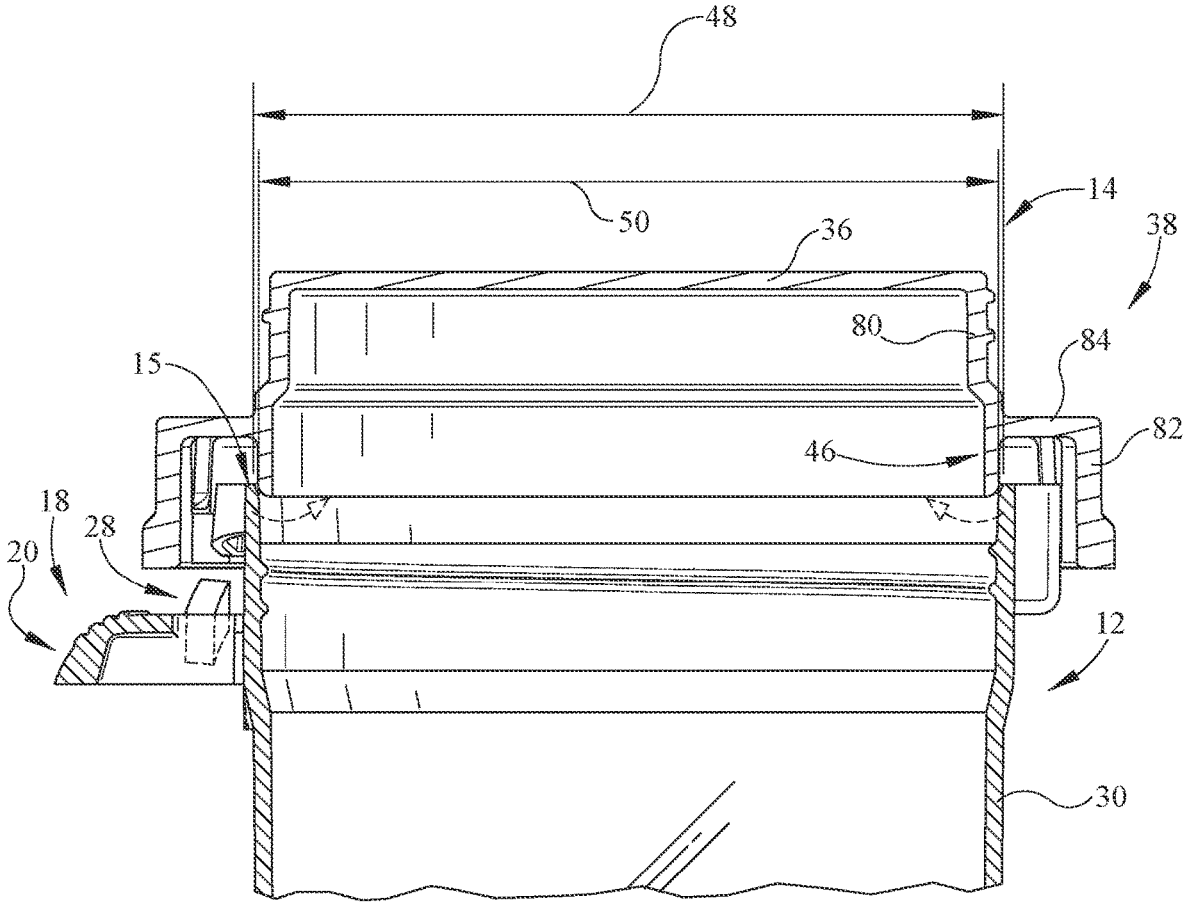
FIG. 8 is a sectional view of the package taken along line 8-8 in FIG. 5 showing that the closure further includes an annular plug that engages a radially inner surface of the vial defining the open mouth and that is configured to flex radially inwardly upon movement of the closure in the clockwise direction toward the fully-installed.

Annular plug seal 46 may bias closure 14 upwardly away from vial 12 as suggested in FIG. 8. A radially outer surface of annular plug seal 46 has a first diameter 48. A radially inner surface of side wall 30 of vial 12 at mouth 15 has a second diameter 50. The second diameter 50 is less than the first diameter 48 such that annular plug seal 46 flexes inwardly toward axis 17 as closure 14 is rotated onto vial 12. Forces provided by annular plug seal 46 on vial 12 may urge closure 14 away from vial 12 to facilitate removal of closure 14 from vial 12. Annular plug seal 46 extends downwardly from skirt 84 and upper side wall 80. Annular plug seal 46 is spaced radially from lower side wall 82 and vial 12 is received between annular plug seal 46 and lower side wall 82 when closure 14 is fully-installed.

Vial 12 does not include exterior threads and closure 14 does not include interior threads for coupling closure 14 to vial 12 in the child resistant mode. Instead, vial 12 includes circumferentially spaced closure retainers 34 and closure 14 includes circumferentially spaced closure anchors 22. The plurality of closure anchors 22 retain the functionality of threads, while also cooperating with closure-release control mechanism 18 to block removal of closure 14 from vial 12 when closure 14 is in the fully-installed position. Thus, threads have been omitted from the interior surface of closure 14 and the exterior surface of vial 12 while the thread function has been retained.

The closure-displacement ramp 42 transitions directly to the closure-retainer surface 44 such that a lower end of the closure-displacement ramp surface 42 and at least a portion of the closure-retainer surface 44 is located at a same height from the mouth 15 of vial 12. In the fully-installed position, an upper surface of the side wall 30 of vial 12 and each of the closure retainers 34 engages the closure 14 to block vertical movement of the closure 14 downwardly toward the vial 12. In this way, an operator need only rotate closure 14 in the counterclockwise direction with the locking tab 28 disengaged from the closure anchors 22 to remove closure 14 from vial 12.

At least one of the plurality of closure retainers 34 further includes a rotation-blocking stop 52 that extends downwardly from the closure-retainer surface 44 at a circumferential end of the closure-retainer surface 44 opposite the closure-displacement ramp 42. The rotation-blocking stop 52 is configured to engage one of the closure anchors 22 in the installed position to block further rotation of closure 14 in the closure-installation direction. In the illustrative embodiment, only three out of the four closure retainers 34 includes a rotation-blocking stop 52, however, any suitable number of rotation-blocking stops 52 may be used.

In illustrative embodiments, vial 12 further includes a retainer motion blocker 60 coupled to side wall 30 of vial 12. The retainer motion blocker 60 is positioned above the closure-release control mechanism 18. The retainer motion blocker 60 is also aligned circumferentially with one of the closure anchor 22 that is engaged with locking tab 28 when closure 14 is in the fully-installed position. The retainer motion blocker 60 is configured to block vertical movement of the closure anchor 22 relative to the locking tab 28 so as to avoid unintentional removal of closure 14 from vial 12.

The retainer motion blocker 60 is similar to the closure retainers 34. The retainer motion blocker 60 has a circumferential length that is less than a circumferential length of each of the plurality of closure retainers 34. The retainer motion blocker 60 also has a radial thickness that is about equal to a radial thickness of each of the plurality of closure retainers 34. In some embodiments, the retainer motion blocker 60 may be the same as one or all of the closure retainers 34. In yet another embodiment, the retainer motion blocker 60 may be omitted.

Each of the closure retainers 34 and the retainer motion blocker 60 is partially spaced apart from the side wall 30 of vial 12 such that a hollow space 54 is formed between an outer surface 56 of each closure retainer 34 and side wall 30. Providing the hollow space 54 between each closure retainer 34 and the side wall 30 reduces the amount material needed to form vial 12 thereby decreasing the cost of vial 12 and package 10. Each closure retainer 34 may include a support rib 58 that extends outward from the side wall toward the outer surface of a corresponding closure retainer through the hollow space 54.

Locking tab 28 is configured to move independently of movable release element 20 about first horizontal pivot axis 28H1 when closure 14 is attached to vial 12, as shown in FIG. 2. Locking tab 28 is also configured to move with movable release element 20 and relative to annular sidewall 30 about second horizontal pivot axis 28H2 to allow removal of closure 14 from vial 12 as suggested in FIG. 16.

Locking tab 28 is configured to engage one of closure anchors 22 included in closure 14 to block removal of closure 14 from vial 12 until a downwardly directed push force is applied to movable release element 20. Rotation of closure 14 in a clockwise closure-installation direction causes one of the closure anchors 22 to engage locking tab 28 to cause locking tab 28 to deflect and move about horizontal pivot axis 28H1 in downward direction 35. Downward movement of locking tab 28 by the closure anchor 22 about horizontal pivot axis 28H1 does not cause movement of movable release element 20 relative to annular sidewall 38. Application of a downward push force to movable release element 20 by a consumer causes locking tab 28 to move or pivot below closure anchors 22 about second horizontal pivot axis 28H2 to allow for removal of closure 14 from vial 12.

Locking tab 28 includes a sloped upper surface 70 and a rotation-blocking surface 72. Sloped upper surface 70 is configured to be engaged by one of the closure anchors 22 of closure 14 during rotation of closure 14 in a clockwise closure-installation direction 37 on vial 12 to cause locking tab 28 to pivot downwardly in direction 35 about horizontal pivot axis 28H1 to allow the closure anchor 22 to move past locking tab 28 during installation of closure 14 onto vial 12.

Figure 5:
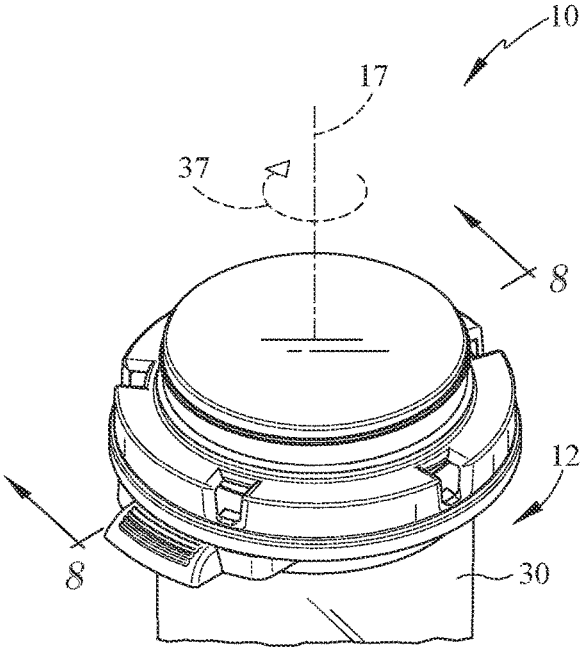
FIG. 5 is a partial perspective view of the package with the closure lowered onto the vial with each of the closure anchors positioned between two adjacent closure retainers and a phantom arrow suggesting that the closure can be rotated in the clockwise direction to lock the closure on the vial.
Figure 6:
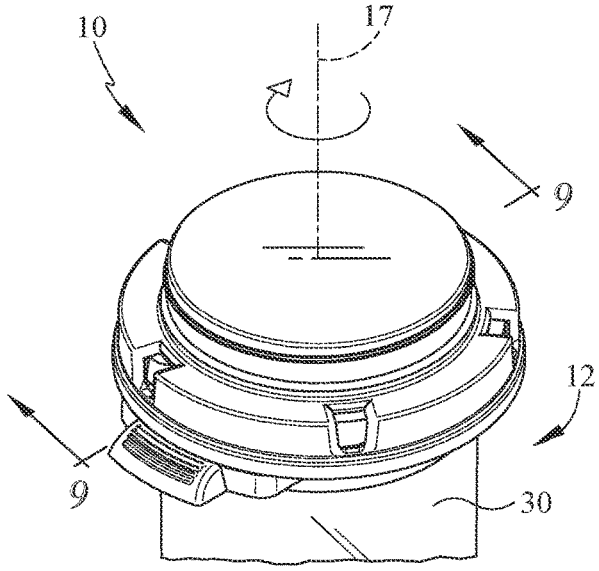
FIG. 6 is a partial perspective view of the closure in a fully-installed position on the vial where each of the closure anchors is positioned directly beneath a corresponding one of the plurality of closure retainers and one of closure anchors is blocked from rotating in the counterclockwise direction by the locking tab.
Figure 9:
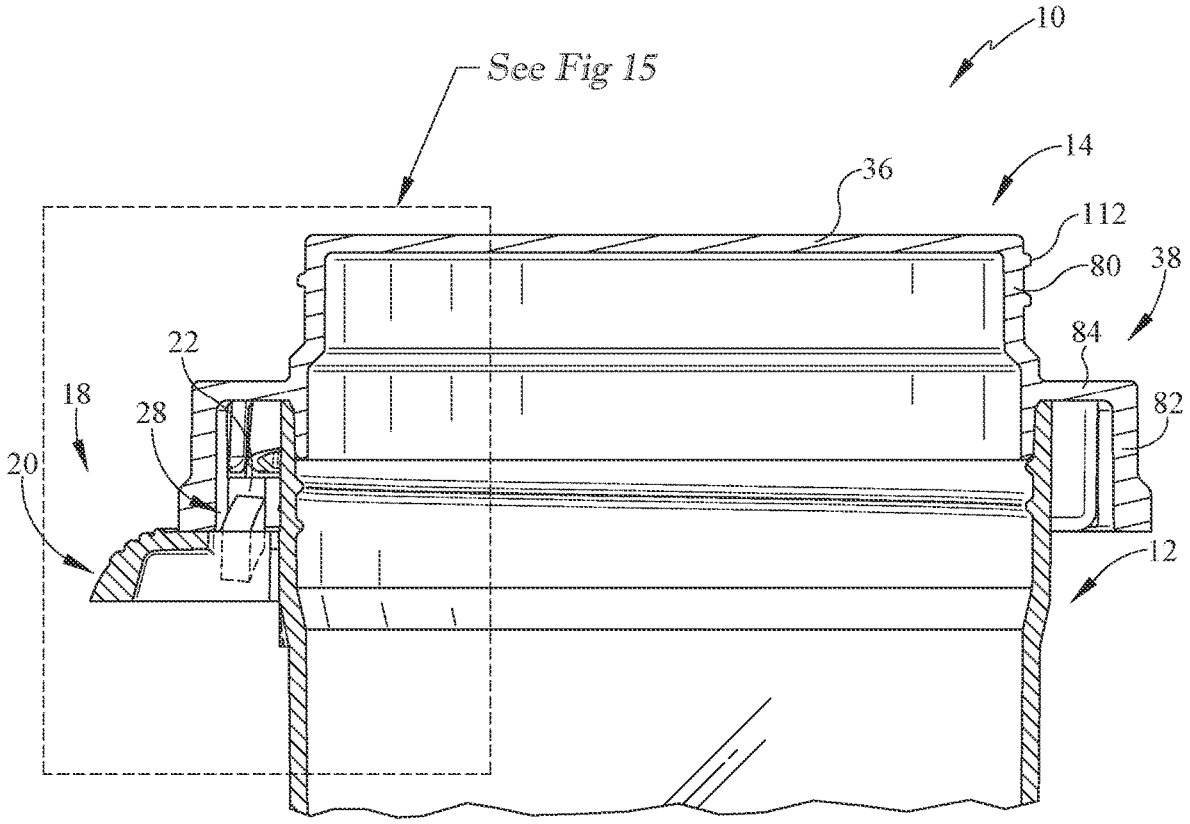
FIG. 9 is a sectional view of the package taken along line 9-9 in FIG. 6 showing the closure in the fully-installed position on the vial.
Figure 10:
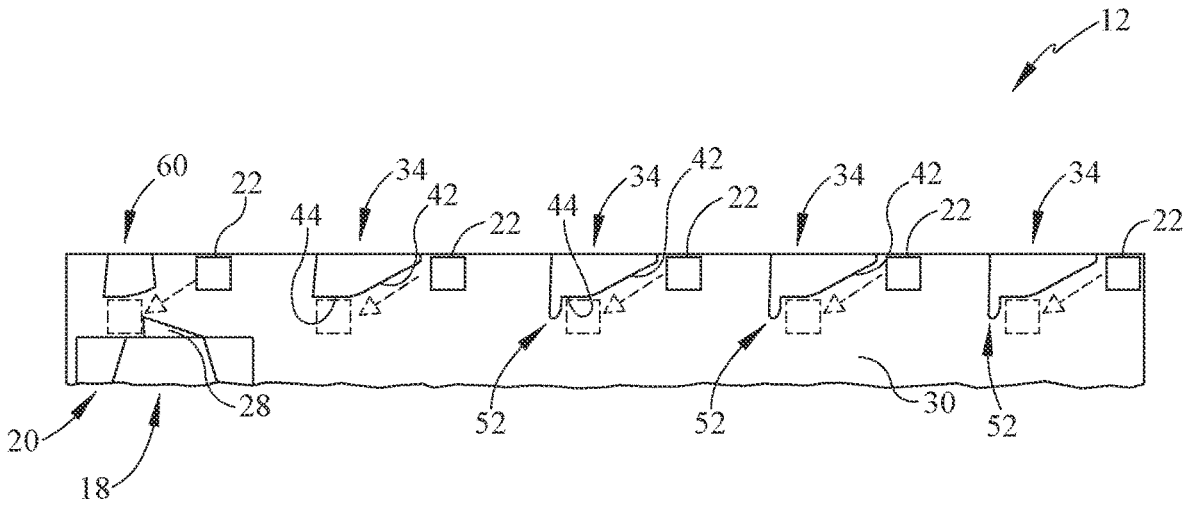
FIG. 10 is a diagrammatic view of an upper end of the vial unrolled to show each of the closure retainers and each of the closure anchors, in dashed lines, moving from an uninstalled position, in which each of the closure anchors is offset circumferentially and from each of the plurality of closure retainers, and the fully-installed position in which each of the plurality of closure anchors lies beneath a corresponding one of the plurality of closure retainers and one of the closure anchors engages a circumferential, rotation-blocking surface of the locking tab.
Figure 11:
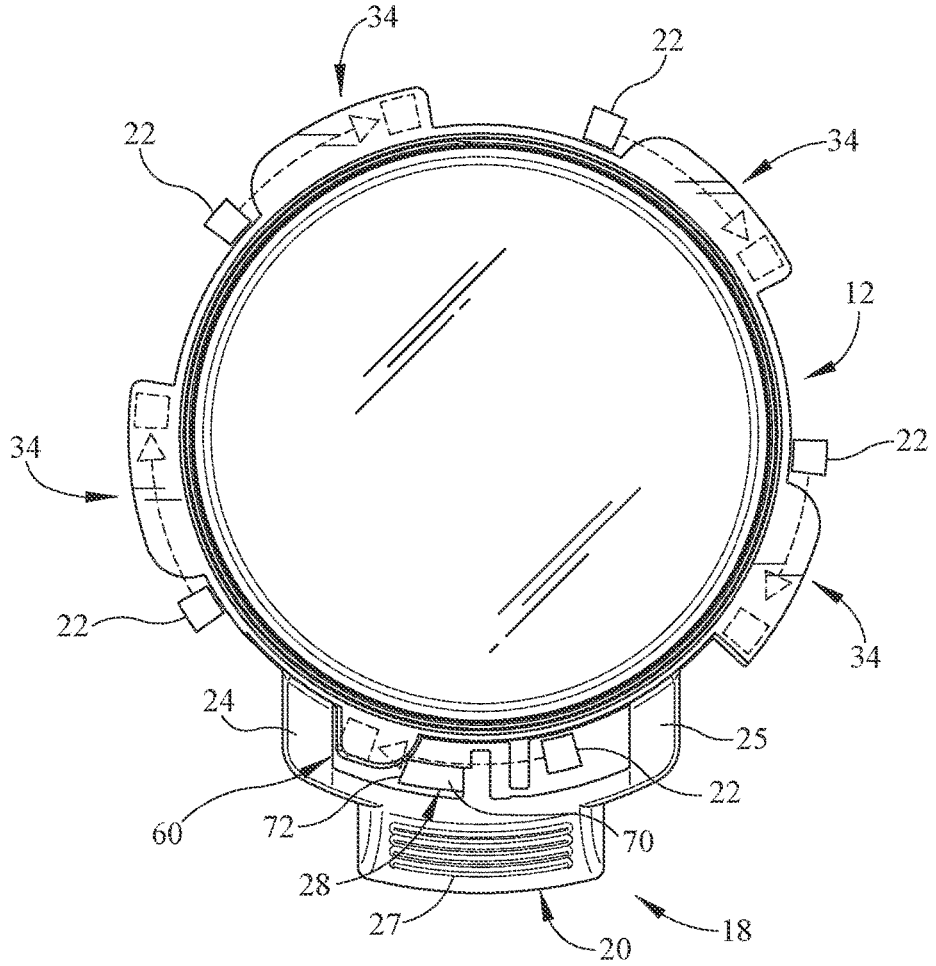
FIG. 11 is a top plan view of the vial showing each of the plurality of closure anchors, in dashed lines, moving from the uninstalled position to the fully-installed position.

During installation of closure 14 in clockwise closure-installation direction 37 onto vial 12 closure anchor 22 moves toward sloped upper surface 70 of locking tab 28. Continued rotation of closure 14 in clockwise closure-installation direction 37 causes closure anchor 22 to engage sloped upper surface 70 of locking tab 28 and move locking tab 28 about horizontal pivot axis 28H1 in downward direction 35, as shown in FIGS. 5 and 9. Continued rotation of closure 14 causes closure anchor 22 to move past locking tab 28, resulting in locking tab 28 snapping back to its original position owing, in part, to elasticity of locking tab 28. With locking tab 28 in its original position, the pathway for closure anchor 22 is blocked and closure 14 cannot be removed from vial 12.

Figure 7:
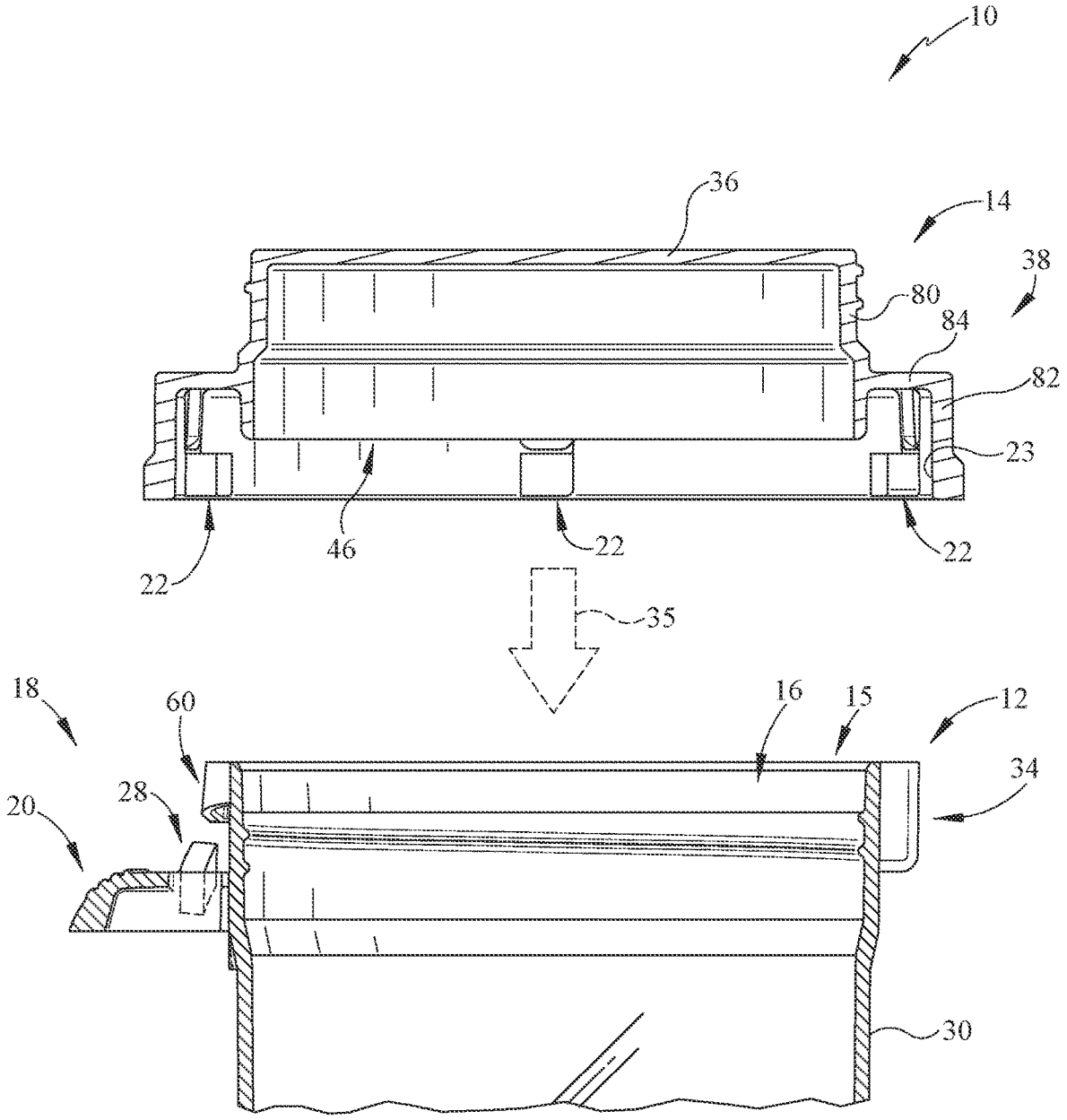
FIG. 7 is a sectional view of the package taken along line 7-7 in FIG. 4.

Side wall 38 of closure 14 includes an upper side wall 80, a lower side wall 82, and a skirt 84 that interconnects the upper side wall 80 and the lower side wall 82 as shown in FIG. 7. The external threads 112 of closure 14 are coupled to an outer surface of upper side wall 80. Each of the closure anchors 22 are coupled to an inside surface of lower side wall 82. Annular plug seal 46 extends downwardly from skirt 84 and is spaced radially inward from the lower side wall 82. The lower side wall 82 is formed to include a plurality of openings 86 that pass through the lower side wall 82 and are aligned circumferentially with each closure anchor. Closure 14 may be formed during a thermoforming process which uses the material removed from the portions of lower side wall 82 that define each opening 86 to form each closure anchor 22.

Figure 18:
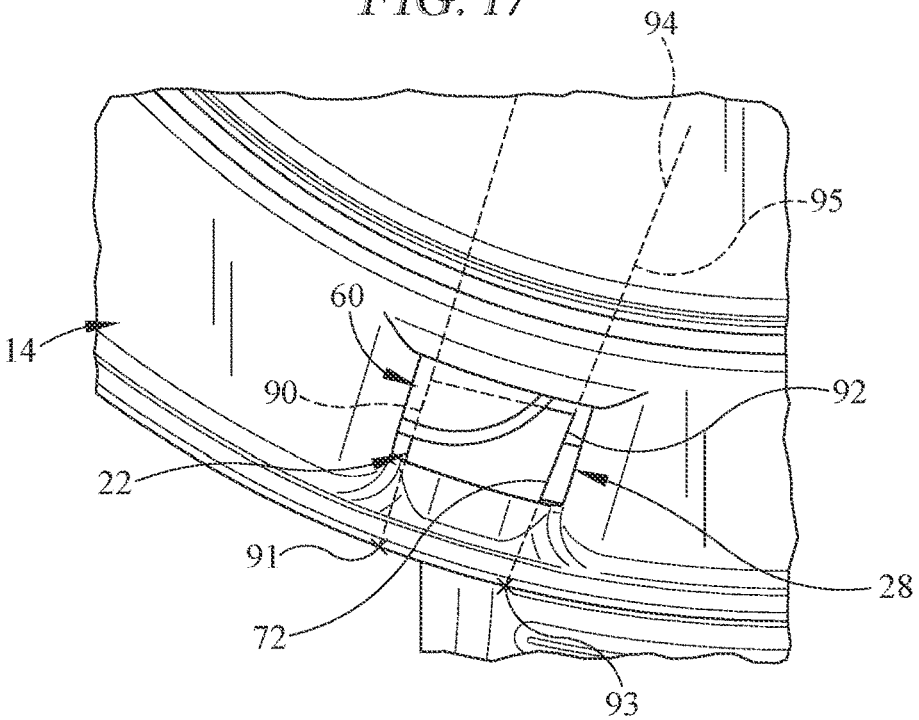
FIG. 18 is a top plan view of a portion of the package from FIG. 17 showing that each closure anchor includes a first circumferential surface that extends along a first plane and a second circumferential surface that extends along a second plane angled toward the counterclockwise direction and configured to cooperate with the circumferential, rotation, blocking surface of the locking tab to urge the closure anchor radially inwardly toward the annular side wall of the vial if the closure is rotated in the counterclockwise direction without disengaging the locking tab from the closure anchor so that the closure anchor is retained beneath an anchor-motion blocker to block unintentional removal of the closure from the vial.

Each closure anchor 22 is formed generally in the shape of a cube as shown in FIGS. 2 and 18, although other suitable shapes or structures may also be used in other embodiments. Each closure anchor 22 is shaped to cooperate with the locking tab 28 to avoid unintentional unlocking of closure 14. Each closure anchor 22 includes a clockwise or first circumferential side 90 and a counterclockwise or second circumferential side 92. The first circumferential side 90 is arranged to lie at a right angle relative to a point of tangency 91 on side wall 38 radially outward from the first circumferential side 90 of the respective closure anchor 22. The second circumferential side 92 is arranged to lie an acute angle relative to a point of tangency 93 on side wall 38 radially outward from the second circumferential side 92 of the respective closure anchor 22. In this way, the second circumferential side 92 is arranged to extend along a plane 94 in the counterclockwise direction.

Rotation-blocking surface 72 of locking tab 28 is similarly arranged to extend along a plane 95 that is generally parallel with plane 94 when second circumferential side 92 directly contacts rotation-blocking surface 72. Rotation of closure 14 in the counterclockwise direction without moving the locking tab 28 out of the path of closure anchor 22 will cause the closure anchor to deflect radially inwardly toward side wall 30 of vial 12. The closure anchor 22 is retained beneath the retainer motion blocker 60 due to the deflection of the closure anchor 22 by the rotation-blocking surface 72.

The illustrated and described arrangement of vial 12 with closure retainers 34 may minimize complexity in tooling when manufacturing package 10 and/or vial 12. Closure retainers 34 provide a downward sealing force when a clockwise rotation is applied to the closure 14. However, closure retainers 34 may be simpler to mold than threads which extend annularly around a vial. A tool and/or mold to manufacture a vial having threads may require several actions, movements, or splits within the mold to manufacture the vial. For example, such a tool may employ a rotating action or an additional split. This can complicate the tool and can increase the cost of manufacture. The vial 12 of the present disclosure may be formed by a two-piece cavity and core tool and/or mold for manufacture. This may minimize complication of the tool and may reduce manufacturing costs while providing a vial 12 with closure retainers 34 to retain closure 14 on vial 12.

Figure 19:
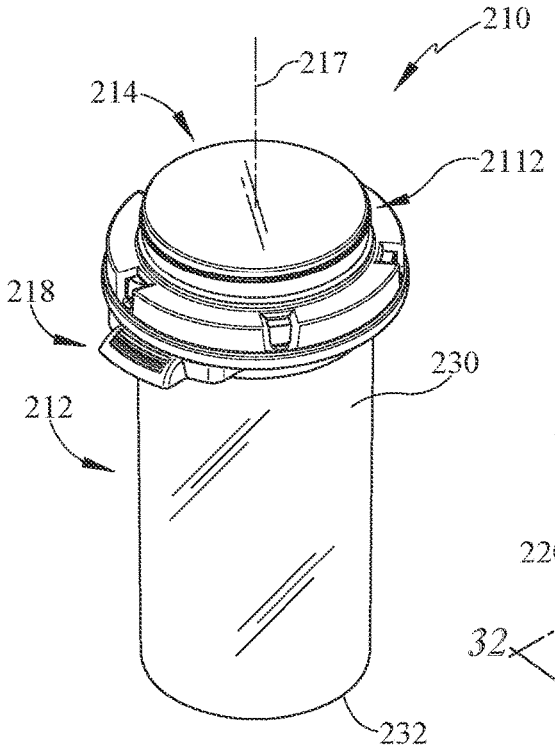
FIG. 19 is a perspective view of a child-resistant package in accordance with a second embodiment of the present disclosure showing a vial, a closure mounted on the vial to cover a mouth opening into an interior region formed in the vial, and a closure-release control mechanism having a movable release element that is coupled to the vial and configured to disengage a locking tab coupled to the vial from a closure anchor included in the closure to permit the release of the closure from the vial.
Figure 20:
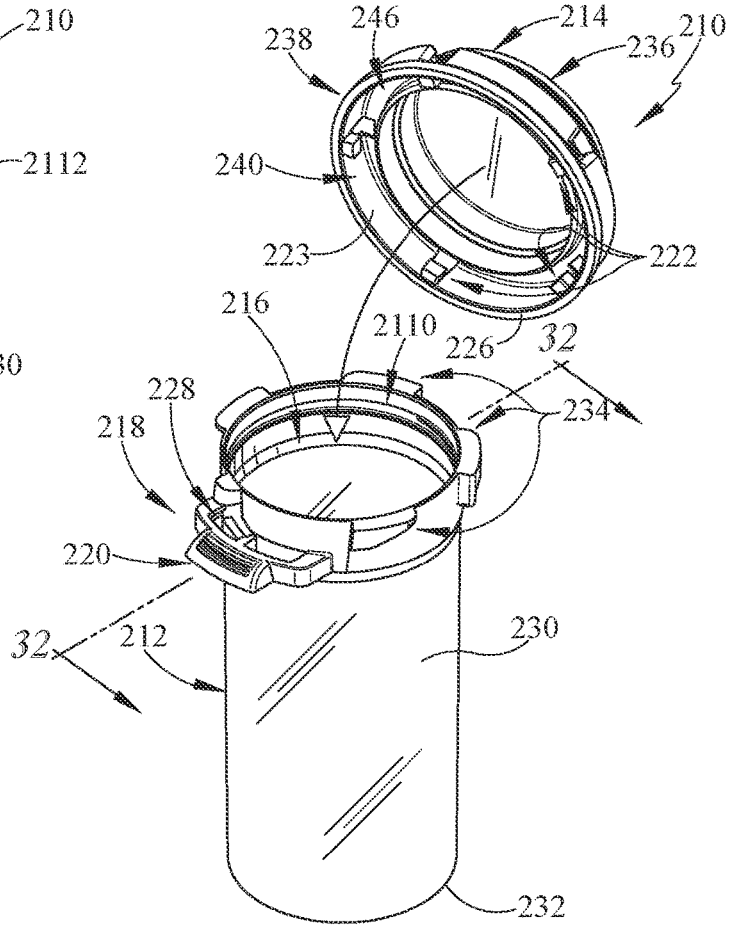
FIG. 20 is an exploded assembly view of the child-resistant package of FIG. 19, showing the closure separated from the vial to reveal a plurality of closure anchors coupled to a perimeter edge of a rim of the closure and showing the movable release element coupled to an annular flange of the vial and an inclined locking tab included in the closure-release control mechanism and configured to engage one of the plurality of closure retainers in the closure as suggested in FIGS. 24, 28, and 33 to block selectively removal of the closure from the vial until a downward directed push force is applied to the movable release element to disengage the locking tab from the closure anchor as shown in FIG. 34.

A child-resistant package 210 in accordance with a second embodiment of the present disclosure includes a vial 212, or container, and a closure 214 mounted on vial 212 to cover a mouth 215 opening into a product-storage chamber 216 formed in vial 212, as shown in the illustrative embodiment of FIGS. 19 and 20. Vial 212 is adapted to accept closure 214 to seal in the contents of vial 212. Product-storage chamber 216 is adapted to contain product, such as medication, and is sealed when closure 214 is coupled to vial 212. Child-resistant package 210 also includes a closure-release control mechanism 218 configured to control release of closure 214 from vial 212.

Vial 212 includes an annular sidewall 230, a floor 232 coupled to a lower end of side wall 230, and a plurality of closure retainers 234 coupled to an outer surface of an upper end of the side wall 230 as shown in FIG. 20. Side wall 230 extends vertically along an axis 217 of child-resistant package 210. Side wall 230 and floor 232 cooperate to define product-storage chamber 216 of vial 212. The plurality of closure retainers 234 extend outwardly away from axis 217 and are configured to cooperate with closure 214 to retain closure 214 on vial 212 in a full-installed position as shown in FIG. 19. Closure 214 is arranged to be coupled to vial 212 after rotation of closure 214 about axis of rotation 217, as shown, for example, in FIG. 19. Vial 212 does not include external threads and uses only the plurality of closure retainers 234 to mount closure 214 on vial 212 when the package 210 is being used in a child-resistant mode.

Closure 214 includes a round top wall 236 and an annular sidewall 238 that depends downwardly from top wall 236. Top wall 236 and side wall 238 form an interior region 240 of closure 214. Closure 214 does not include threads on side wall 238 within interior region 240 of closure 214, and, instead, further includes a plurality of closure anchors 222 that are coupled to an inside surface 223 of side wall 238 in interior region 240. The plurality of closure anchors 222 are configured to engage the plurality of closure retainers 234 so that closure 214 is retained to vial 212 after rotation of closure 214 about axis of rotation 217, as shown, for example, in FIG. 19.

Figure 34:
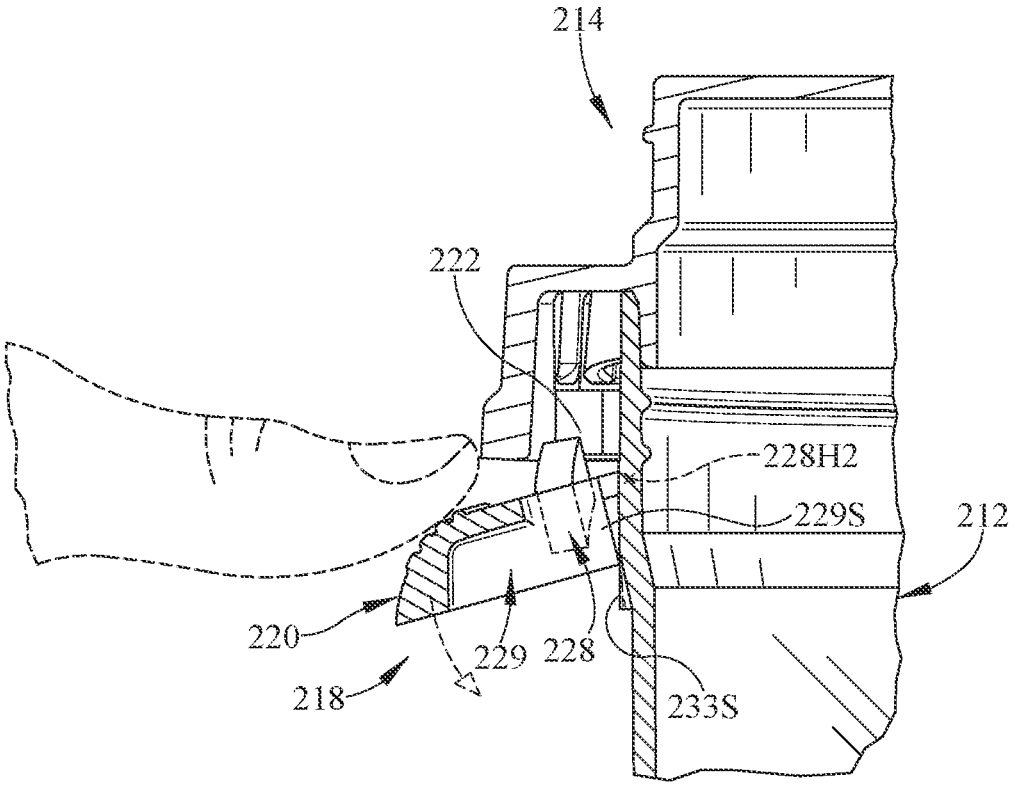
FIG. 34 is a cross-section of the portion of the package shown in FIG. 33 showing the thumb of the user pushing the closure release element downwardly to disengage the locking tab from the closure anchor so that the closure can be rotated in the counterclockwise direction to remove the closure from the vial for access to contents within the vial.
Figure 35:
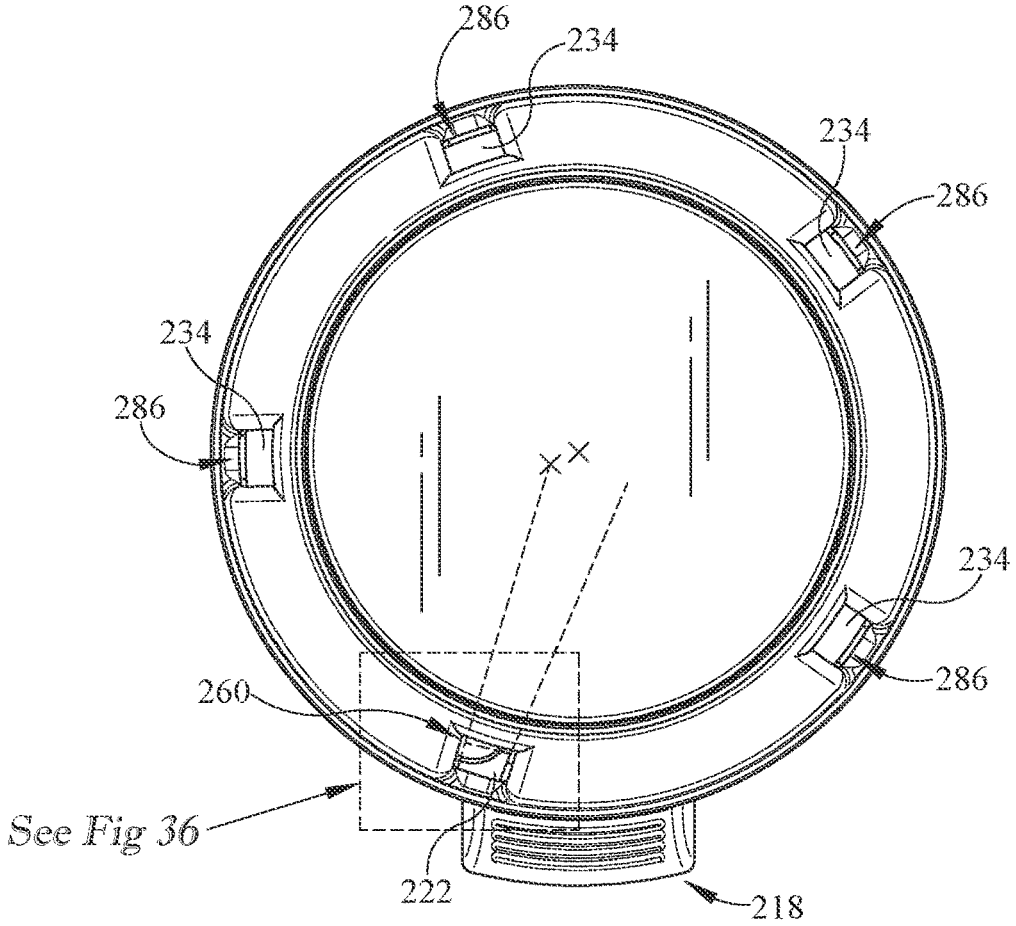
FIG. 35 is a top plan view of the package with the closure in the fully-installed position on the vial.

Closure-release control mechanism 218 comprises a movable release element 220 coupled to vial 212 and a locking tab 228 mounted on vial 212 for two-axis pivotable movement about a first horizontal pivot axis 228H1 during installation of closure 214 on vial 212 and about a second horizontal pivot axis 228H2 during removal of closure 214 from vial 212. Closure-release control mechanism 218 further comprises a plurality of radially inwardly extending closure anchors 222 coupled to a rim 226 of closure 214, as shown in FIG. 20. Removal of closure 214 from vial 212 is blocked when locking tab 228 included in closure-release control mechanism 218 and coupled to movable release element 220 is positioned to lie in the pathway of one of the plurality of closure anchors 222. When a consumer pushes movable release element 220 to flex downwardly as shown in FIG. 34, locking tab 228 moves out of the pathway of the one of the plurality of closure anchors 222 on closure 214 to permit counterclockwise rotation and removal of closure 214 from vial 212, as suggested in FIG. 34. Vial 212 also includes internal threads 2110 that correspond to external threads 2112 on an exterior surface of side wall 238 opposite interior region 240 of closure 214 to allow closure 214 to be coupled to vial 212 in a non-child resistant mode. To change closure 214 to the non-child resistant mode, closure 214 is removed from vial 212, inverted, and top wall 236 of closure 214 is inserted through open mouth 215 and coupled to vial 212 via threads 2110, 2112. When closure 214 is in the non-child resistant mode, closure-release control mechanism 218 does not work to block removal of closure 214 from vial 212.

Figure 21:
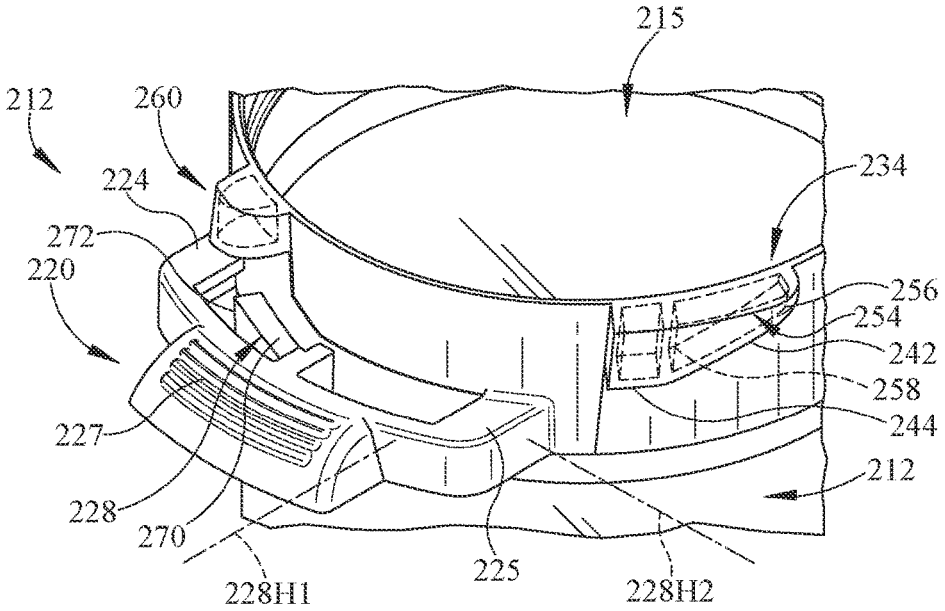
FIG. 21 is an enlarged perspective view of a portion of the vial of FIG. 20 showing the inclined locking tab positioned to lie between the movable release element and an annular sidewall included in the vial and showing that the vial includes a plurality of closure retainers coupled to the annular sidewall and adapted to engage a respective one of the plurality of closure anchors upon rotation of the closure in a clockwise direction relative to the vial until one of the closure anchors engages a circumferential surface of the inclined locking tab to block the closure from rotating in a counterclockwise direction until the downward push force is applied on the movable release element.
Figure 22:
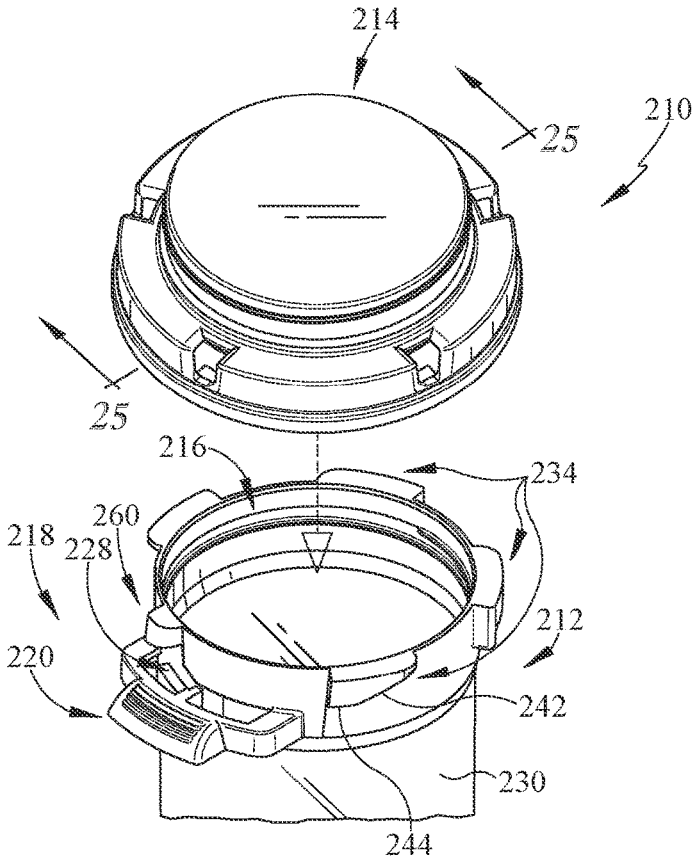
FIG. 22 is a partial perspective and exploded view of the package from FIG. 19 showing the closure removed from the vial and a downward arrow suggesting that, in order to close and lock the closure on the vial, the closure is lowered onto the vial with each of the closure anchors positioned between two adjacent closure retainers.

Movable release element 220 includes a pair of support arms 224, 225 and an actuator pad 227 as shown in FIG. 21. The pair of support arms 224, 225 extend radially outward from side wall 230 of vial 212 and are spaced apart from one another circumferentially about axis 217. Actuator pad 227 extends between and interconnects the pair of support arms 224, 225. Locking tab 228 is coupled to actuator pad 227, but may be coupled to one of the support arms 224, 225 in other embodiments. An operator may use the actuator pad 227 to deform the pair of support arms 224, 225 and pivot the locking tab 228 downwardly with the actuator pad 227 about second horizontal axis 228H2 out of the path of the plurality of closure anchors 222 so that closure 214 can be removed from vial 212. Actuator pad 227 further includes a plurality of ribs 221 as shown in FIGS. 30-32 to provide a gripping surface for the operator's thumb.

Figure 30:
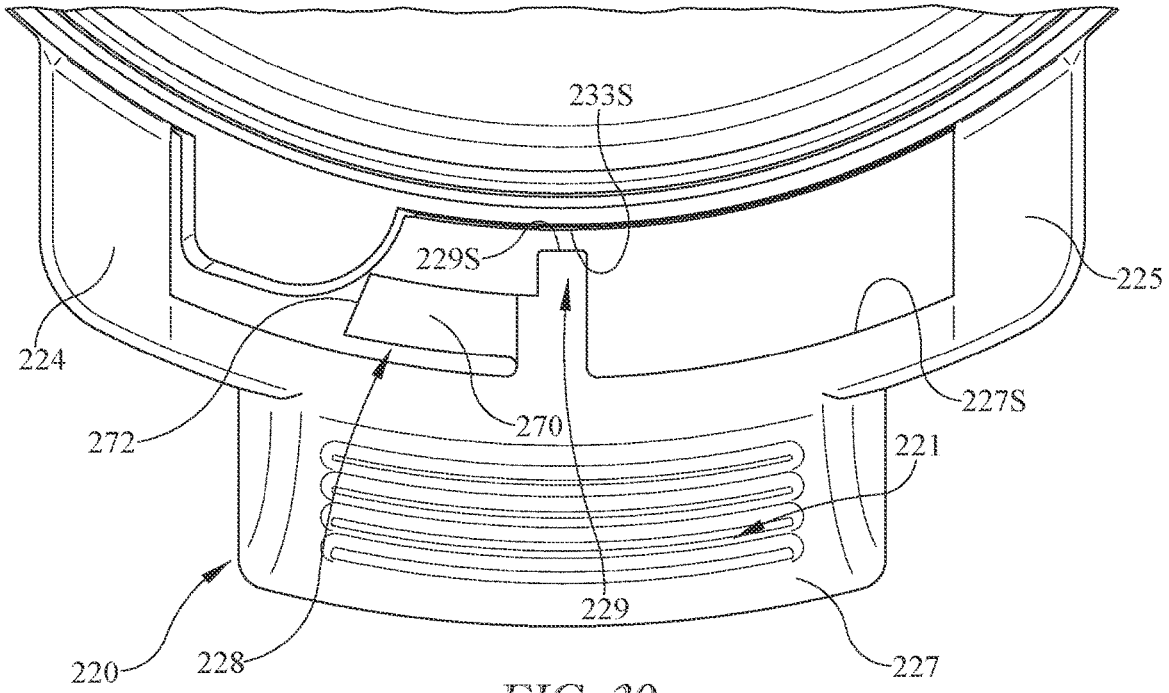
FIG. 30 is a top plan view of the closure-release control mechanism shown in FIG. 19 showing that closure-release control mechanism includes a travel limiter coupled to the movable release element and adapted to engage a companion travel-limiter wall coupled to the annular side wall of the vial.
Figure 31:
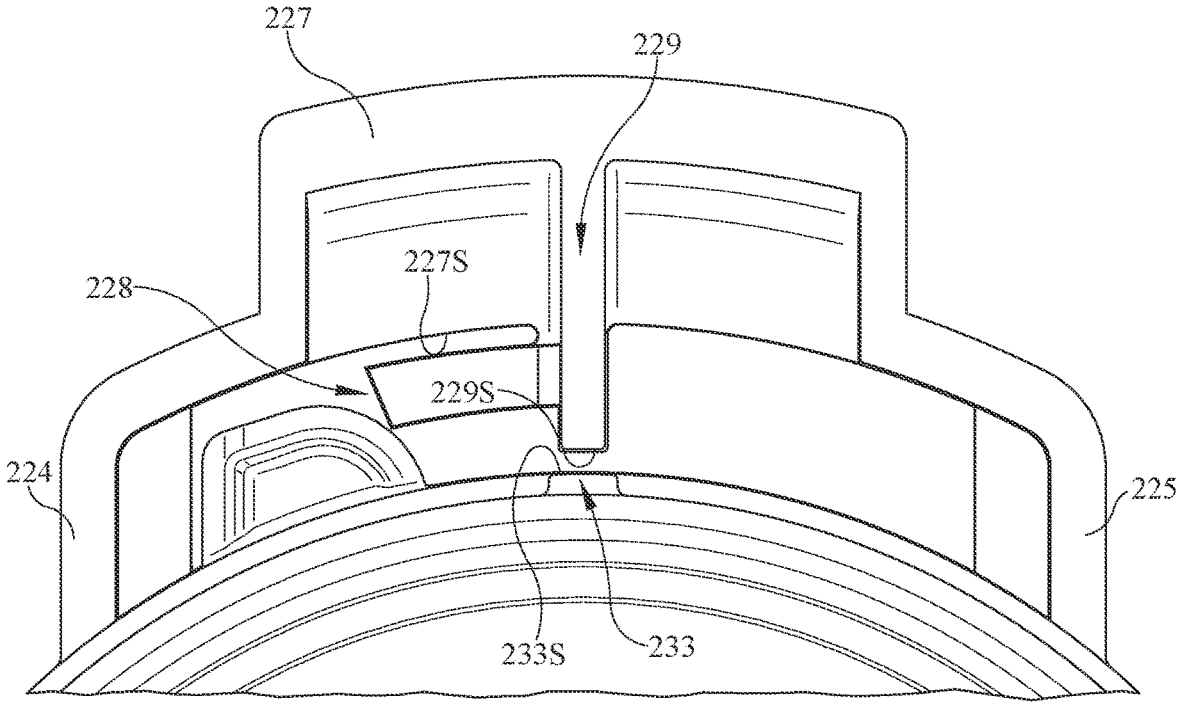
FIG. 31 is a bottom plan view of the closure-release control mechanism shown in FIG. 30.

Closure-release control mechanism 218 further includes a travel limiter 229 and a companion travel-limiter wall 233 as shown in FIGS. 30 and 31. In the illustrative embodiment shown in FIG. 30, travel limiter 229 is coupled to and extends radially inward from actuator pad 227 of movable release element 220. Travel limiter 229 is integrally coupled to locking tab 228.

Figure 32:
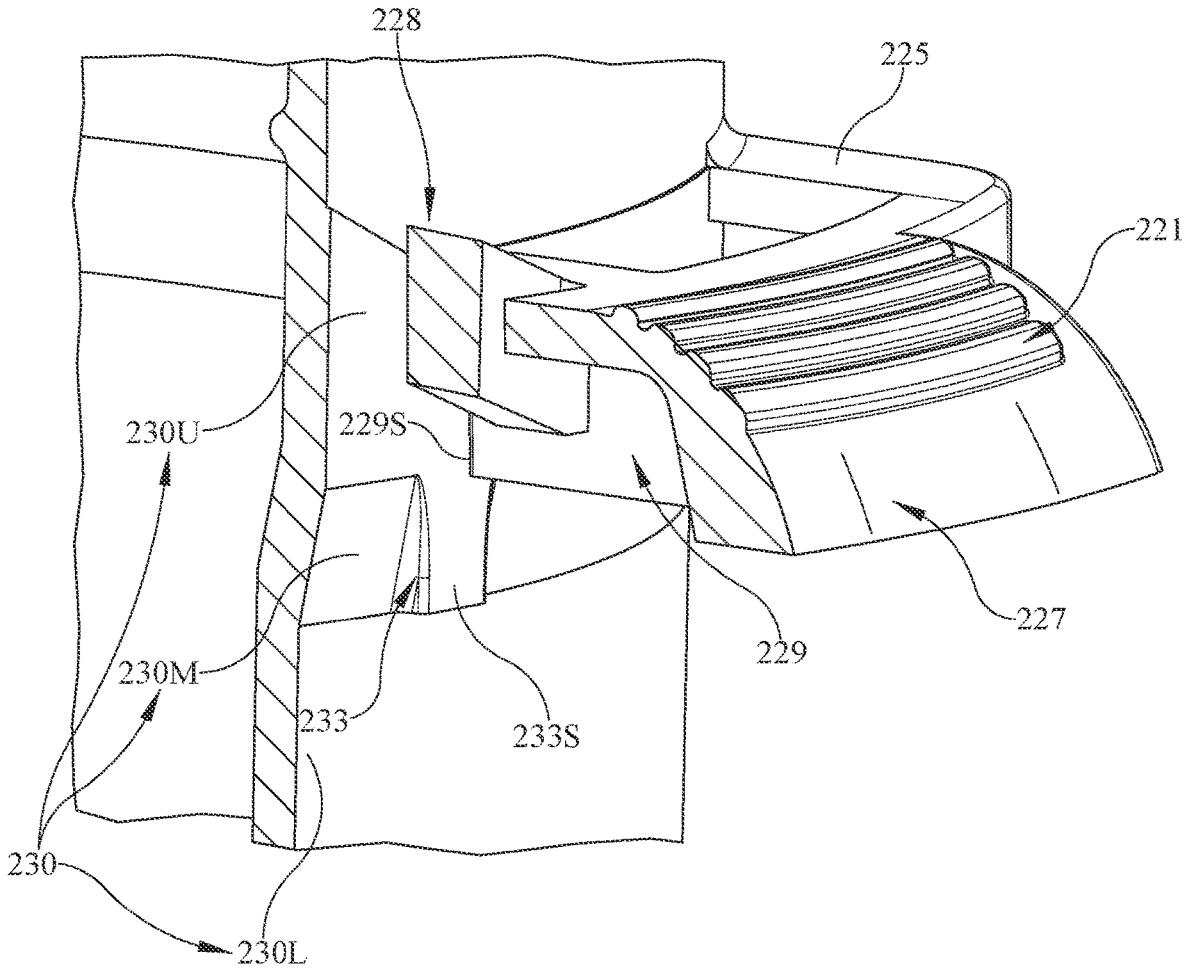
FIG. 32 is a sectional view of the closure-release control mechanism taken along line 32-32 shown in FIG. 20.
Figure 33:
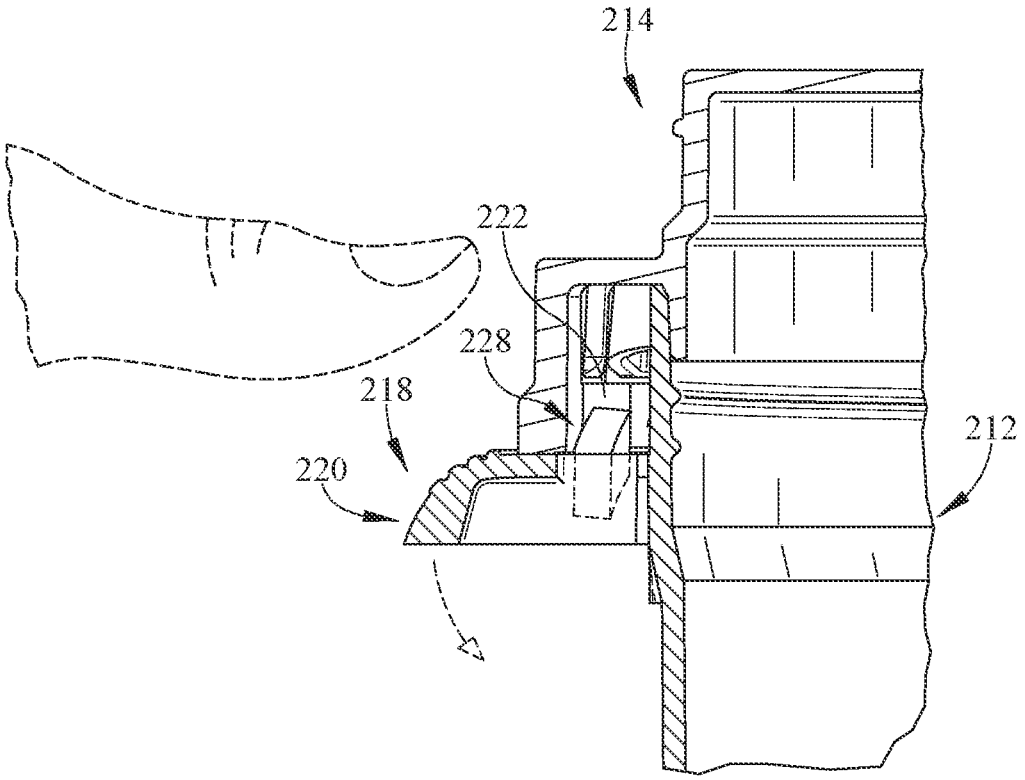
FIG. 33 is a cross-section of a portion of the package from FIG. 27 showing the closure in the fully-installed position and a thumb of a user being lowered toward the closure release element.

Companion travel-limiter wall 233 is coupled to and extends radially outward from a middle section 230M of annular side wall 230 relative to axis 217 as shown in FIG. 32. Companion travel-limiter wall 233 includes a contacting surface 233S that is radially aligned with an upper section 230U of annular side wall 230 and parallel to a lower section 230L of annular side wall 230. Alternatively, the contacting surface 233S of companion travel-limiter walls 233 may be a surface of the annular side wall 230. Contacting surface 233S is parallel to a contacting surface 229S of first travel limiter 229 when the movable release element 220 is not deformed. The radial length of travel limiter 229 and companion travel-limiter walls 233 each may be any radial length between actuator pad 227 and annular side wall 230.

When an operator pushes movable release element 220 to flex downwardly, contacting surface 229S of travel limiter 229 may engage contacting surface of 233S of companion travel-limiter wall 233. The engagement of the contacting surfaces 229S and 233S stops the locking tab 228 and the actuator pad 227 from further pivoting about second horizontal axis 228H2 and deforming beyond the elastic limit of the actuator pad 227. The travel limiter 229 and companion travel-limiter walls 233 cooperate to reduce wear on movable release element 220 and block breakage or permanent deformation of the pair of support arms 224, 225.

In the illustrative embodiment shown in FIGS. 30 and 31, travel limiter 229 is arranged at a circumferential midpoint of the actuator pad 227. Companion travel-limiter wall 233 is circumferentially aligned with travel limiter 229 relative to axis 217. Lock tab 228 is integrally coupled to and extends circumferentially from travel limiter 229 towards support arm 224. In other embodiments, travel limiter 229 may be positioned at any point along the radially inward surface 227S of actuator pad 227 so long as it is circumferentially aligned with companion travel-limiter wall 233 and/or contacting surface 233S.

Each of the plurality of closure retainers 234 includes a closure-displacement ramp 242 and a closure-retainer surface 244 as shown in FIG. 21. Each closure-displacement ramp 242 is configured to engage one of the plurality of closure anchors as closure 214 is rotated in a closure-instillation direction toward the fully-installed position. Each closure-retainer surface 244 is configured to engage one of the plurality of closure anchors 222 in the installed position to block removal of closure 214 from vial 212 along axis of rotation 217.

Each of the plurality of closure retainers 234 is configured to pull closure 214 toward vial 212 as closure 214 is rotated in the closure-installation direction and at least some of the closure anchors 222 ride along a closure-displacement ramp 242 of each closure retainer 234. Closure 214 further includes an annular plug seal 246 and arranged to extend downwardly away from the top wall 236 through mouth 215 of vial 212 and into product-storage chamber 216 in the installed position. Annular plug seal 246 is adapted to engage an inner surface of side wall 230 of vial 212 to provide a liquid-and-air tight seal between closure 214 and vial 212.

Figure 26:
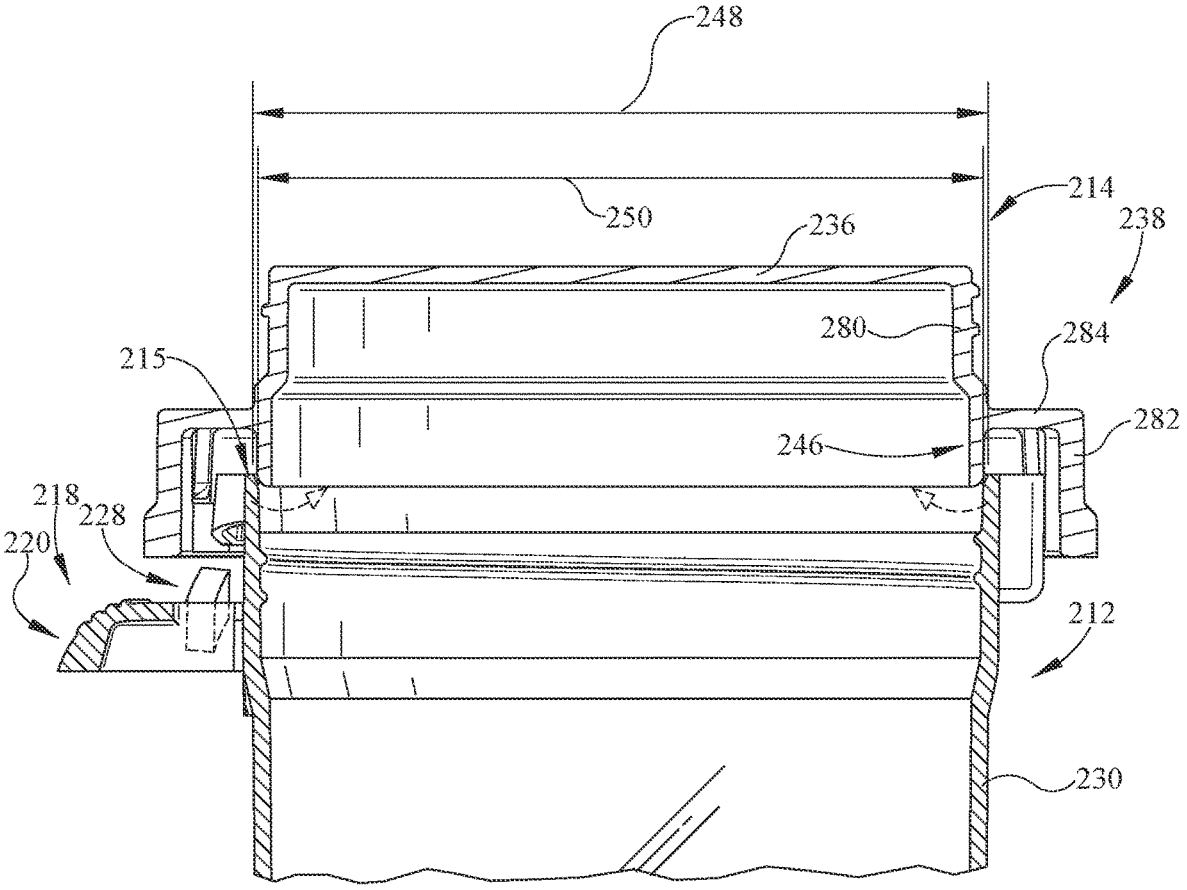
FIG. 26 is a sectional view of the package taken along line 26-26 in FIG. 23 showing that the closure further includes an annular plug that engages a radially inner surface of the vial defining the open mouth and that is configured to flex radially inwardly upon movement of the closure in the clockwise direction toward the fully-installed.

Annular plug seal 246 may bias closure 214 upwardly away from vial 212 as suggested in FIG. 26. A radially outer surface of annular plug seal 246 has a first diameter 248. A radially inner surface of side wall 230 of vial 212 at mouth 215 has a second diameter 250. The second diameter 250 is less than the first diameter 248 such that annular plug seal 246 flexes inwardly toward axis 217 as closure 214 is rotated onto vial 212. Forces provided by annular plug seal 246 on vial 212 may urge closure 214 away from vial 212 to facilitate removal of closure 214 from vial 212. Annular plug seal 246 extends downwardly from skirt 284 and upper side wall 280. Annular plug seal 246 is spaced radially from lower side wall 282 and vial 212 is received between annular plug seal 246 and lower side wall 282 when closure 214 is fully-installed.

Vial 212 does not include exterior threads and closure 214 does not include interior threads for coupling closure 214 to vial 212 in the child resistant mode. Instead, vial 212 includes circumferentially spaced closure retainers 234 and closure 214 includes circumferentially spaced closure anchors 222. The plurality of closure anchors 222 retain the functionality of threads, while also cooperating with closure-release control mechanism 218 to block removal of closure 214 from vial 212 when closure 214 is in the fully-installed position. Thus, threads have been omitted from the interior surface of closure 214 and the exterior surface of vial 212 while the thread function has been retained.

The closure-displacement ramp 242 transitions directly to the closure-retainer surface 244 such that a lower end of the closure-displacement ramp surface 242 and at least a portion of the closure-retainer surface 244 is located at a same height from the mouth 215 of vial 212. In the fully-installed position, an upper surface of the side wall 230 of vial 212 and each of the closure retainers 234 engages the closure 214 to block vertical movement of the closure 214 downwardly toward the vial 212. In this way, an operator need only rotate closure 214 in the counterclockwise direction with the locking tab 228 disengaged from the closure anchors 222 to remove closure 214 from vial 212.

At least one of the plurality of closure retainers 234 further includes a rotation-blocking stop 252 that extends downwardly from the closure-retainer surface 244 at a circumferential end of the closure-retainer surface 244 opposite the closure-displacement ramp 242. The rotation-blocking stop 252 is configured to engage one of the closure anchors 222 in the installed position to block further rotation of closure 214 in the closure-installation direction. In the illustrative embodiment, only three out of the four closure retainers 234 includes a rotation-blocking stop 252, however, any suitable number of rotation-blocking stops 252 may be used.

In illustrative embodiments, vial 212 further includes a retainer motion blocker 260 coupled to side wall 230 of vial 212. The retainer motion blocker 260 is positioned above the closure-release control mechanism 218. The retainer motion blocker 260 is also aligned circumferentially with one of the closure anchor 222 that is engaged with locking tab 228 when closure 214 is in the fully-installed position. The retainer motion blocker 260 is configured to block vertical movement of the closure anchor 222 relative to the locking tab 228 so as to avoid unintentional removal of closure 214 from vial 212.

The retainer motion blocker 260 is similar to the closure retainers 234. The retainer motion blocker 260 has a circumferential length that is less than a circumferential length of each of the plurality of closure retainers 234. The retainer motion blocker 260 also has a radial thickness that is about equal to a radial thickness of each of the plurality of closure retainers 234. In some embodiments, the retainer motion blocker 260 may be the same as one or all of the closure retainers 234. In yet another embodiment, the retainer motion blocker 260 may be omitted.

Each of the closure retainers 234 and the retainer motion blocker 260 is partially spaced apart from the side wall 230 of vial 212 such that a hollow space 254 is formed between an outer surface 256 of each closure retainer 234 and side wall 230. Providing the hollow space 254 between each closure retainer 234 and the side wall 230 reduces the amount material needed to form vial 212 thereby decreasing the cost of vial 212 and package 210. Each closure retainer 234 may include a support rib 258 that extends outward from the side wall toward the outer surface of a corresponding closure retainer through the hollow space 254.

Locking tab 228 is configured to move independently of movable release element 220 about first horizontal pivot axis 228H1 when closure 214 is attached to vial 212, as shown in FIG. 20. Locking tab 228 is also configured to move with movable release element 220 and relative to annular sidewall 230 about second horizontal pivot axis 228H2 to allow removal of closure 214 from vial 212 as suggested in FIG. 34.

Locking tab 228 is configured to engage one of closure anchors 222 included in closure 214 to block removal of closure 214 from vial 212 until a downwardly directed push force is applied to movable release element 220. Rotation of closure 214 in a clockwise closure-installation direction causes one of the closure anchors 222 to engage locking tab 228 to cause locking tab 228 to deflect and move about horizontal pivot axis 228H1 in downward direction 235. Downward movement of locking tab 228 by the closure anchor 222 about horizontal pivot axis 228H1 does not cause movement of movable release element 220 relative to annular sidewall 238. Application of a downward push force to movable release element 220 by a consumer causes locking tab 228 to move or pivot below closure anchors 222 about second horizontal pivot axis 228H2 to allow for removal of closure 214 from vial 212.

Locking tab 228 includes a sloped upper surface 270 and a rotation-blocking surface 272. Sloped upper surface 270 is configured to be engaged by one of the closure anchors 222 of closure 214 during rotation of closure 214 in a clockwise closure-installation direction 37 on vial 212 to cause locking tab 228 to pivot downwardly in direction 235 about horizontal pivot axis 228H1 to allow the closure anchor 222 to move past locking tab 228 during installation of closure 214 onto vial 212.

Figure 23:
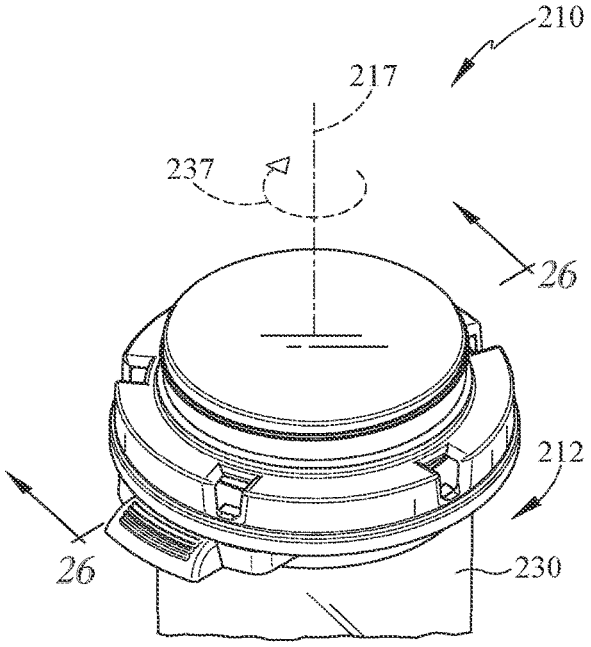
FIG. 23 is a partial perspective view of the package with the closure lowered onto the vial with each of the closure anchors positioned between two adjacent closure retainers and a phantom arrow suggesting that the closure can be rotated in the clockwise direction to lock the closure on the vial.
Figure 24:
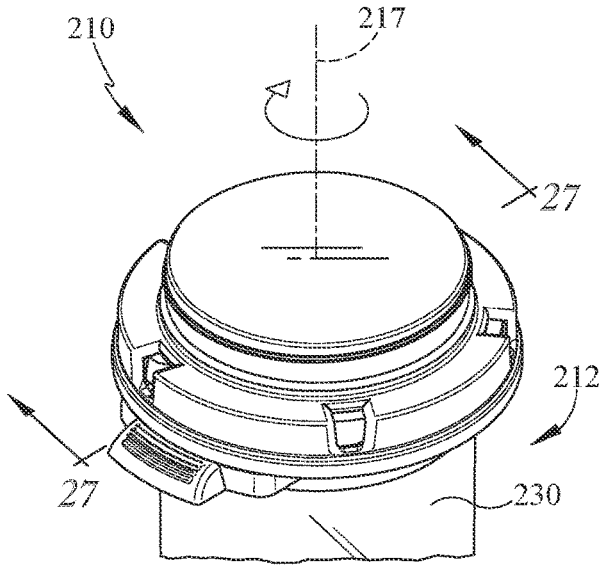
FIG. 24 is a partial perspective view of the closure in a fully-installed position on the vial where each of the closure anchors is positioned directly beneath a corresponding one of the plurality of closure retainers and one of closure anchors is blocked from rotating in the counterclockwise direction by the locking tab.
Figure 27:
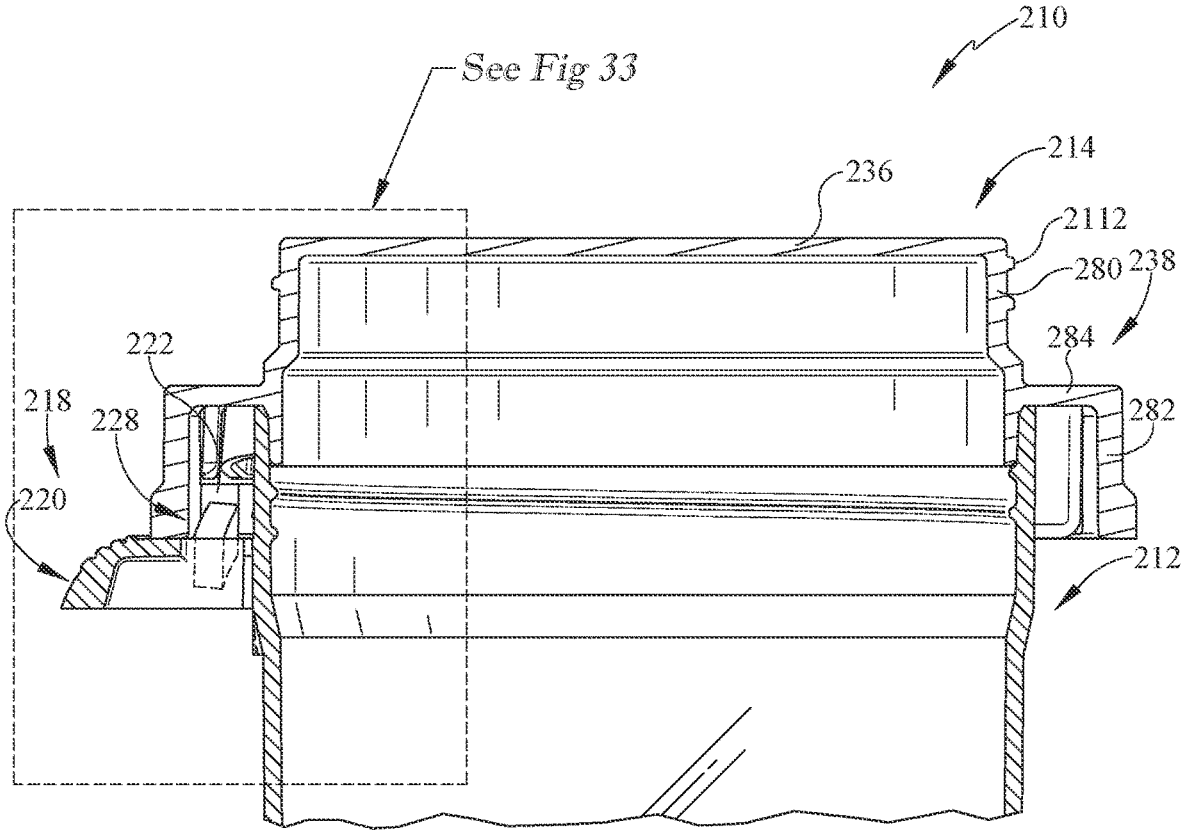
FIG. 27 is a sectional view of the package taken along line 27-27 in FIG. 24 showing the closure in the fully-installed position on the vial.
Figure 28:
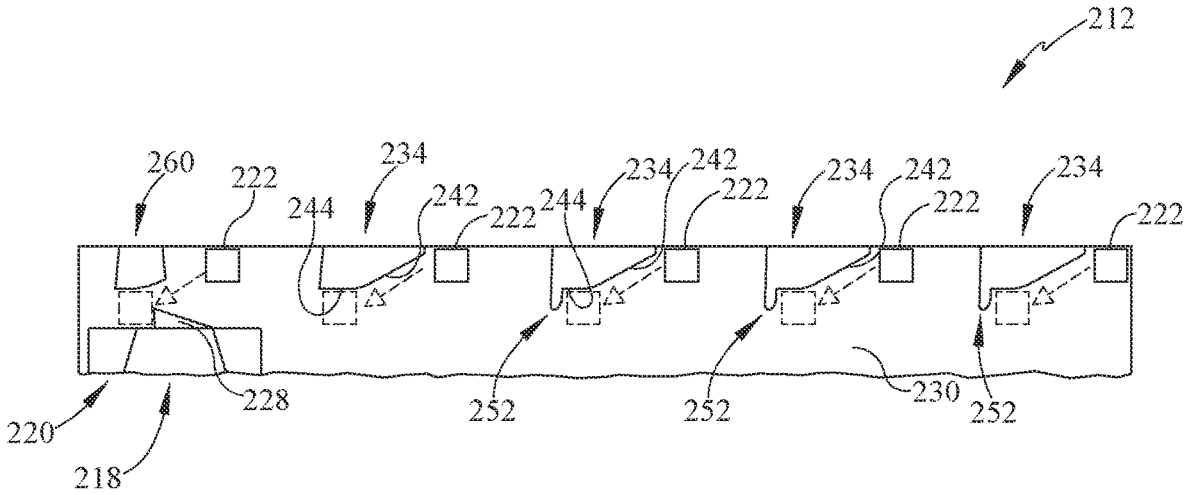
FIG. 28 is a diagrammatic view of an upper end of the vial unrolled to show each of the closure retainers and each of the closure anchors, in dashed lines, moving from an uninstalled position, in which each of the closure anchors is offset circumferentially and from each of the plurality of closure retainers, and the fully-installed position in which each of the plurality of closure anchors lies beneath a corresponding one of the plurality of closure retainers and one of the closure anchors engages a circumferential, rotation-blocking surface of the locking tab.
Figure 29:
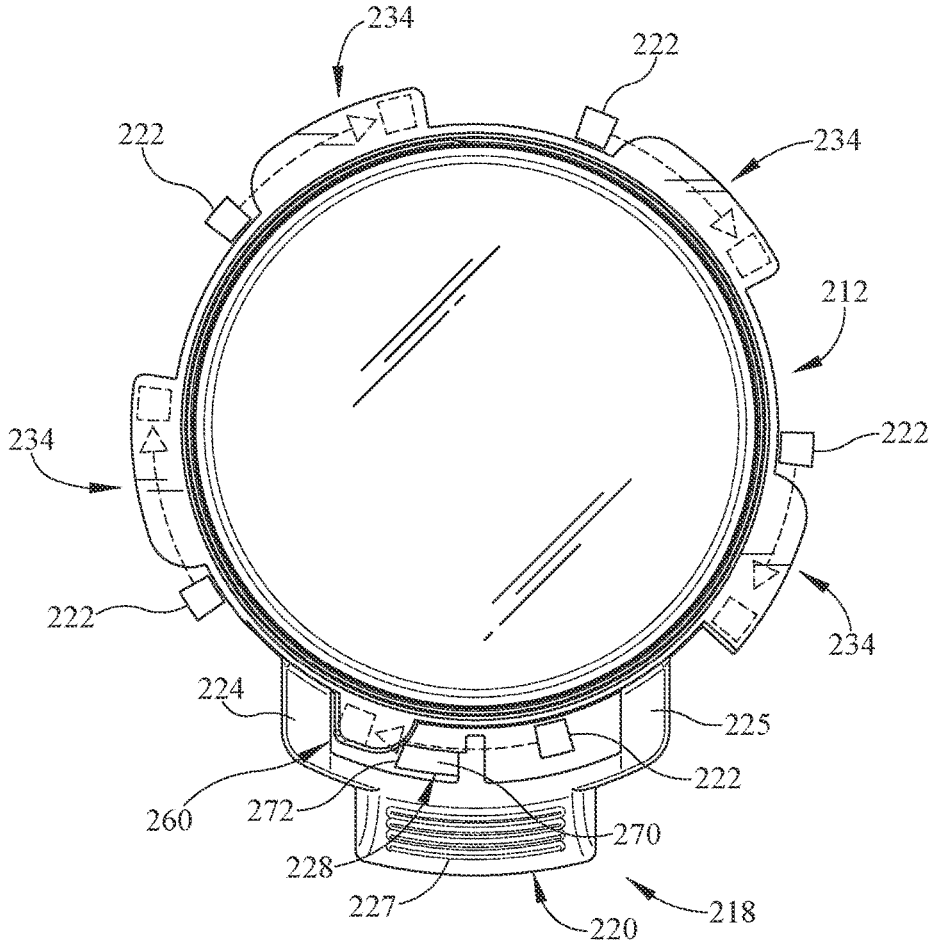
FIG. 29 is a top plan view of the vial showing each of the plurality of closure anchors, in dashed lines, moving from the uninstalled position to the fully-installed position.

During installation of closure 214 in clockwise closure-installation direction 37 onto vial 212 closure anchor 222 moves toward sloped upper surface 270 of locking tab 228. Continued rotation of closure 214 in clockwise closure-installation direction 237 causes closure anchor 222 to engage sloped upper surface 270 of locking tab 228 and move locking tab 228 about horizontal pivot axis 228H1 in downward direction 235, as shown in FIGS. 23 and 27. Continued rotation of closure 214 causes closure anchor 222 to move past locking tab 228, resulting in locking tab 228 snapping back to its original position owing, in part, to elasticity of locking tab 228. With locking tab 228 in its original position, the pathway for closure anchor 222 is blocked and closure 214 cannot be removed from vial 212.

Figure 25:
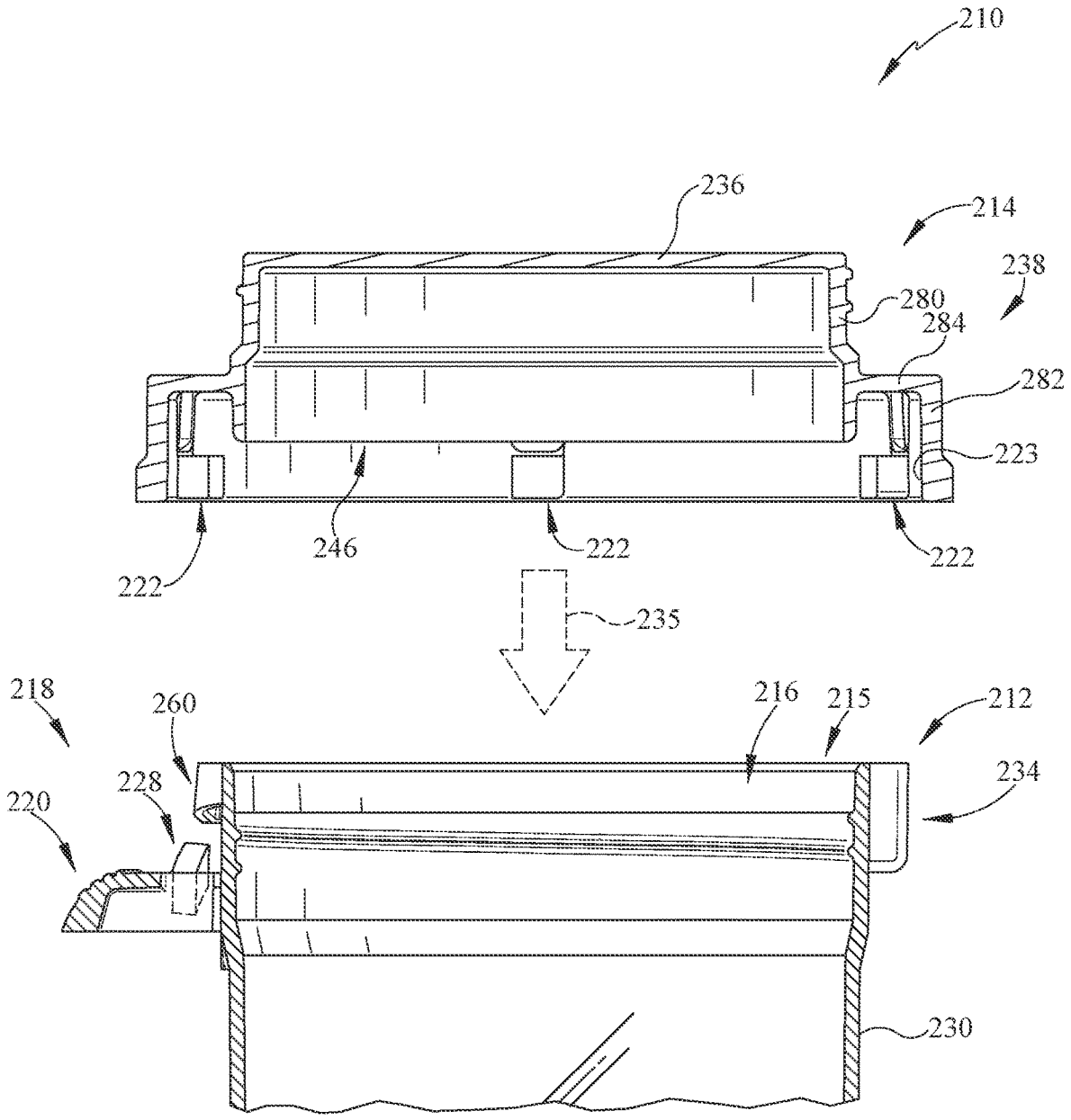
FIG. 25 is a sectional view of the package taken along line 25-25 in FIG. 22.

Side wall 238 of closure 214 includes an upper side wall 280, a lower side wall 282, and a skirt 284 that interconnects the upper side wall 280 and the lower side wall 282 as shown in FIG. 25. The external threads 2112 of closure 214 are coupled to an outer surface of upper side wall 280. Each of the closure anchors 222 are coupled to an inside surface of lower side wall 282. Annular plug seal 246 extends downwardly from skirt 284 and is spaced radially inward from the lower side wall 282. The lower side wall 282 is formed to include a plurality of openings 286 that pass through the lower side wall 282 and are aligned circumferentially with each closure anchor. Closure 214 may be formed during a thermoforming process which uses the material removed from the portions of lower side wall 282 that define each opening 286 to form each closure anchor 222.

Figure 36:
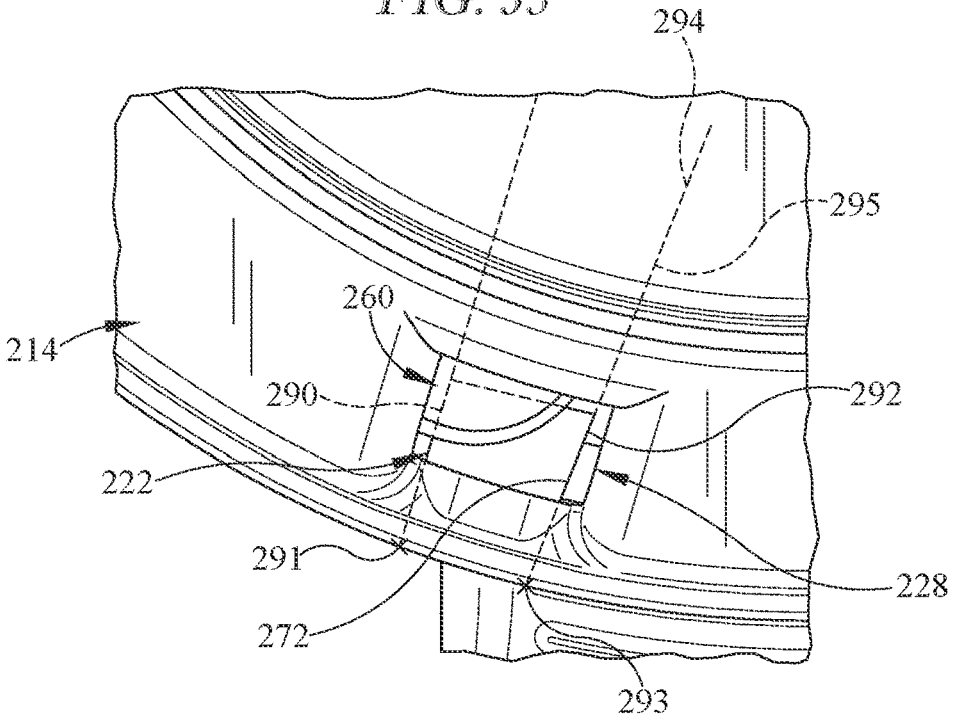
FIG. 36 is a top plan view of a portion of the package from FIG. 35 showing that each closure anchor includes a first circumferential surface that extends along a first plane and a second circumferential surface that extends along a second plane angled toward the counterclockwise direction and configured to cooperate with the circumferential, rotation, blocking surface of the locking tab to urge the closure anchor radially inwardly toward the annular side wall of the vial if the closure is rotated in the counterclockwise direction without disengaging the locking tab from the closure anchor so that the closure anchor is retained beneath an anchor-motion blocker to block unintentional removal of the closure from the vial.

Each closure anchor 222 is formed generally in the shape of a cube as shown in FIGS. 20 and 36, although other suitable shapes or structures may also be used in other embodiments. Each closure anchor 222 is shaped to cooperate with the locking tab 228 to avoid unintentional unlocking of closure 214. Each closure anchor 222 includes a clockwise or first circumferential side 290 and a counterclockwise or second circumferential side 292. The first circumferential side 290 is arranged to lie at a right angle relative to a point of tangency 291 on side wall 238 radially outward from the first circumferential side 290 of the respective closure anchor 222. The second circumferential side 292 is arranged to lie an acute angle relative to a point of tangency 293 on side wall 238 radially outward from the second circumferential side 292 of the respective closure anchor 222. In this way, the second circumferential side 292 is arranged to extend along a plane 294 in the counterclockwise direction.

Rotation-blocking surface 272 of locking tab 228 is similarly arranged to extend along a plane 295 that is generally parallel with plane 294 when second circumferential side 292 directly contacts rotation-blocking surface 272. Rotation of closure 214 in the counterclockwise direction without moving the locking tab 228 out of the path of closure anchor 222 will cause the closure anchor to deflect radially inwardly toward side wall 230 of vial 212. The closure anchor 222 is retained beneath the retainer motion blocker 260 due to the deflection of the closure anchor 222 by the rotation-blocking surface 272.

The illustrated and described arrangement of vial 212 with closure retainers 234 may minimize complexity in tooling when manufacturing package 210 and/or vial 212. Closure retainers 234 provide a downward sealing force when a clockwise rotation is applied to the closure 214. However, closure retainers 234 may be simpler to mold than threads which extend annularly around a vial. A tool and/or mold to manufacture a vial having threads may require several actions, movements, or splits within the mold to manufacture the vial. For example, such a tool may employ a rotating action or an additional split. This can complicate the tool and can increase the cost of manufacture. The vial 212 of the present disclosure may be formed by a two-piece cavity and core tool and/or mold for manufacture. This may minimize complication of the tool and may reduce manufacturing costs while providing a vial 212 with closure retainers 234 to retain closure 214 on vial 212.

Figure 37:
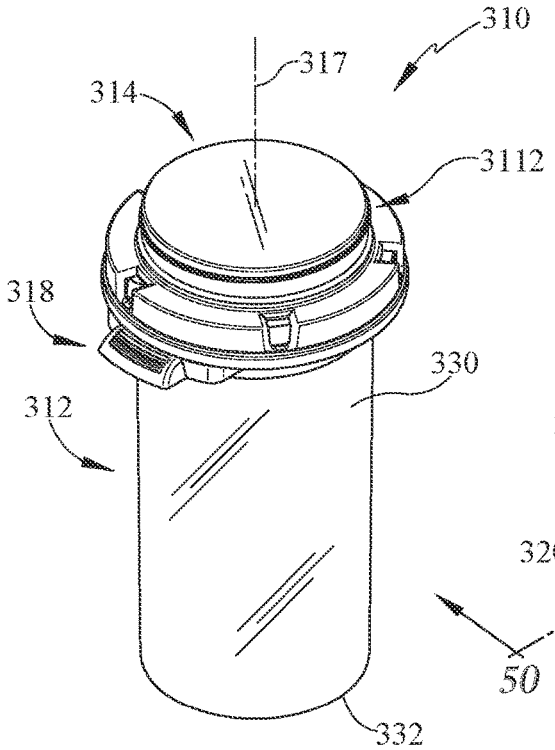
FIG. 37 is a perspective view of a child-resistant package in accordance with a third embodiment of the present disclosure showing a vial, a closure mounted on the vial to cover a mouth opening into an interior region formed in the vial, and a closure-release control mechanism having a movable release element that is coupled to the vial and configured to disengage a locking tab coupled to the vial from a closure anchor included in the closure to permit the release of the closure from the vial.
Figure 38:
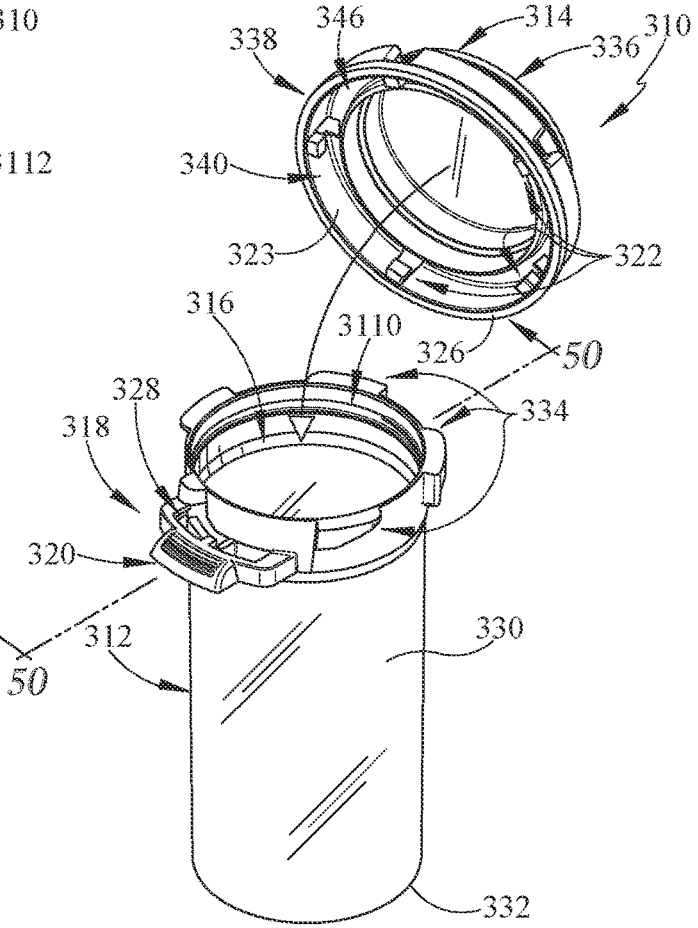
FIG. 38 is an exploded assembly view of the child-resistant package of FIG. 37, showing the closure separated from the vial to reveal a plurality of closure anchors coupled to a perimeter edge of a rim of the closure and showing the movable release element coupled to an annular flange of the vial and an inclined locking tab included in the closure-release control mechanism and configured to engage one of the plurality of closure retainers in the closure as suggested in FIGS. 42, 46, and 51 to block selectively removal of the closure from the vial until a downward directed push force is applied to the movable release element to disengage the locking tab from the closure anchor as shown in FIG. 52.

A child-resistant package 310 in accordance with a third embodiment of the present disclosure includes a vial 312, or container, and a closure 314 mounted on vial 312 to cover a mouth 315 opening into a product-storage chamber 316 formed in vial 312, as shown in the illustrative embodiment of FIGS. 37 and 38. Vial 312 is adapted to accept closure 314 to seal in the contents of vial 312. Product-storage chamber 316 is adapted to contain product, such as medication, and is sealed when closure 314 is coupled to vial 312. Child-resistant package 310 also includes a closure-release control mechanism 318 configured to control release of closure 314 from vial 312.

Vial 312 includes an annular sidewall 330, a floor 332 coupled to a lower end of side wall 330, and a plurality of closure retainers 334 coupled to an outer surface of an upper end of the side wall 330 as shown in FIG. 38. Side wall 330 extends vertically along an axis 317 of child-resistant package 310. Side wall 330 and floor 332 cooperate to define product-storage chamber 316 of vial 312. The plurality of closure retainers 334 extend outwardly away from axis 317 and are configured to cooperate with closure 314 to retain closure 314 on vial 312 in a full-installed position as shown in FIG. 37. Closure 314 is arranged to be coupled to vial 312 after rotation of closure 314 about axis of rotation 317, as shown, for example, in FIG. 37. Vial 312 does not include external threads and uses only the plurality of closure retainers 334 to mount closure 314 on vial 312 when the package 310 is being used in a child-resistant mode.

Closure 314 includes a round top wall 336 and an annular sidewall 338 that depends downwardly from top wall 336. Top wall 336 and side wall 338 form an interior region 340 of closure 314. Closure 314 does not include threads on side wall 338 within interior region 340 of closure 314, and, instead, further includes a plurality of closure anchors 322 that are coupled to an inside surface 323 of sidewall 338 in interior region 340. The plurality of closure anchors 322 are configured to engage the plurality of closure retainers 334 so that closure 314 is retained to vial 312 after rotation of closure 314 about axis of rotation 317, as shown, for example, in FIG. 37.

Figure 52:
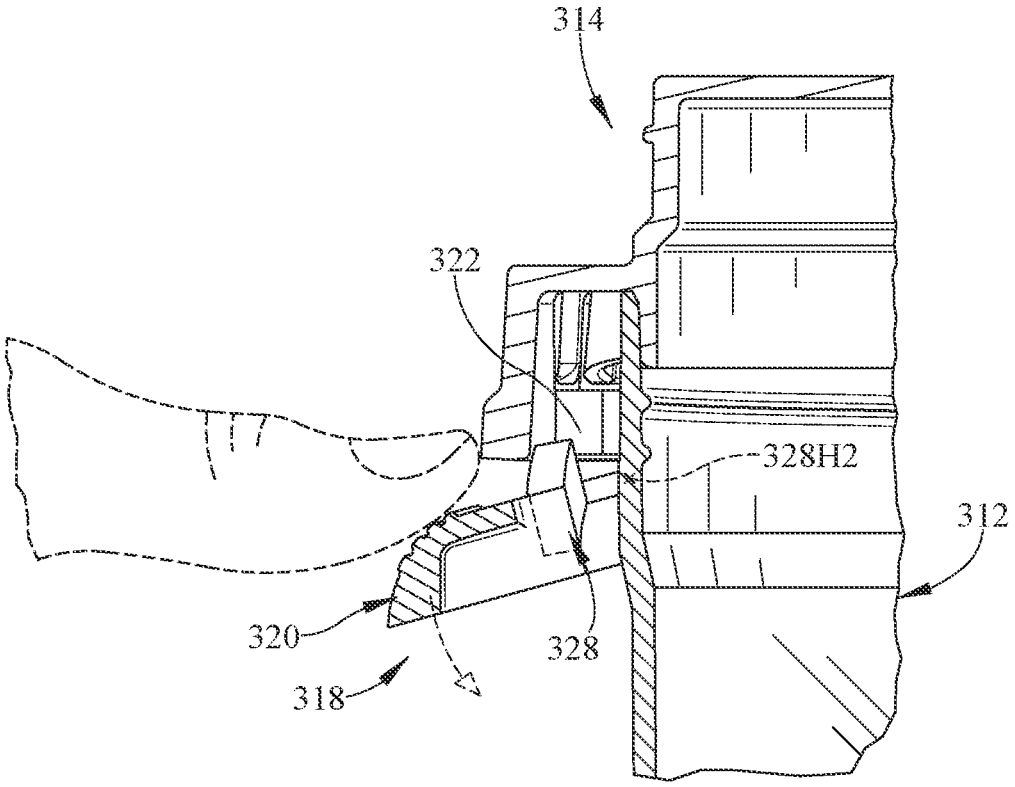
FIG. 52 is a cross-section of the portion of the package shown in FIG. 51 showing the thumb of the user pushing the closure release element downwardly to disengage the locking tab from the closure anchor so that the closure can be rotated in the counterclockwise direction to remove the closure from the vial for access to contents within the vial.
Figure 53:
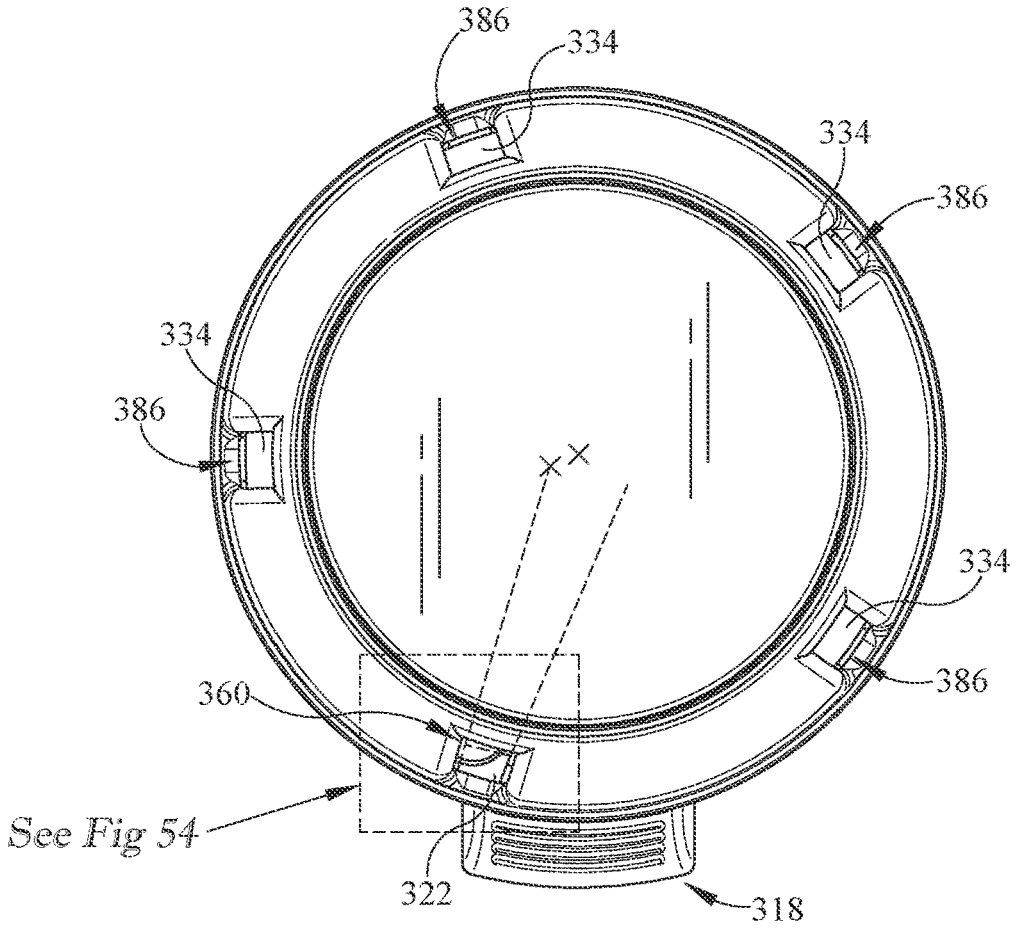
FIG. 53 is a top plan view of the package with the closure in the fully-installed position on the vial.

Closure-release control mechanism 318 comprises a movable release element 320 coupled to vial 312 and a locking tab 328 mounted on vial 312 for two-axis pivotable movement about a first horizontal pivot axis 328H1 during installation of closure 314 on vial 312 and about a second horizontal pivot axis 328H2 during removal of closure 314 from vial 312. Closure-release control mechanism 318 further comprises a plurality of radially inwardly extending closure anchors 322 coupled to a rim 326 of closure 314, as shown in FIG. 38. Removal of closure 314 from vial 312 is blocked when locking tab 328 included in closure-release control mechanism 318 and coupled to movable release element 320 is positioned to lie in the pathway of one of the plurality of closure anchors 322. When a consumer pushes movable release element 320 to flex downwardly as shown in FIG. 52, locking tab 328 moves out of the pathway of the one of the plurality of closure anchors 322 on closure 314 to permit counterclockwise rotation and removal of closure 314 from vial 312, as suggested in FIG. 52. Vial 312 also includes internal threads 3110 that correspond to external threads 3112 on an exterior surface of side wall 338 opposite interior region 340 of closure 314 to allow closure 314 to be coupled to vial 312 in a non-child resistant mode. To change closure 314 to the non-child resistant mode, closure 314 is removed from vial 312, inverted, and top wall 336 of closure 314 is inserted through open mouth 315 and coupled to vial 312 via threads 3110, 3112. When closure 314 is in the non-child resistant mode, closure-release control mechanism 318 does not work to block removal of closure 314 from vial 312.

Figure 39:
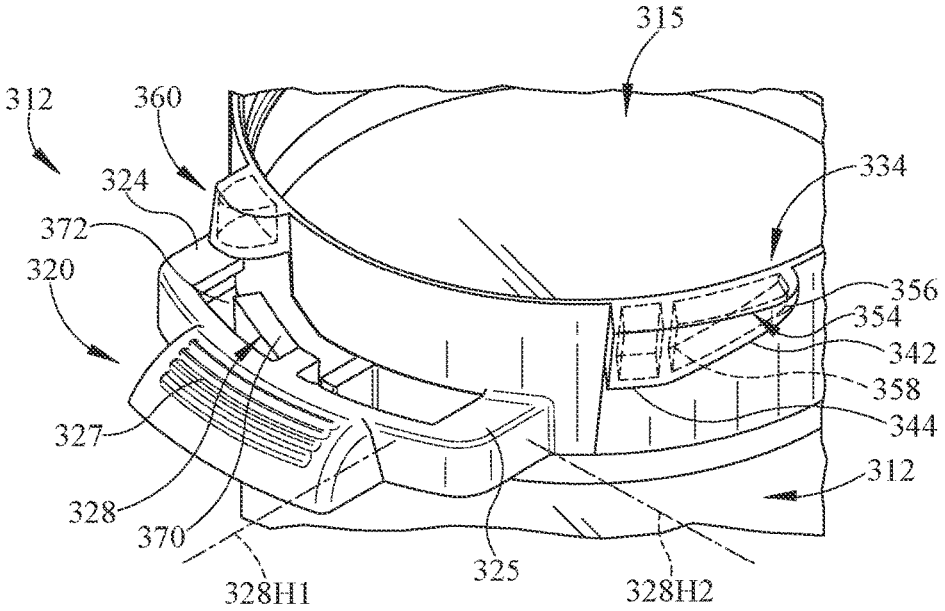
FIG. 39 is an enlarged perspective view of a portion of the vial of FIG. 38 showing the inclined locking tab positioned to lie between the movable release element and an annular sidewall included in the vial and showing that the vial includes a plurality of closure retainers coupled to the annular sidewall and adapted to engage a respective one of the plurality of closure anchors upon rotation of the closure in a clockwise direction relative to the vial until one of the closure anchors engages a circumferential surface of the inclined locking tab to block the closure from rotating in a counterclockwise direction until the downward push force is applied on the movable release element.
Figure 40:
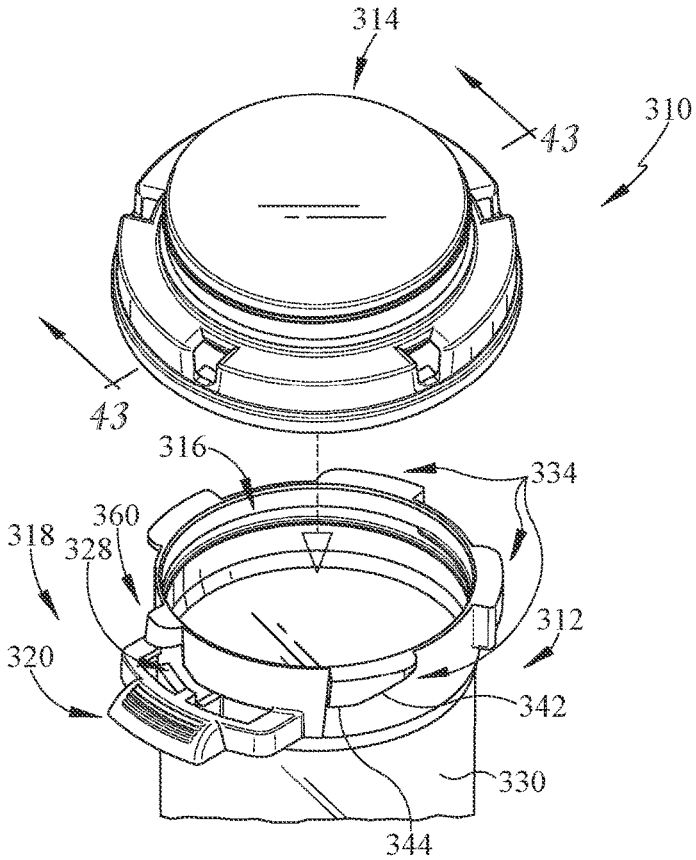
FIG. 40 is a partial perspective and exploded view of the package from FIG. 37 showing the closure removed from the vial and a downward arrow suggesting that, in order to close and lock the closure on the vial, the closure is lowered onto the vial with each of the closure anchors positioned between two adjacent closure retainers.

Movable release element 320 includes a pair of support arms 324, 325 and an actuator pad 327 as shown in FIG. 39. The pair of support arms 324, 325 extend radially outward from side wall 330 of vial 312 and are spaced apart from one another circumferentially about axis 317. Actuator pad 327 extends between and interconnects the pair of support arms 324, 325. Locking tab 328 is coupled to actuator pad 327, but may be coupled to one of the support arms 324, 325 in other embodiments. An operator may use the actuator pad 327 to deform the pair of support arms 324, 325 and pivot the locking tab 328 downwardly with the actuator pad 327 about second horizontal axis 328H2 out of the path of the plurality of closure anchors 322 so that closure 314 can be removed from vial 312. Actuator pad 327 further includes a plurality of ribs 321 as shown in FIGS. 48-50 to provide a gripping surface for the operator's thumb.

Figure 48:
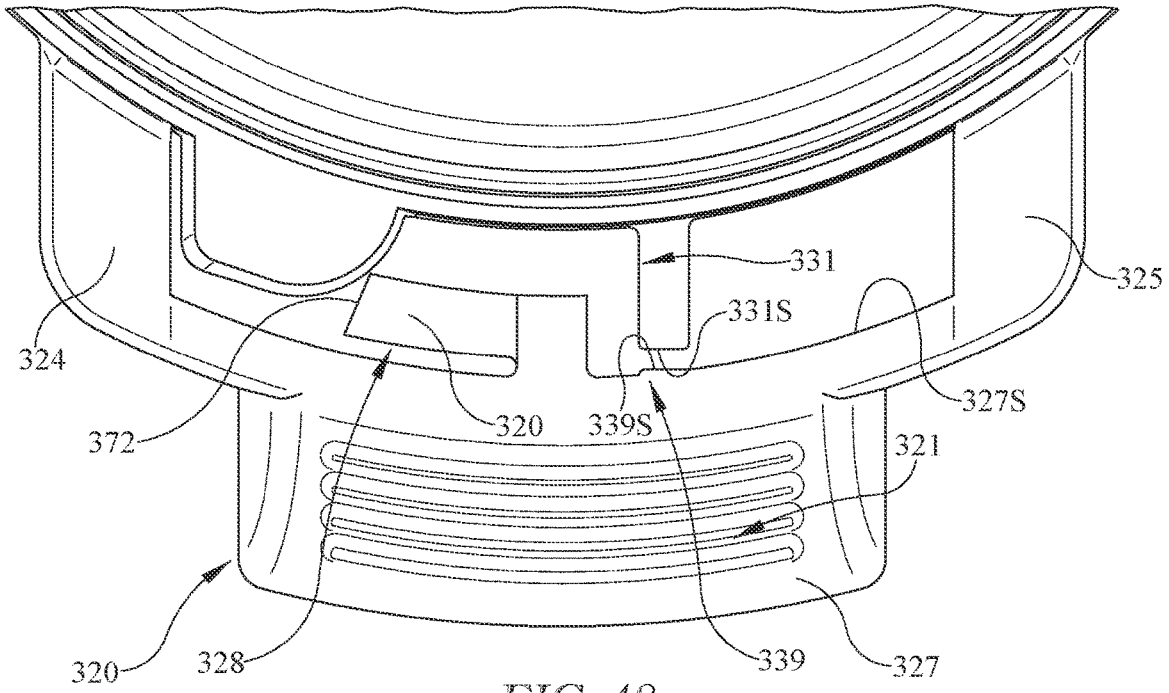
FIG. 48 is a top plan view of the closure-release control mechanism shown in FIG. 37 showing that closure-release control mechanism includes a travel limiter coupled to the annular side wall of the vial and adapted to engage a companion travel-limiter wall coupled to the movable release element.
Figure 49:
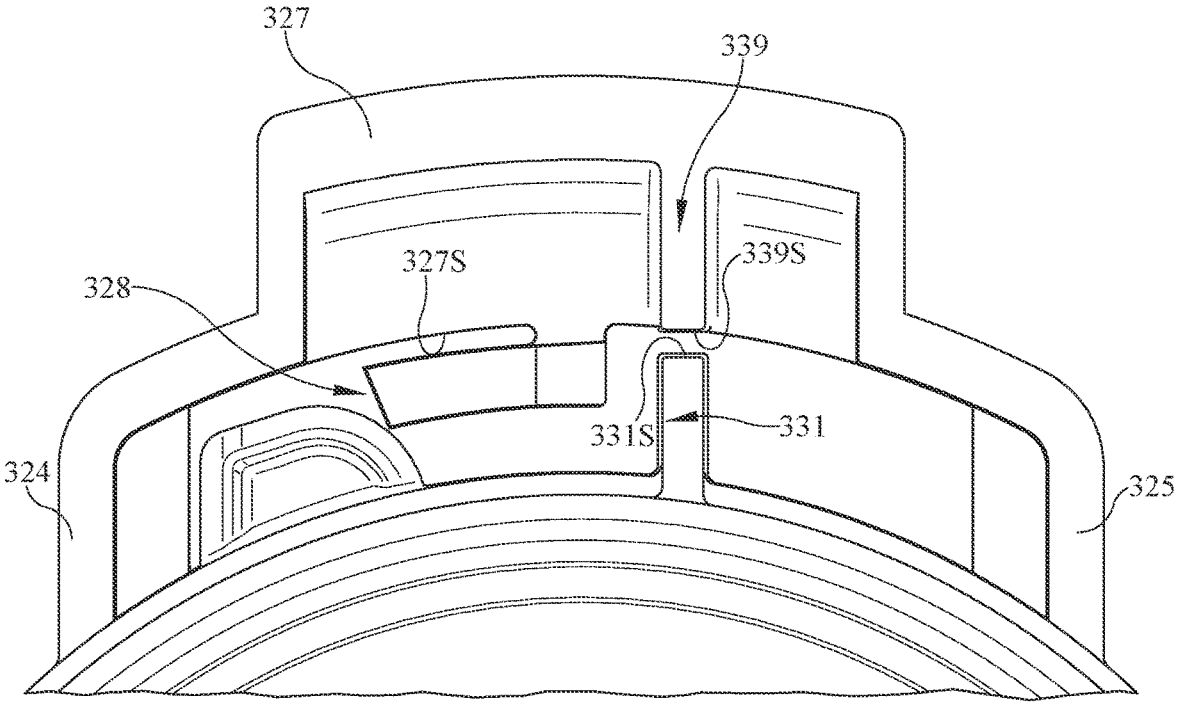
FIG. 49 is a bottom plan view of the closure-release control mechanism shown in FIG. 48.
Figure 50:
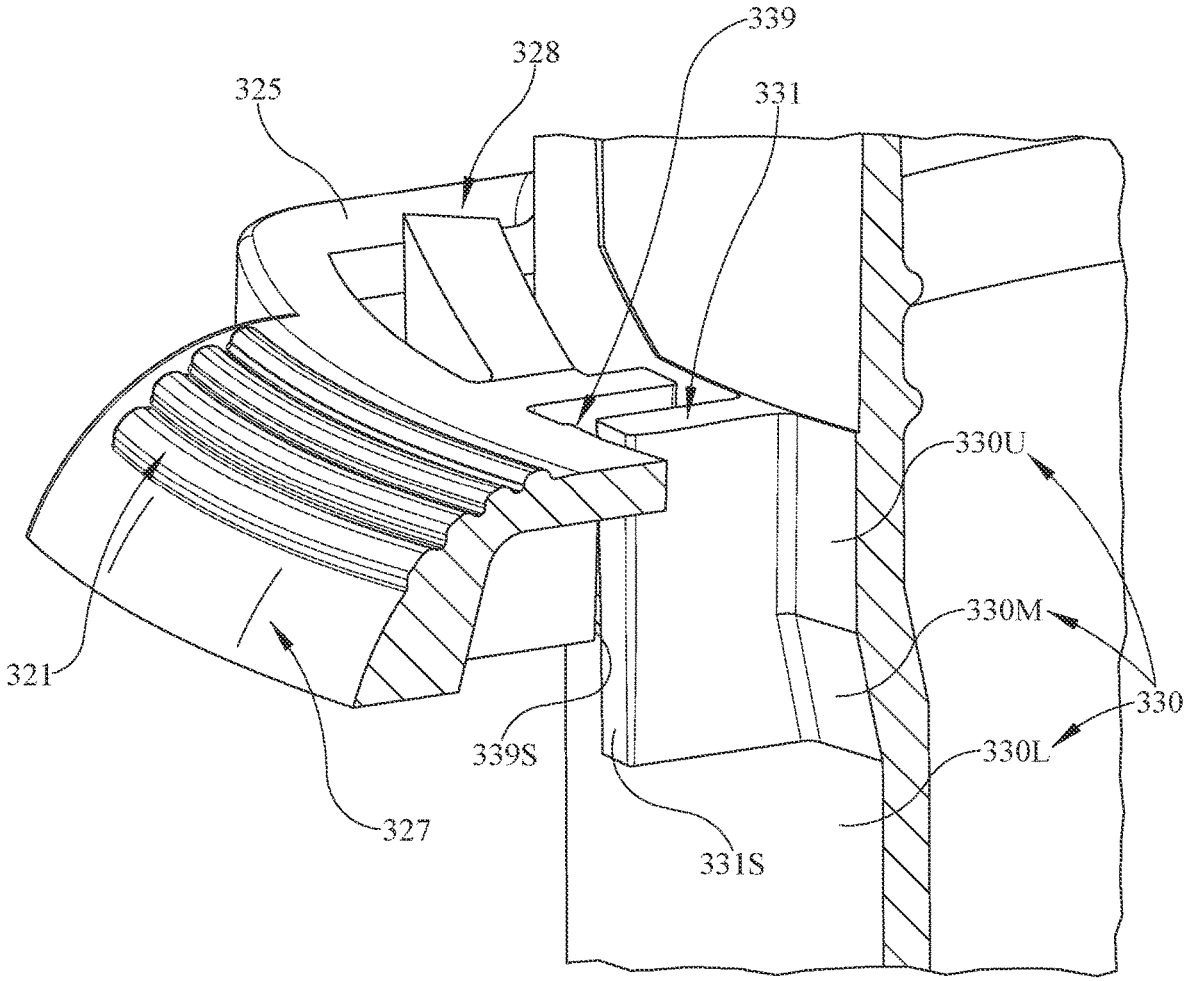
FIG. 50 is a sectional view of the closure-release control mechanism taken along line 50-50 shown in FIG. 38.
Figure 51:
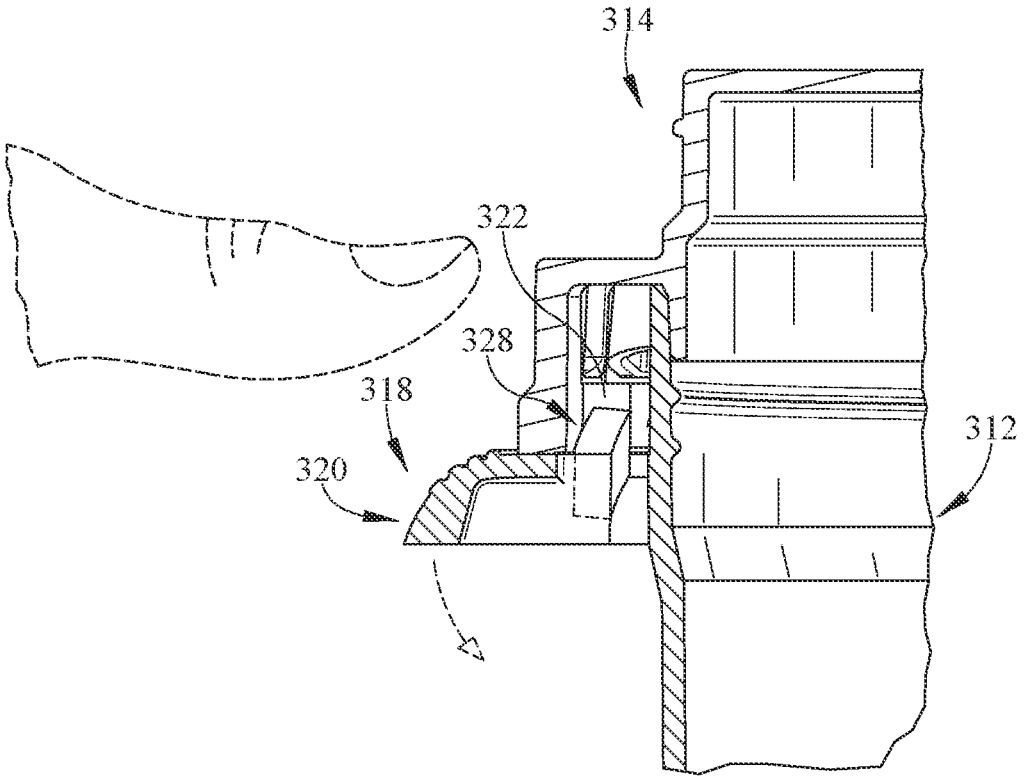
FIG. 51 is a cross-section of a portion of the package from FIG. 45 showing the closure in the fully-installed position and a thumb of a user being lowered toward the closure release element.

Closure-release control mechanism 318 further includes a travel limiter 331 and a companion travel-limiter wall 339 as shown in FIGS. 48 and 49. In the illustrative embodiment shown in FIG. 48, the travel limiter 331 is coupled to and extends radially outward from annular side wall 330 of vial 312 relative to axis 317. Travel limiter 331 is integrally coupled to annular side wall 330.

Companion travel-limiter wall 339 is coupled to and extends radially inward from a radially inward surface 327S of actuator pad 327. Companion travel-limiter wall 339 includes a contacting surface 339S. Alternatively, the contacting surface 339S of companion travel-limiter wall 339 may be a surface of the actuator pad 327. Contacting surface 339S is parallel to a contacting surface 331S of travel limiter 331 when the movable release element 320 is not deformed. The radial length of travel limiter 331 and companion travel-limiter wall 339 each may be any radial length between actuator pad 327 and annular side wall 330.

When an operator pushes movable release element 320 to flex downwardly, contacting surface 339S of companion travel-limiter wall 339 may engage contacting surface 331S of travel limiter 331. The engagement of the contacting surfaces 331S and 339S stops the locking tab 328 and the actuator pad 327 from further pivoting about second horizontal axis 328H2. The travel limiter 331 and companion travel-limiter wall 339 cooperate to reduce wear on movable release element 320 and block breakage or permanent deformation of the pair of support arms 324, 325.

In the illustrative embodiment shown in FIGS. 48 and 49, companion travel-limiter wall 339 is coupled to actuator pad 327 and positioned circumferentially between locking tab 328 and support arm 325. Travel limiter 331 is circumferentially aligned with companion travel-limiter wall 339 relative to axis 317. In other embodiments, companion travel-limiter wall 339 and/or contacting surface 339S may be positioned at any point along the radially inward surface 327S so long as it is circumferentially aligned with travel limiter 331.

Each of the plurality of closure retainers 334 includes a closure-displacement ramp 342 and a closure-retainer surface 344 as shown in FIG. 39. Each closure-displacement ramp 342 is configured to engage one of the plurality of closure anchors as closure 314 is rotated in a closure-instillation direction toward the fully-installed position. Each closure-retainer surface 344 is configured to engage one of the plurality of closure anchors 322 in the installed position to block removal of closure 314 from vial 312 along axis of rotation 317.

Each of the plurality of closure retainers 334 is configured to pull closure 314 toward vial 312 as closure 314 is rotated in the closure-installation direction and at least some of the closure anchors 322 ride along a closure-displacement ramp 342 of each closure retainer 334. Closure 314 further includes an annular plug seal 346 and arranged to extend downwardly away from the top wall 336 through mouth 315 of vial 312 and into product-storage chamber 316 in the installed position. Annular plug seal 346 is adapted to engage an inner surface of side wall 330 of vial 312 to provide a liquid-and-air tight seal between closure 314 and vial 312.

Figure 44:
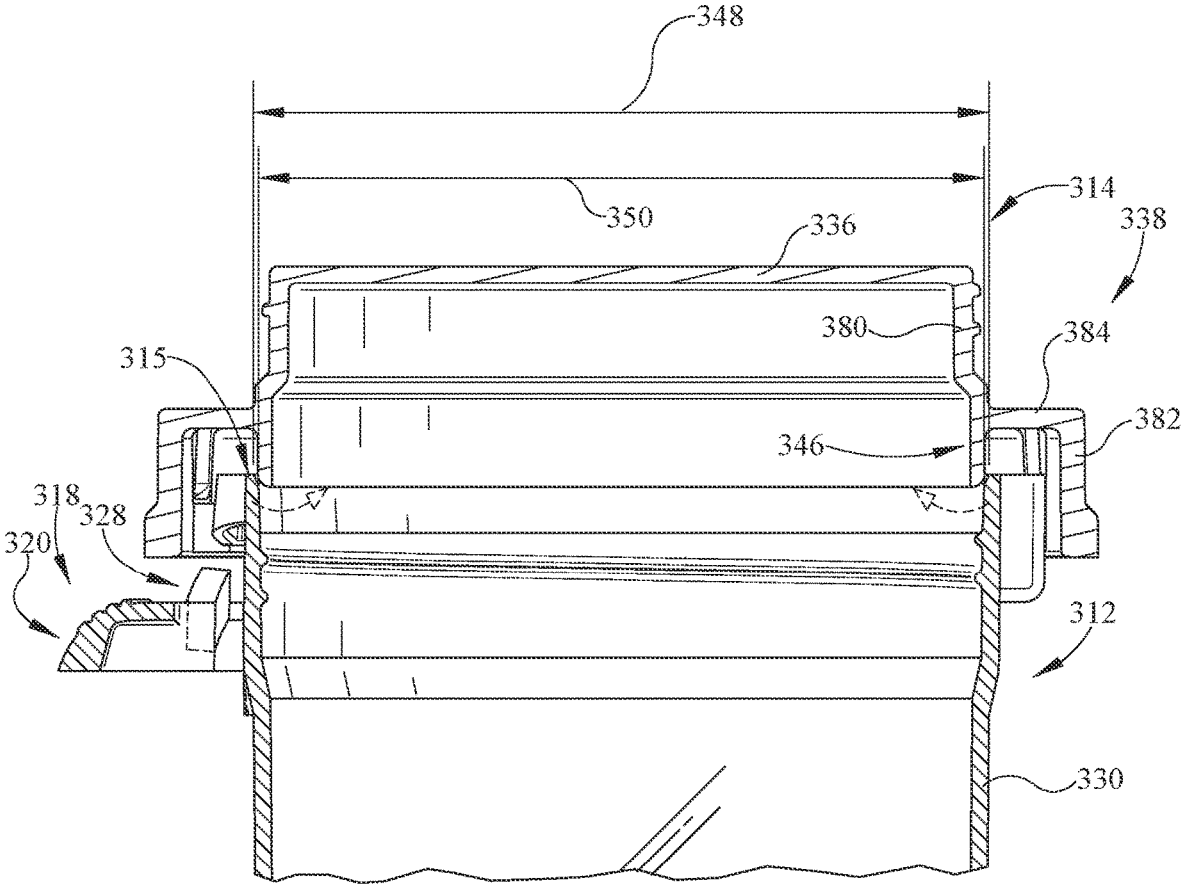
FIG. 44 is a sectional view of the package taken along line 44-44 in FIG. 41 showing that the closure further includes an annular plug that engages a radially inner surface of the vial defining the open mouth and that is configured to flex radially inwardly upon movement of the closure in the clockwise direction toward the fully-installed.

Annular plug seal 346 may bias closure 314 upwardly away from vial 312 as suggested in FIG. 44. A radially outer surface of annular plug seal 346 has a first diameter 348. A radially inner surface of side wall 330 of vial 312 at mouth 315 has a second diameter 350. The second diameter 350 is less than the first diameter 348 such that annular plug seal 346 flexes inwardly toward axis 317 as closure 314 is rotated onto vial 312. Forces provided by annular plug seal 346 on vial 312 may urge closure 314 away from vial 312 to facilitate removal of closure 314 from vial 312. Annular plug seal 346 extends downwardly from skirt 384 and upper side wall 380. Annular plug seal 346 is spaced radially from lower side wall 382 and vial 312 is received between annular plug seal 346 and lower side wall 382 when closure 314 is fully-installed.

Vial 312 does not include exterior threads and closure 314 does not include interior threads for coupling closure 314 to vial 312 in the child resistant mode. Instead, vial 312 includes circumferentially spaced closure retainers 334 and closure 314 includes circumferentially spaced closure anchors 322. The plurality of closure anchors 322 retain the functionality of threads, while also cooperating with closure-release control mechanism 318 to block removal of closure 314 from vial 312 when closure 314 is in the fully-installed position. Thus, threads have been omitted from the interior surface of closure 314 and the exterior surface of vial 312 while the thread function has been retained.

The closure-displacement ramp 342 transitions directly to the closure-retainer surface 344 such that a lower end of the closure-displacement ramp surface 342 and at least a portion of the closure-retainer surface 344 is located at a same height from the mouth 315 of vial 312. In the fully-installed position, an upper surface of the side wall 330 of vial 312 and each of the closure retainers 334 engages the closure 314 to block vertical movement of the closure 314 downwardly toward the vial 312. In this way, an operator need only rotate closure 314 in the counterclockwise direction with the locking tab 328 disengaged from the closure anchors 322 to remove closure 314 from vial 312.

At least one of the plurality of closure retainers 334 further includes a rotation-blocking stop 352 that extends downwardly from the closure-retainer surface 344 at a circumferential end of the closure-retainer surface 344 opposite the closure-displacement ramp 342. The rotation-blocking stop 352 is configured to engage one of the closure anchors 322 in the installed position to block further rotation of closure 314 in the closure-installation direction. In the illustrative embodiment, only three out of the four closure retainers 334 includes a rotation-blocking stop 352, however, any suitable number of rotation-blocking stops 352 may be used.

In illustrative embodiments, vial 312 further includes a retainer motion blocker 360 coupled to sidewall 330 of vial 312. The retainer motion blocker 360 is positioned above the closure-release control mechanism 318. The retainer motion blocker 360 is also aligned circumferentially with one of the closure anchor 322 that is engaged with locking tab 328 when closure 314 is in the fully-installed position. The retainer motion blocker 360 is configured to block vertical movement of the closure anchor 322 relative to the locking tab 328 so as to avoid unintentional removal of closure 314 from vial 312.

The retainer motion blocker 360 is similar to the closure retainers 334. The retainer motion blocker 360 has a circumferential length that is less than a circumferential length of each of the plurality of closure retainers 334. The retainer motion blocker 360 also has a radial thickness that is about equal to a radial thickness of each of the plurality of closure retainers 334. In some embodiments, the retainer motion blocker 360 may be the same as one or all of the closure retainers 334. In yet another embodiment, the retainer motion blocker 360 may be omitted.

Each of the closure retainers 334 and the retainer motion blocker 360 is partially spaced apart from the sidewall 330 of vial 312 such that a hollow space 354 is formed between an outer surface 356 of each closure retainer 334 and sidewall 330. Providing the hollow space 54 between each closure retainer 34 and the sidewall 330 reduces the amount material needed to form vial 312 thereby decreasing the cost of vial 312 and package 310. Each closure retainer 334 may include a support rib 358 that extends outward from the sidewall toward the outer surface of a corresponding closure retainer through the hollow space 354.

Locking tab 328 is configured to move independently of movable release element 320 about first horizontal pivot axis 328H1 when closure 314 is attached to vial 312, as shown in FIG. 38. Locking tab 328 is also configured to move with movable release element 320 and relative to annular sidewall 330 about second horizontal pivot axis 328H2 to allow removal of closure 314 from vial 312 as suggested in FIG. 52.

Locking tab 328 is configured to engage one of closure anchors 322 included in closure 314 to block removal of closure 314 from vial 312 until a downwardly directed push force is applied to movable release element 320. Rotation of closure 314 in a clockwise closure-installation direction causes one of the closure anchors 322 to engage locking tab 328 to cause locking tab 328 to deflect and move about horizontal pivot axis 328H1 in downward direction 335. Downward movement of locking tab 328 by the closure anchor 322 about horizontal pivot axis 328H1 does not cause movement of movable release element 320 relative to annular sidewall 338. Application of a downward push force to movable release element 320 by a consumer causes locking tab 328 to move or pivot below closure anchors 322 about second horizontal pivot axis 328H2 to allow for removal of closure 314 from vial 312.

Locking tab 328 includes a sloped upper surface 370 and a rotation-blocking surface 372. Sloped upper surface 370 is configured to be engaged by one of the closure anchors 322 of closure 314 during rotation of closure 314 in a clockwise closure-installation direction 337 on vial 312 to cause locking tab 328 to pivot downwardly in direction 335 about horizontal pivot axis 328H1 to allow the closure anchor 322 to move past locking tab 328 during installation of closure 314 onto vial 312.

Figure 41:
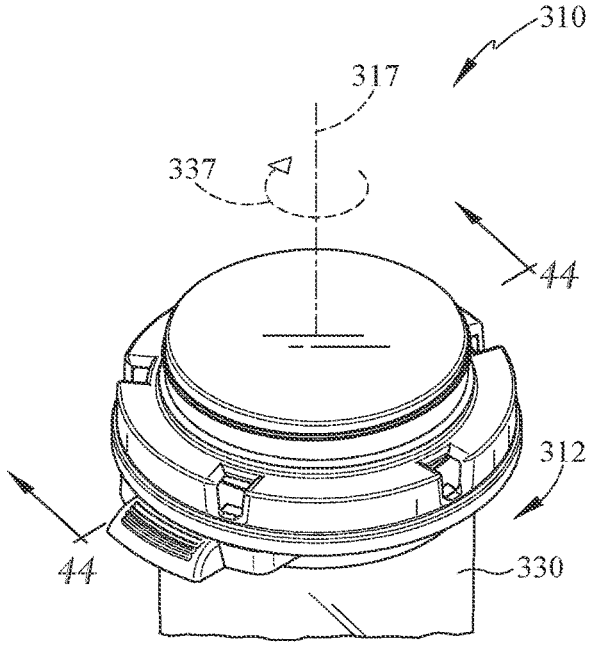
FIG. 41 is a partial perspective view of the package with the closure lowered onto the vial with each of the closure anchors positioned between two adjacent closure retainers and a phantom arrow suggesting that the closure can be rotated in the clockwise direction to lock the closure on the vial.
Figure 42:
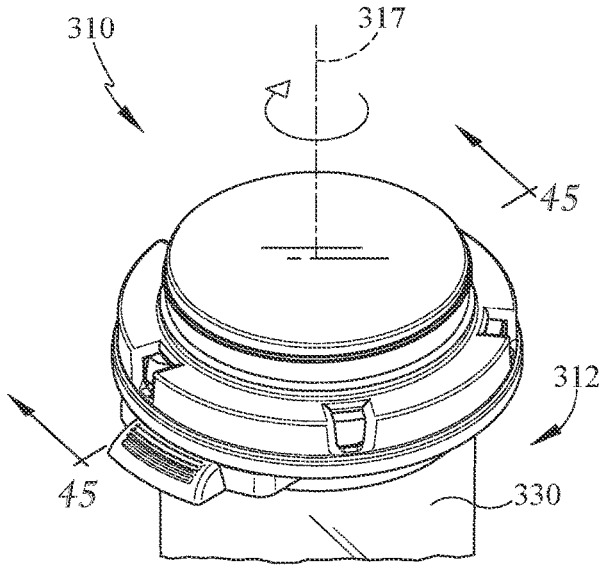
FIG. 42 is a partial perspective view of the closure in a fully-installed position on the vial where each of the closure anchors is positioned directly beneath a corresponding one of the plurality of closure retainers and one of closure anchors is blocked from rotating in the counterclockwise direction by the locking tab.
Figure 45:
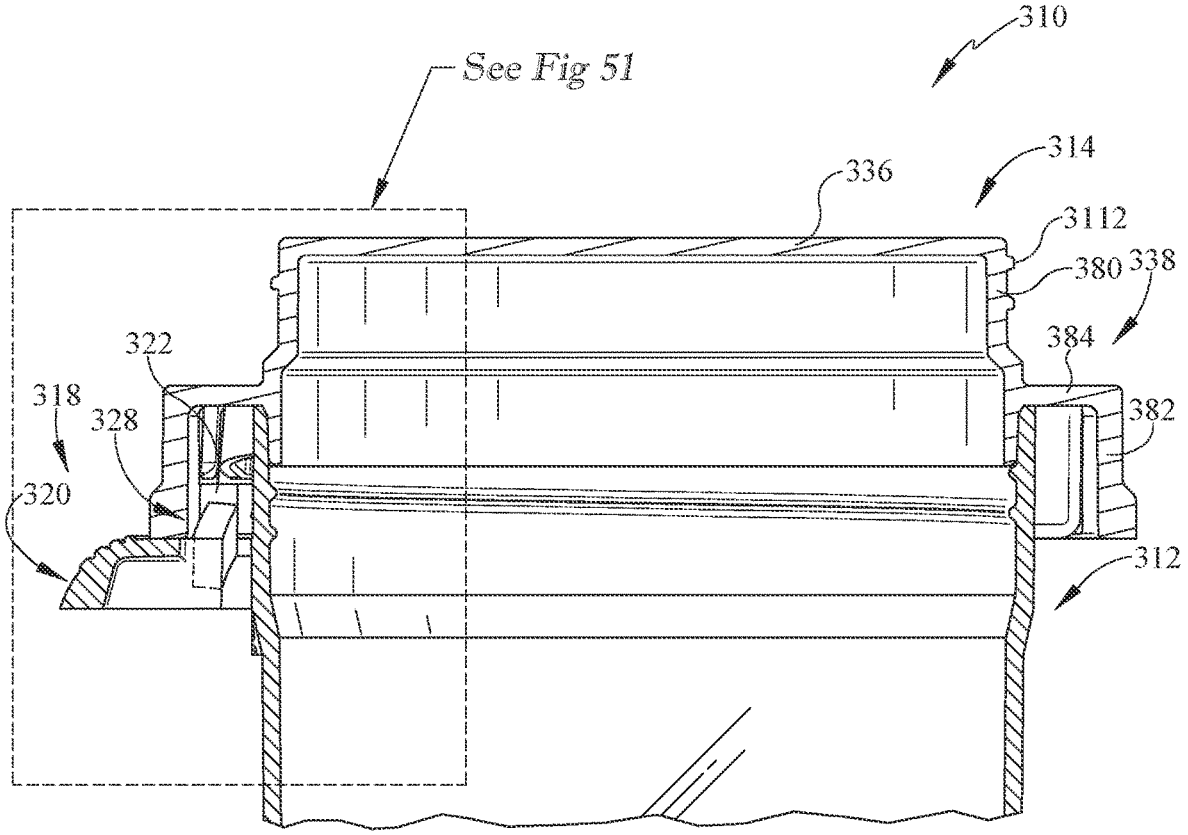
FIG. 45 is a sectional view of the package taken along line 45-45 in FIG. 42 showing the closure in the fully-installed position on the vial.
Figure 46:
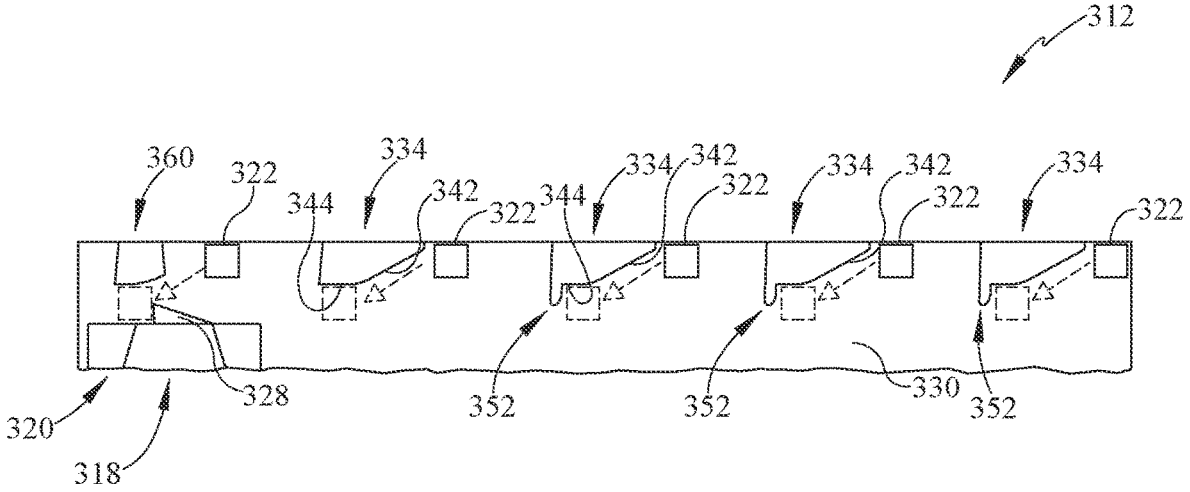
FIG. 46 is a diagrammatic view of an upper end of the vial unrolled to show each of the closure retainers and each of the closure anchors, in dashed lines, moving from an uninstalled position, in which each of the closure anchors is offset circumferentially and from each of the plurality of closure retainers, and the fully-installed position in which each of the plurality of closure anchors lies beneath a corresponding one of the plurality of closure retainers and one of the closure anchors engages a circumferential, rotation-blocking surface of the locking tab.
Figure 47:
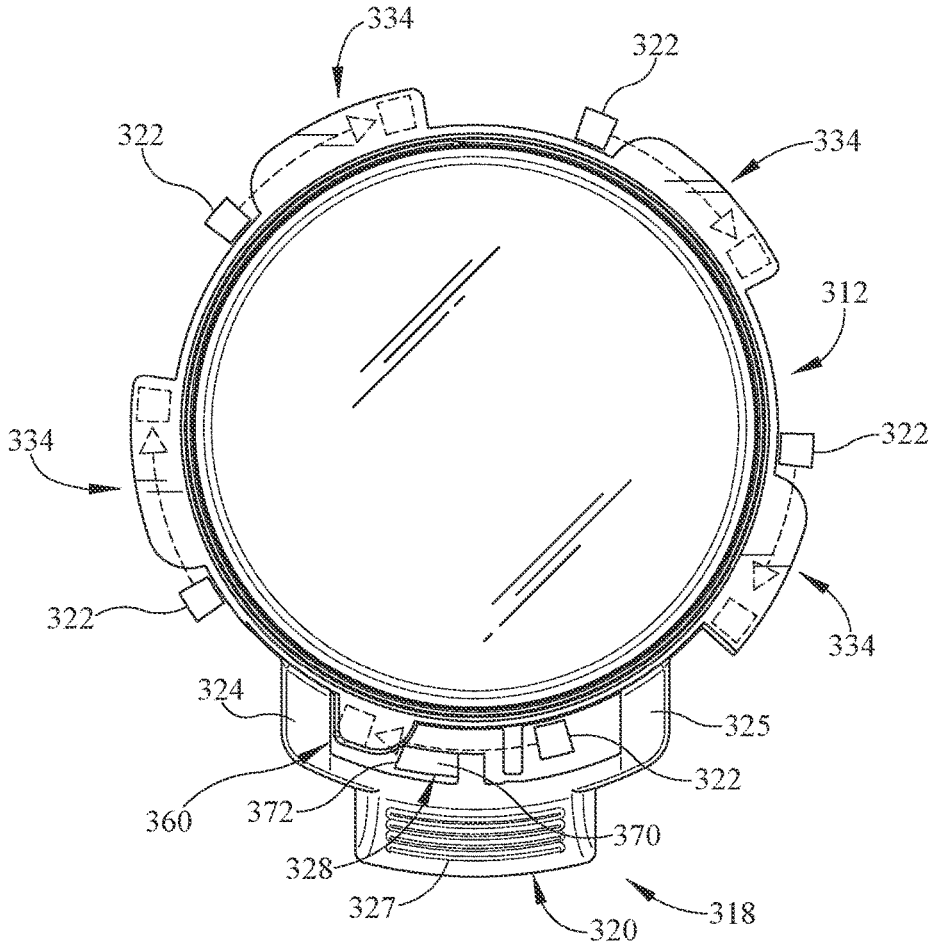
FIG. 47 is a top plan view of the vial showing each of the plurality of closure anchors, in dashed lines, moving from the uninstalled position to the fully-installed position.

During installation of closure 314 in clockwise closure-installation direction 337 onto vial 312 closure anchor 322 moves toward sloped upper surface 370 of locking tab 328. Continued rotation of closure 314 in clockwise closure-installation direction 337 causes closure anchor 322 to engage sloped upper surface 370 of locking tab 328 and move locking tab 328 about horizontal pivot axis 328H1 in downward direction 335, as shown in FIGS. 41 and 45.

Continued rotation of closure 314 causes closure anchor 322 to move past locking tab 328, resulting in locking tab 328 snapping back to its original position owing, in part, to elasticity of locking tab 328. With locking tab 328 in its original position, the pathway for closure anchor 322 is blocked and closure 314 cannot be removed from vial 312.

Figure 43:
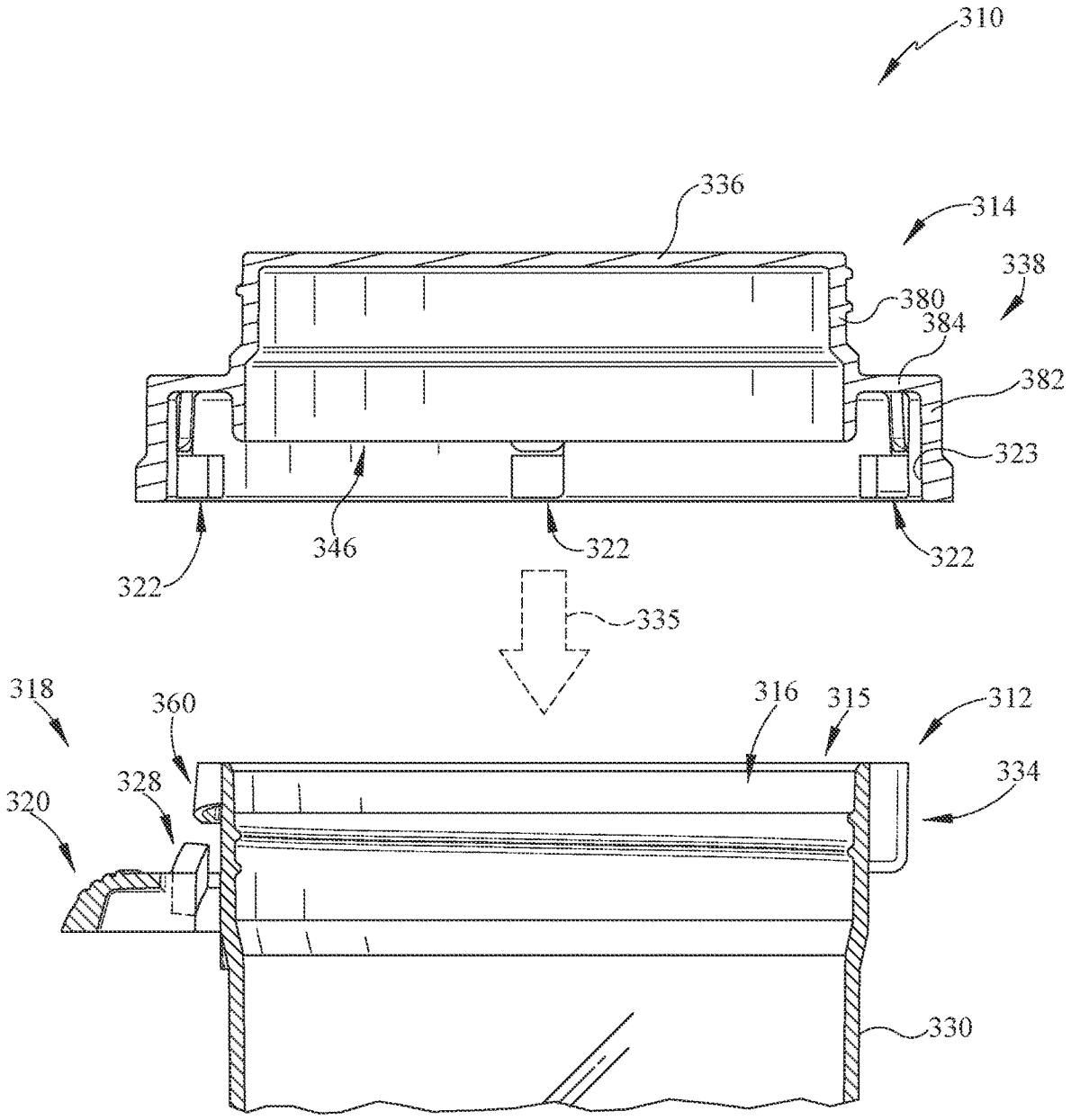
FIG. 43 is a sectional view of the package taken along line 43-43 in FIG. 40.

Side wall 338 of closure 314 includes an upper side wall 380, a lower side wall 382, and a skirt 384 that interconnects the upper side wall 380 and the lower side wall 382 as shown in FIG. 43. The external threads 112 of closure 314 are coupled to an outer surface of upper side wall 380. Each of the closure anchors 322 are coupled to an inside surface of lower side wall 382. Annular plug seal 346 extends downwardly from skirt 384 and is spaced radially inward from the lower side wall 382. The lower side wall 382 is formed to include a plurality of openings 386 that pass through the lower side wall 382 and are aligned circumferentially with each closure anchor. Closure 314 may be formed during a thermoforming process which uses the material removed from the portions of lower side wall 382 that define each opening 386 to form each closure anchor 322.

Figure 54:
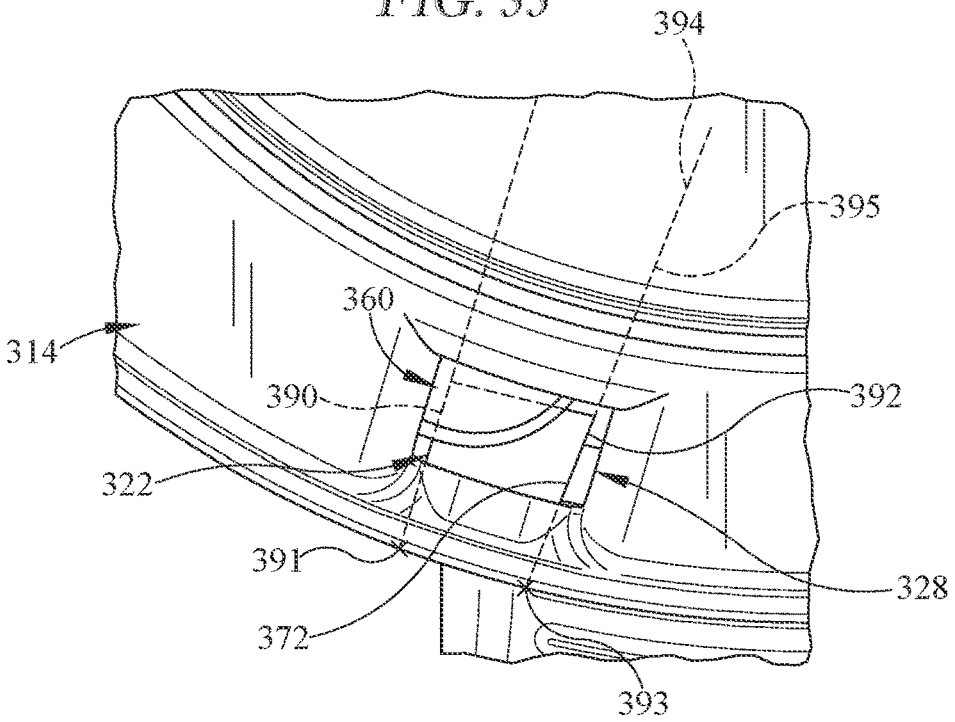
FIG. 54 is a top plan view of a portion of the package from FIG. 53 showing that each closure anchor includes a first circumferential surface that extends along a first plane and a second circumferential surface that extends along a second plane angled toward the counterclockwise direction and configured to cooperate with the circumferential, rotation, blocking surface of the locking tab to urge the closure anchor radially inwardly toward the annular side wall of the vial if the closure is rotated in the counterclockwise direction without disengaging the locking tab from the closure anchor so that the closure anchor is retained beneath an anchor-motion blocker to block unintentional removal of the closure from the vial.

Each closure anchor 322 is formed generally in the shape of a cube as shown in FIGS. 38 and 54, although other suitable shapes or structures may also be used in other embodiments. Each closure anchor 322 is shaped to cooperate with the locking tab 328 to avoid unintentional unlocking of closure 314. Each closure anchor 322 includes a clockwise or first circumferential side 390 and a counterclockwise or second circumferential side 392. The first circumferential side 390 is arranged to lie at a right angle relative to a point of tangency 391 on side wall 338 radially outward from the first circumferential side 390 of the respective closure anchor 322. The second circumferential side 392 is arranged to lie an acute angle relative to a point of tangency 393 on side wall 338 radially outward from the second circumferential side 392 of the respective closure anchor 322. In this way, the second circumferential side 392 is arranged to extend along a plane 394 in the counterclockwise direction.

Rotation-blocking surface 372 of locking tab 328 is similarly arranged to extend along a plane 395 that is generally parallel with plane 394 when second circumferential side 392 directly contacts rotation-blocking surface 372. Rotation of closure 314 in the counterclockwise direction without moving the locking tab 328 out of the path of closure anchor 322 will cause the closure anchor to deflect radially inwardly toward side wall 330 of vial 312. The closure anchor 322 is retained beneath the retainer motion blocker 360 due to the deflection of the closure anchor 322 by the rotation-blocking surface 372.

The illustrated and described arrangement of vial 312 with closure retainers 334 may minimize complexity in tooling when manufacturing package 310 and/or vial 2312. Closure retainers 334 provide a downward sealing force when a clockwise rotation is applied to the closure 314. However, closure retainers 334 may be simpler to mold than threads which extend annularly around a vial. A tool and/or mold to manufacture a vial having threads may require several actions, movements, or splits within the mold to manufacture the vial. For example, such a tool may employ a rotating action or an additional split. This can complicate the tool and can increase the cost of manufacture. The vial 312 of the present disclosure may be formed by a two-piece cavity and core tool and/or mold for manufacture. This may minimize complication of the tool and may reduce manufacturing costs while providing a vial 312 with closure retainers 334 to retain closure 314 on vial 312.

Figure 55:
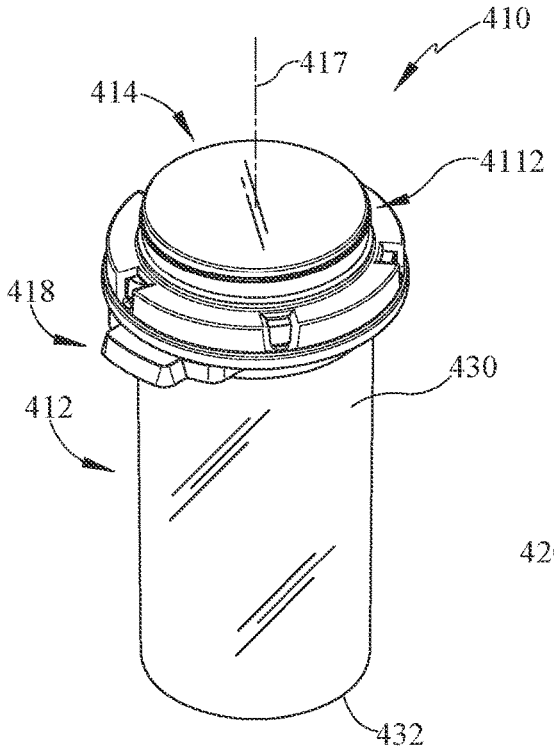
FIG. 55 is a perspective view of a child-resistant package in accordance with a fourth embodiment of the present disclosure showing a vial, a closure mounted on the vial to cover a mouth opening into an interior region formed in the vial, and a closure-release control mechanism having a movable release element that is coupled to the vial and configured to disengage a locking tab coupled to the vial from a closure anchor included in the closure to permit the release of the closure from the vial.
Figure 56:
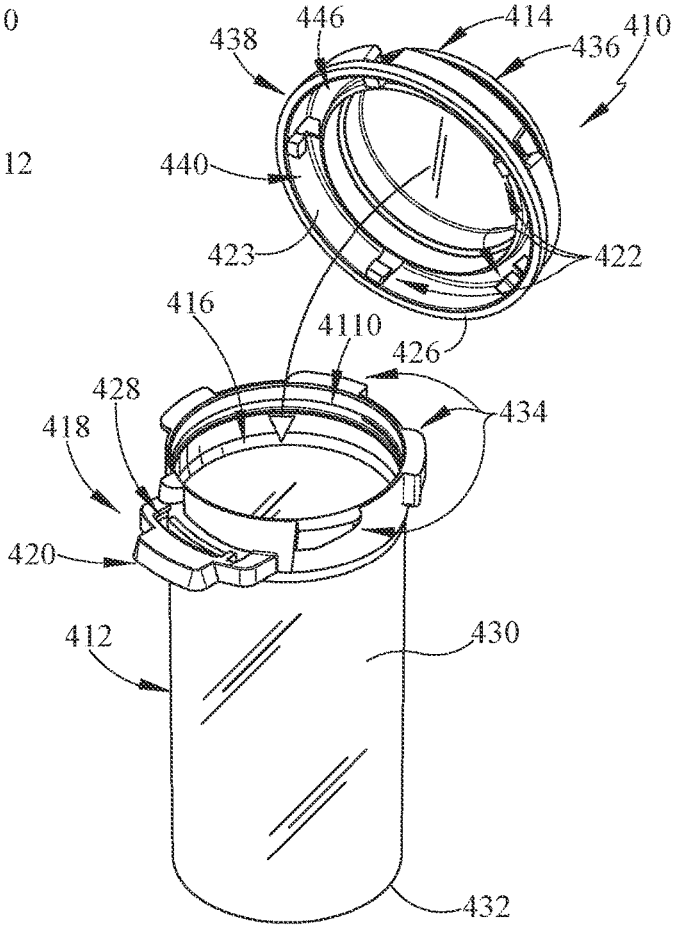
FIG. 56 is an exploded assembly view of the child-resistant package of FIG. 55, showing the closure separated from the vial to reveal a plurality of closure anchors coupled to a perimeter edge of a rim of the closure and showing the movable release element coupled to an annular flange of the vial and an inclined locking tab included in the closure-release control mechanism and configured to engage one of the plurality of closure retainers in the closure as suggested in FIGS. 60, 64, and 66 to block selectively removal of the closure from the vial until a downward directed push force is applied to the movable release element to disengage the locking tab from the closure anchor as shown in FIG. 67.

A child-resistant package 410 in accordance with a fourth embodiment of the present disclosure includes a vial 412, or container, and a closure 414 mounted on vial 412 to cover a mouth 415 opening into a product-storage chamber 416 formed in vial 412, as shown in the illustrative embodiment of FIGS. 55 and 56. Vial 412 is adapted to accept closure 414 to seal in the contents of vial 412. Product-storage chamber 416 is adapted to contain product, such as medication, and is sealed when closure 414 is coupled to vial 412. Child-resistant package 410 also includes a closure-release control mechanism 418 configured to control release of closure 414 from vial 412.

Vial 412 includes an annular sidewall 430, a floor 432 coupled to a lower end of side wall 430, and a plurality of closure retainers 434 coupled to an outer surface of an upper end of the side wall 430 as shown in FIG. 56. Side wall 430 extends vertically along an axis 417 of child-resistant package 410. Side wall 430 and floor 432 cooperate to define product-storage chamber 416 of vial 412. The plurality of closure retainers 434 extend outwardly away from axis 417 and are configured to cooperate with closure 414 to retain closure 414 on vial 412 in a full-installed position as shown in FIG. 55. Closure 414 is arranged to be coupled to vial 412 after rotation of closure 414 about axis of rotation 417, as shown, for example, in FIG. 55. Vial 412 does not include external threads and uses only the plurality of closure retainers 434 to mount closure 414 on vial 412 when the package 410 is being used in a child-resistant mode.

Closure 414 includes a round top wall 436 and an annular sidewall 438 that depends downwardly from top wall 436. Top wall 436 and side wall 438 form an interior region 440 of closure 414. Closure 414 does not include threads on side wall 438 within interior region 440 of closure 414, and, instead, further includes a plurality of closure anchors 422 that are coupled to an inside surface 423 of side wall 438 in interior region 440. The plurality of closure anchors 422 are configured to engage the plurality of closure retainers 434 so that closure 414 is retained to vial 412 after rotation of closure 414 about axis of rotation 417, as shown, for example, in FIG. 55.

Figure 67:
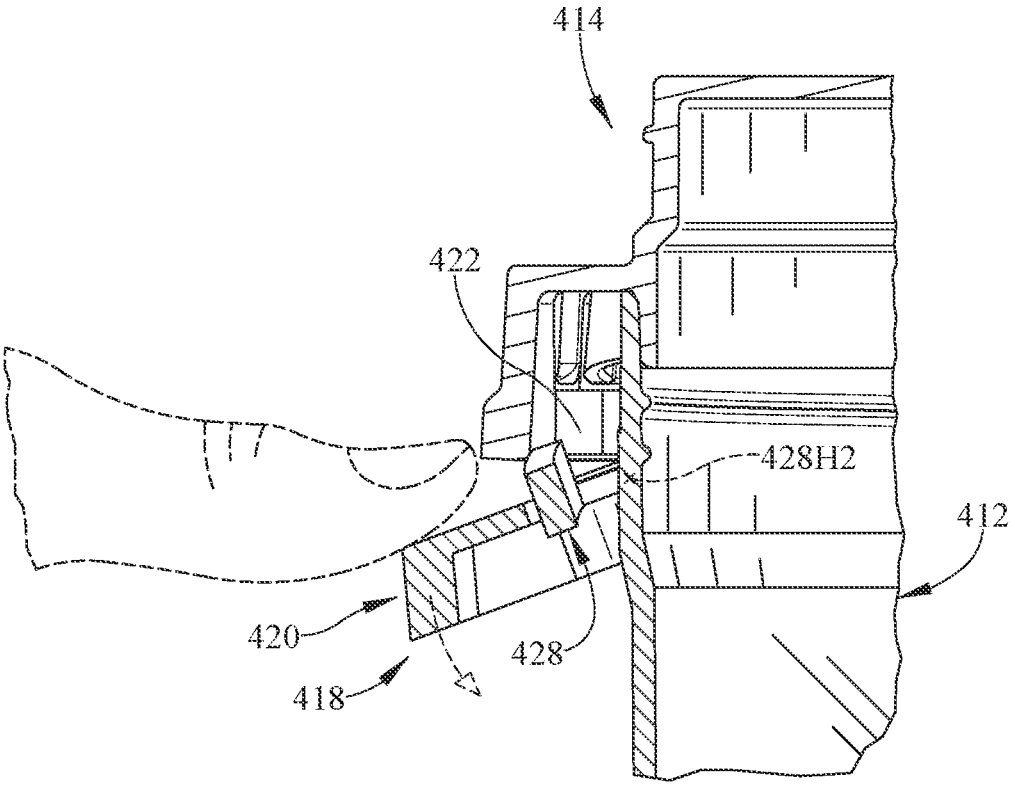
FIG. 67 is a cross-section of the portion of the package shown in FIG. 66 showing the thumb of the user pushing the closure release element downwardly to disengage the locking tab from the closure anchor so that the closure can be rotated in the counterclockwise direction to remove the closure from the vial for access to contents within the vial.
Figure 68:
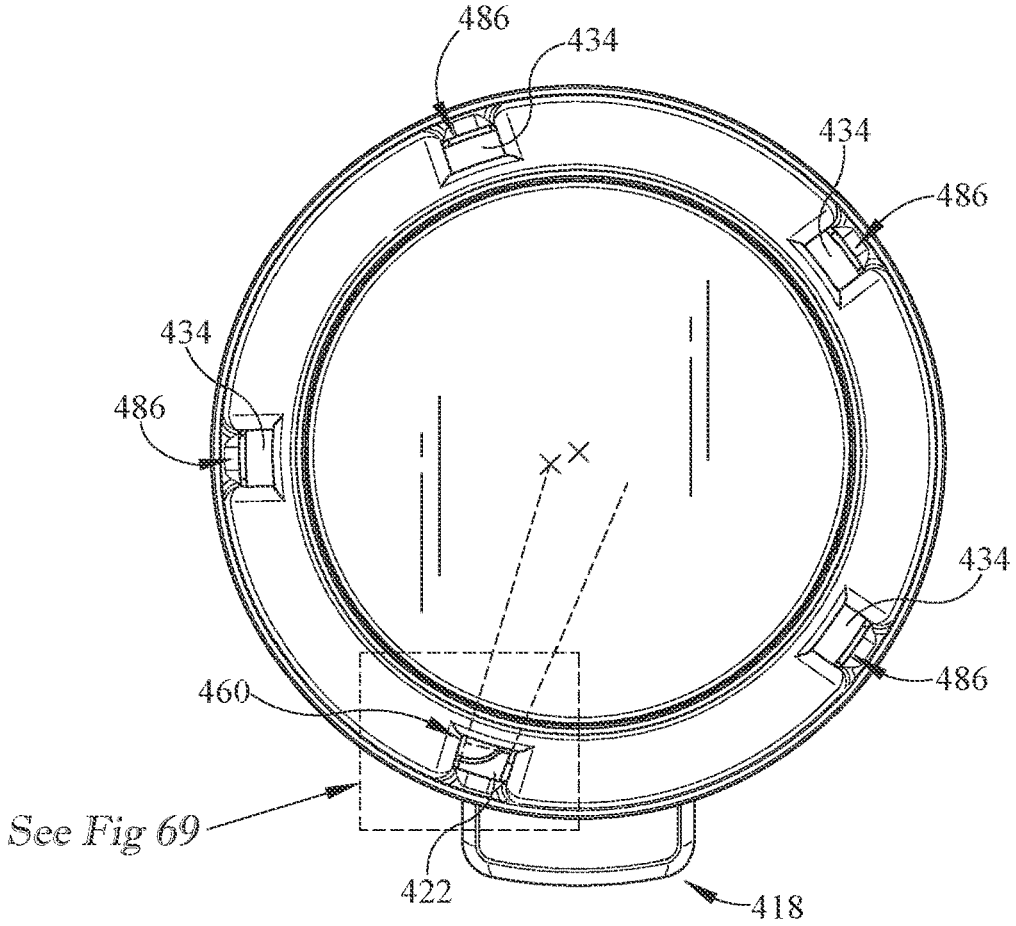
FIG. 68 is a top plan view of the package with the closure in the fully-installed position on the vial.

Closure-release control mechanism 418 comprises a movable release element 420 coupled to vial 412 and a locking tab 428 mounted on vial 412 for two-axis pivotable movement about a first horizontal pivot axis 428H1 during installation of closure 414 on vial 412 and about a second horizontal pivot axis 428H2 during removal of closure 414 from vial 412. Closure-release control mechanism 418 further comprises a plurality of radially inwardly extending closure anchors 422 coupled to a rim 426 of closure 414, as shown in FIG. 56. Removal of closure 414 from vial 412 is blocked when locking tab 428 included in closure-release control mechanism 418 and coupled to movable release element 420 is positioned to lie in the pathway of one of the plurality of closure anchors 422. When a consumer pushes movable release element 420 to flex downwardly as shown in FIG. 67, locking tab 428 moves out of the pathway of the one of the plurality of closure anchors 422 on closure 414 to permit counterclockwise rotation and removal of closure 414 from vial 412, as suggested in FIG. 67. Vial 412 also includes internal threads 4110 that correspond to external threads 4112 on an exterior surface of side wall 438 opposite interior region 440 of closure 414 to allow closure 414 to be coupled to vial 412 in a non-child resistant mode. To change closure 414 to the non-child resistant mode, closure 414 is removed from vial 412, inverted, and top wall 436 of closure 414 is inserted through open mouth 415 and coupled to vial 412 via threads 4110, 4112. When closure 414 is in the non-child resistant mode, closure-release control mechanism 418 does not work to block removal of closure 414 from vial 412.

Figure 57:
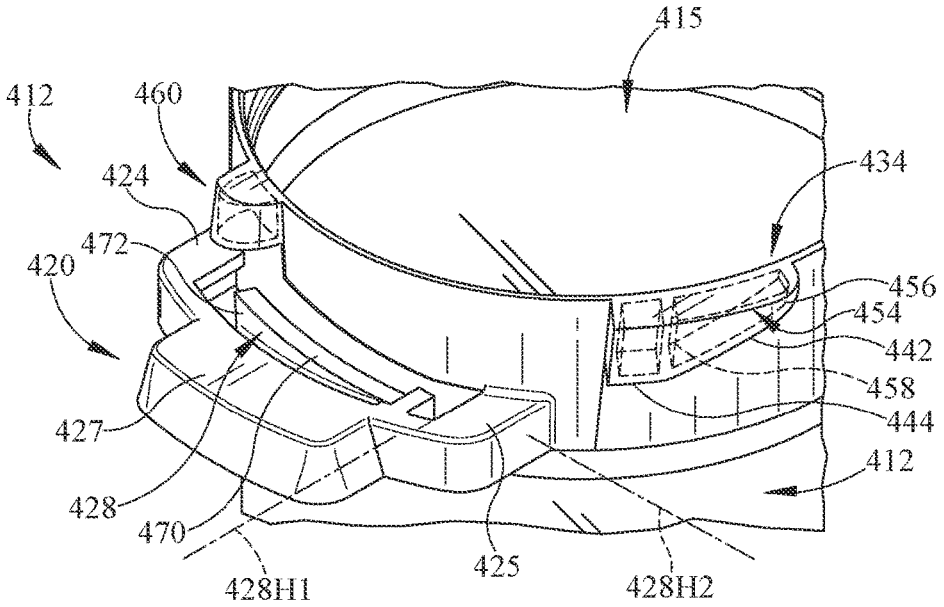
FIG. 57 is an enlarged perspective view of a portion of the vial of FIG. 56 showing the inclined locking tab positioned to lie between the movable release element and an annular sidewall included in the vial and showing that the vial includes a plurality of closure retainers coupled to the annular sidewall and adapted to engage a respective one of the plurality of closure anchors upon rotation of the closure in a clockwise direction relative to the vial until one of the closure anchors engages a circumferential surface of the inclined locking tab to block the closure from rotating in a counterclockwise direction until the downward push force is applied on the movable release element.
Figure 58:
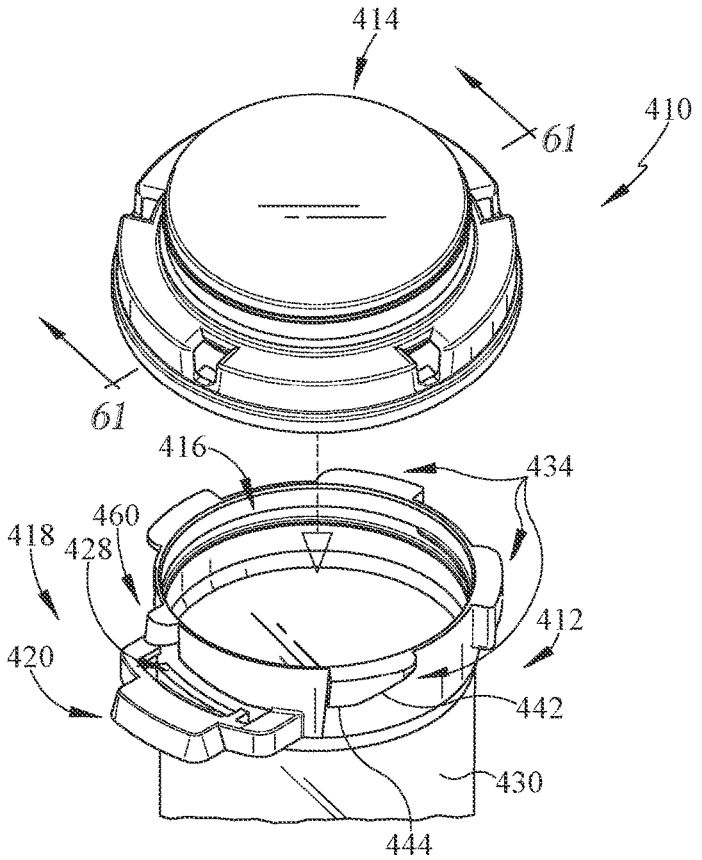
FIG. 58 is a partial perspective and exploded view of the package from FIG. 55 showing the closure removed from the vial and a downward arrow suggesting that, in order to close and lock the closure on the vial, the closure is lowered onto the vial with each of the closure anchors positioned between two adjacent closure retainers.

Movable release element 420 includes a pair of support arms 424, 425 and an actuator pad 427 as shown in FIG. 57. The pair of support arms 424, 425 extend radially outward from side wall 430 of vial 412 and are spaced apart from one another circumferentially about axis 417. Actuator pad 427 extends between and interconnects the pair of support arms 424, 425. Locking tab 428 is coupled to actuator pad 427, but may be coupled to one of the support arms 424, 425 in other embodiments. An operator may use the actuator pad 427 to deform the pair of support arms 424, 425 and pivot the locking tab 428 downwardly with the actuator pad 427 about second horizontal axis 428H2 out of the path of the plurality of closure anchors 422 so that closure 414 can be removed from vial 412.

Each of the plurality of closure retainers 434 includes a closure-displacement ramp 442 and a closure-retainer surface 444 as shown in FIG. 57. Each closure-displacement ramp 442 is configured to engage one of the plurality of closure anchors as closure 414 is rotated in a closure-instillation direction toward the fully-installed position. Each closure-retainer surface 444 is configured to engage one of the plurality of closure anchors 422 in the installed position to block removal of closure 414 from vial 412 along axis of rotation 417.

Each of the plurality of closure retainers 434 is configured to pull closure 414 toward vial 412 as closure 414 is rotated in the closure-installation direction and at least some of the closure anchors 422 ride along a closure-displacement ramp 442 of each closure retainer 434. Closure 414 further includes an annular plug seal 446 and arranged to extend downwardly away from the top wall 436 through mouth 415 of vial 412 and into product-storage chamber 416 in the installed position. Annular plug seal 446 is adapted to engage an inner surface of side wall 430 of vial 412 to provide a liquid-and-air tight seal between closure 414 and vial 412.

Figure 62:
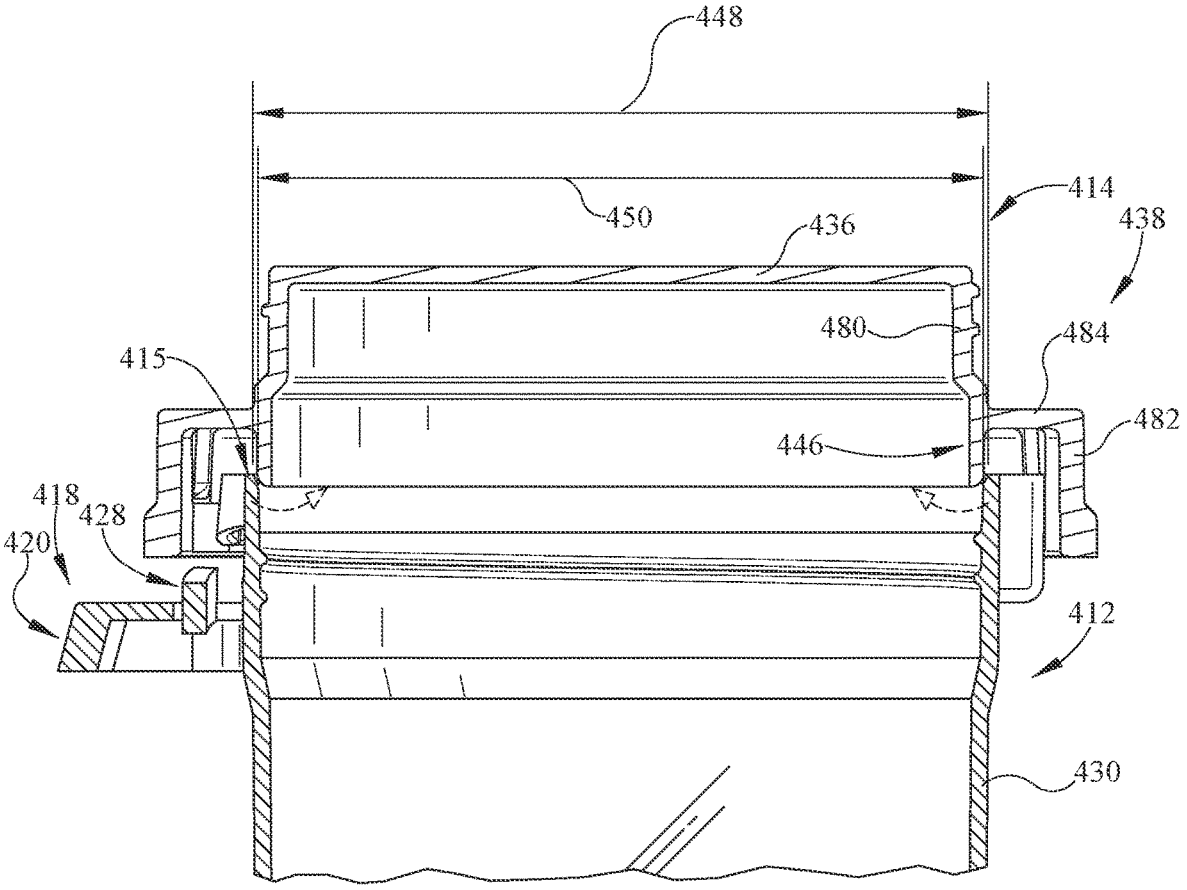
FIG. 62 is a sectional view of the package taken along line 62-62 in FIG. 59 showing that the closure further includes an annular plug that engages a radially inner surface of the vial defining the open mouth and that is configured to flex radially inwardly upon movement of the closure in the clockwise direction toward the fully-installed.

Annular plug seal 446 may bias closure 414 upwardly away from vial 412 as suggested in FIG. 62. A radially outer surface of annular plug seal 446 has a first diameter 448. A radially inner surface of side wall 430 of vial 412 at mouth 415 has a second diameter 450. The second diameter 450 is less than the first diameter 448 such that annular plug seal 446 flexes inwardly toward axis 417 as closure 414 is rotated onto vial 412. Forces provided by annular plug seal 446 on vial 412 may urge closure 414 away from vial 412 to facilitate removal of closure 414 from vial 412. Annular plug seal 446 extends downwardly from skirt 484 and upper side wall 480. Annular plug seal 446 is spaced radially from lower side wall 482 and vial 412 is received between annular plug seal 446 and lower side wall 482 when closure 414 is fully-installed.

Vial 412 does not include exterior threads and closure 414 does not include interior threads for coupling closure 414 to vial 412 in the child resistant mode. Instead, vial 412 includes circumferentially spaced closure retainers 434 and closure 414 includes circumferentially spaced closure anchors 422. The plurality of closure anchors 422 retain the functionality of threads, while also cooperating with closure-release control mechanism 418 to block removal of closure 414 from vial 412 when closure 414 is in the fully-installed position. Thus, threads have been omitted from the interior surface of closure 414 and the exterior surface of vial 412 while the thread function has been retained.

The closure-displacement ramp 442 transitions directly to the closure-retainer surface 444 such that a lower end of the closure-displacement ramp surface 442 and at least a portion of the closure-retainer surface 444 is located at a same height from the mouth 415 of vial 412. In the fully-installed position, an upper surface of the side wall 430 of vial 412 and each of the closure retainers 434 engages the closure 414 to block vertical movement of the closure 414 downwardly toward the vial 412. In this way, an operator need only rotate closure 414 in the counterclockwise direction with the locking tab 428 disengaged from the closure anchors 422 to remove closure 414 from vial 412.

At least one of the plurality of closure retainers 434 further includes a rotation-blocking stop 452 that extends downwardly from the closure-retainer surface 444 at a circumferential end of the closure-retainer surface 444 opposite the closure-displacement ramp 442. The rotation-blocking stop 452 is configured to engage one of the closure anchors 422 in the installed position to block further rotation of closure 414 in the closure-installation direction. In the illustrative embodiment, only three out of the four closure retainers 434 includes a rotation-blocking stop 452, however, any suitable number of rotation-blocking stops 452 may be used.

In illustrative embodiments, vial 412 further includes a retainer motion blocker 460 coupled to side wall 430 of vial 412. The retainer motion blocker 460 is positioned above the closure-release control mechanism 418. The retainer motion blocker 460 is also aligned circumferentially with one of the closure anchors 422 that is engaged with locking tab 428 when closure 414 is in the fully-installed position. The retainer motion blocker 460 is configured to block vertical movement of the closure anchor 422 relative to the locking tab 428 so as to avoid unintentional removal of closure 414 from vial 412.

The retainer motion blocker 460 is similar to the closure retainers 434. The retainer motion blocker 460 has a circumferential length that is less than a circumferential length of each of the plurality of closure retainers 434. The retainer motion blocker 460 also has a radial thickness that is about equal to a radial thickness of each of the plurality of closure retainers 434. In some embodiments, the retainer motion blocker 460 may be the same as one or all of the closure retainers 434. In yet another embodiment, the retainer motion blocker 460 may be omitted.

Each of the closure retainers 434 and the retainer motion blocker 460 is partially spaced apart from the side wall 430 of vial 412 such that a hollow space 454 is formed between an outer surface 456 of each closure retainer 434 and side wall 430. Providing the hollow space 454 between each closure retainer 434 and the side wall 430 reduces the amount material needed to form vial 412 thereby decreasing the cost of vial 412 and package 410. Each closure retainer 434 may include a support rib 458 that extends outward from the side wall toward the outer surface of a corresponding closure retainer through the hollow space 454.

Locking tab 428 is configured to move independently of movable release element 420 about first horizontal pivot axis 428H1 when closure 414 is attached to vial 412, as shown in FIG. 56. Locking tab 428 is also configured to move with movable release element 420 and relative to annular sidewall 430 about second horizontal pivot axis 428H2 to allow removal of closure 414 from vial 412 as suggested in FIG. 67.

Locking tab 428 is configured to engage one of closure anchors 422 included in closure 414 to block removal of closure 414 from vial 412 until a downwardly directed push force is applied to movable release element 420. Rotation of closure 414 in a clockwise closure-installation direction causes one of the closure anchors 422 to engage locking tab 428 to cause locking tab 428 to deflect and move about horizontal pivot axis 428H1 in downward direction 435. Downward movement of locking tab 428 by the closure anchor 422 about horizontal pivot axis 428H1 does not cause movement of movable release element 420 relative to annular sidewall 438. Application of a downward push force to movable release element 420 by a consumer causes locking tab 428 to move or pivot below closure anchors 422 about second horizontal pivot axis 428H2 to allow for removal of closure 414 from vial 412.

Locking tab 428 includes a sloped upper surface 470 and a rotation-blocking surface 472. Sloped upper surface 470 is configured to be engaged by one of the closure anchors 422 of closure 414 during rotation of closure 414 in a clockwise closure-installation direction 437 on vial 412 to cause locking tab 428 to pivot downwardly in direction 435 about horizontal pivot axis 428H1 to allow the closure anchor 422 to move past locking tab 428 during installation of closure 414 onto vial 412.

Figure 59:
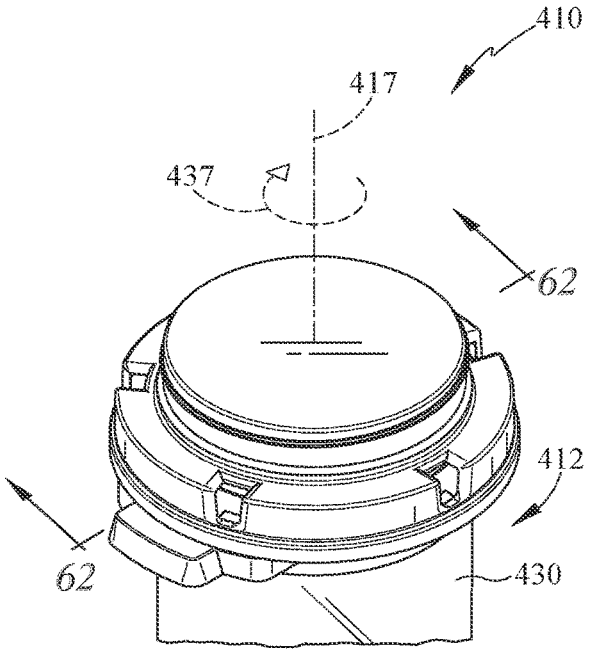
FIG. 59 is a partial perspective view of the package with the closure lowered onto the vial with each of the closure anchors positioned between two adjacent closure retainers and a phantom arrow suggesting that the closure can be rotated in the clockwise direction to lock the closure on the vial.
Figure 60:
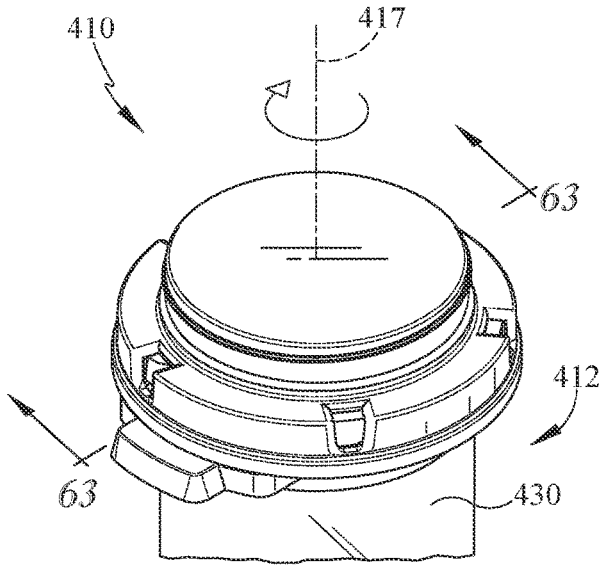
FIG. 60 is a partial perspective view of the closure in a fully-installed position on the vial where each of the closure anchors is positioned directly beneath a corresponding one of the plurality of closure retainers and one of closure anchors is blocked from rotating in the counterclockwise direction by the locking tab.
Figure 63:
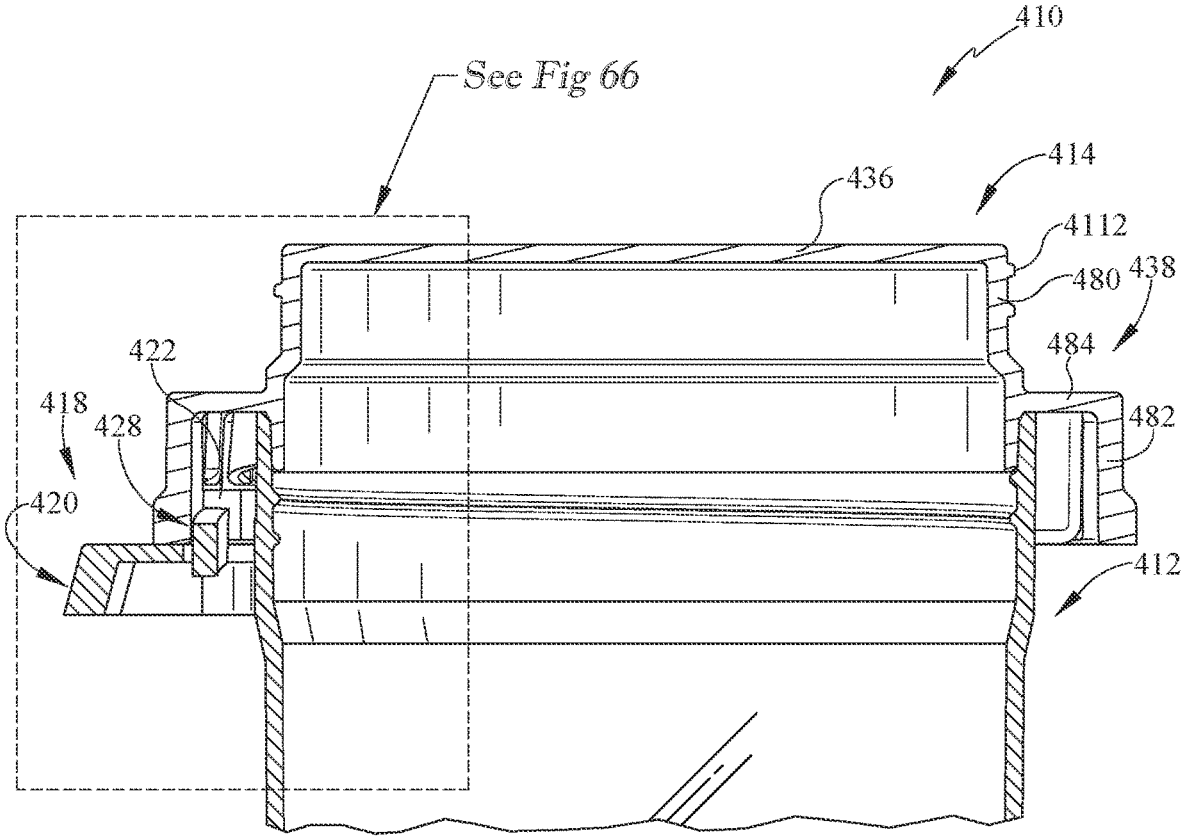
FIG. 63 is a sectional view of the package taken along line 63-63 in FIG. 60 showing the closure in the fully-installed position on the vial.
Figure 64:
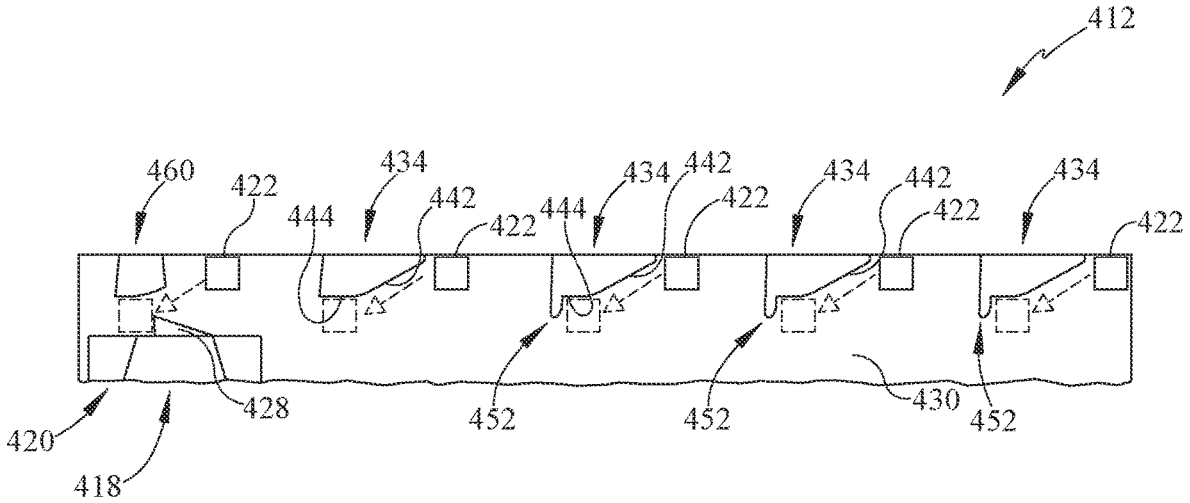
FIG. 64 is a diagrammatic view of an upper end of the vial unrolled to show each of the closure retainers and each of the closure anchors, in dashed lines, moving from an uninstalled position, in which each of the closure anchors is offset circumferentially and from each of the plurality of closure retainers, and the fully-installed position in which each of the plurality of closure anchors lies beneath a corresponding one of the plurality of closure retainers and one of the closure anchors engages a circumferential, rotation-blocking surface of the locking tab.
Figure 65:
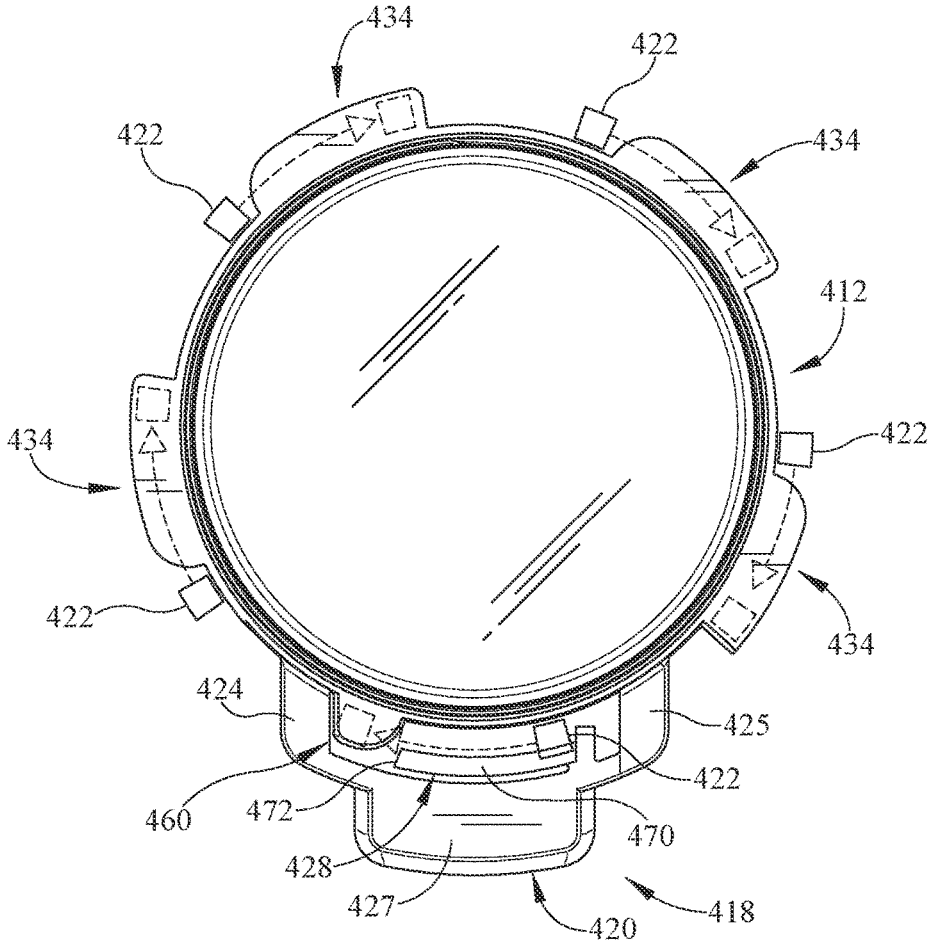
FIG. 65 is a top plan view of the vial showing each of the plurality of closure anchors, in dashed lines, moving from the uninstalled position to the fully-installed position.
Figure 66:
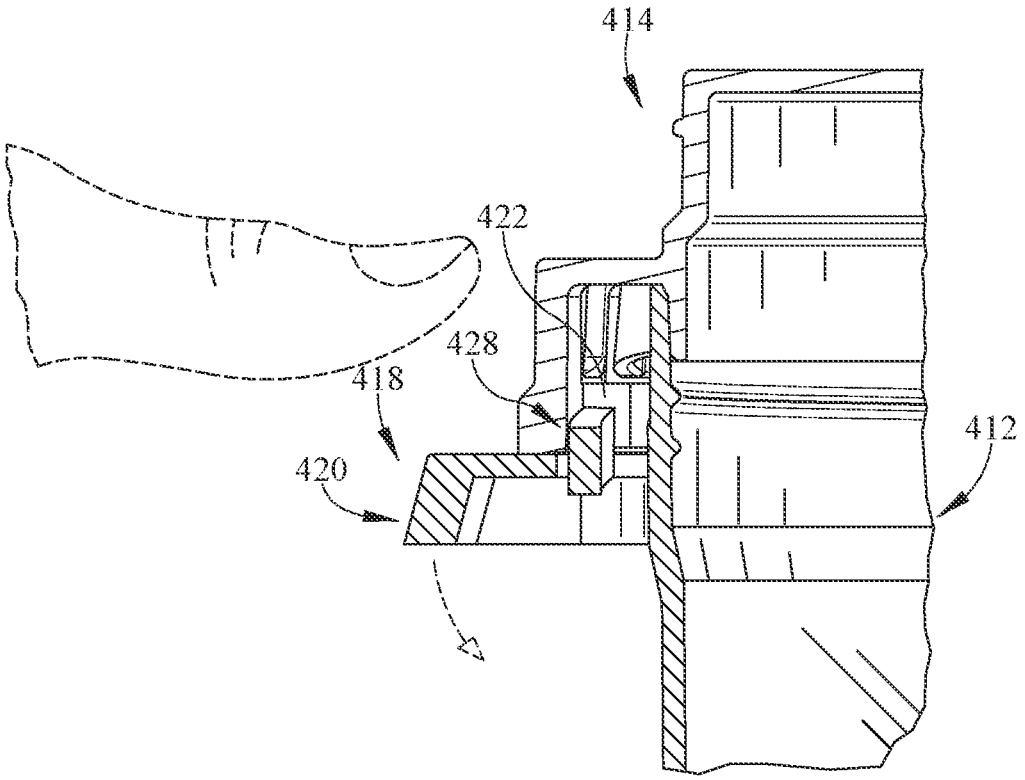
FIG. 66 is a cross-section of a portion of the package from FIG. 63 showing the closure in the fully-installed position and a thumb of a user being lowered toward the closure release element.

During installation of closure 414 in clockwise closure-installation direction 437 onto vial 412 closure anchor 422 moves toward sloped upper surface 470 of locking tab 428. Continued rotation of closure 414 in clockwise closure-installation direction 437 causes closure anchor 422 to engage sloped upper surface 470 of locking tab 428 and move locking tab 428 about horizontal pivot axis 428H1 in downward direction 435, as shown in FIGS. 59 and 63. Continued rotation of closure 414 causes closure anchor 422 to move past locking tab 428, resulting in locking tab 428 snapping back to its original position owing, in part, to elasticity of locking tab 428. With locking tab 428 in its original position, the pathway for closure anchor 422 is blocked and closure 414 cannot be removed from vial 412.

Figure 61:
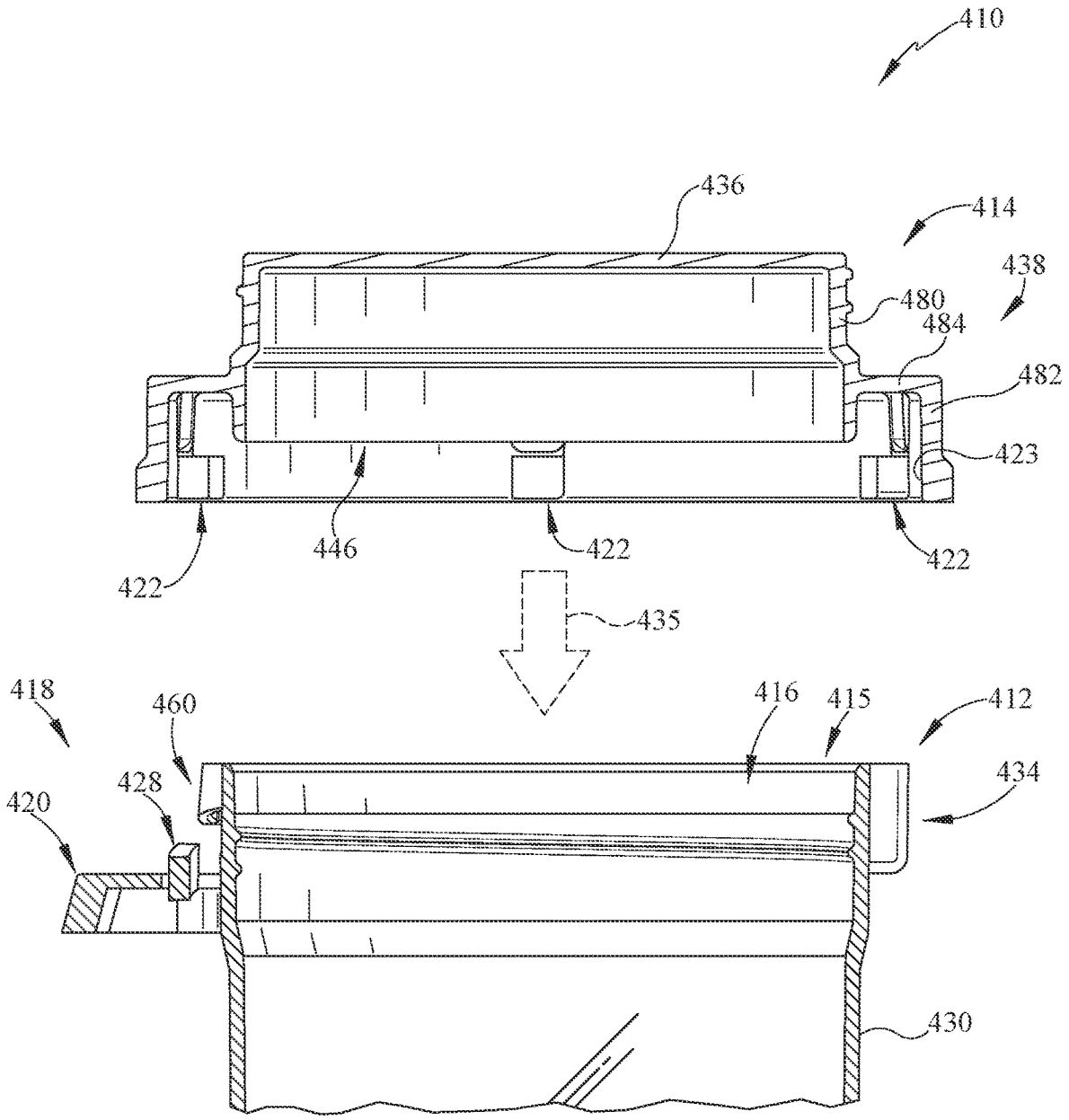
FIG. 61 is a sectional view of the package taken along line 61-61 in FIG. 58.

Side wall 438 of closure 414 includes an upper side wall 480, a lower side wall 482, and a skirt 484 that interconnects the upper side wall 480 and the lower side wall 482 as shown in FIG. 61. The external threads 4112 of closure 414 are coupled to an outer surface of upper side wall 480. Each of the closure anchors 422 are coupled to an inside surface of lower side wall 482. Annular plug seal 446 extends downwardly from skirt 484 and is spaced radially inward from the lower side wall 482. The lower side wall 482 is formed to include a plurality of openings 486 that pass through the lower side wall 482 and are aligned circumferentially with each closure anchor 422. Closure 414 may be formed during a thermoforming process which uses the material removed from the portions of lower side wall 482 that define each opening 486 to form each closure anchor 422.

Figure 69:
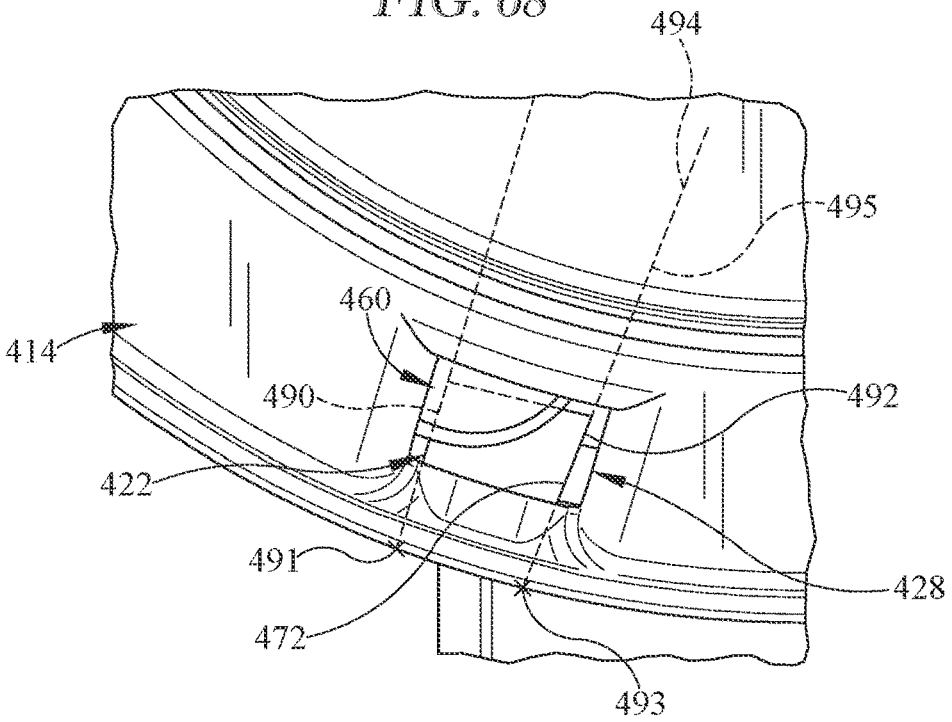
FIG. 69 is a top plan view of a portion of the package from FIG. 68 showing that each closure anchor includes a first circumferential surface that extends along a first plane and a second circumferential surface that extends along a second plane angled toward the counterclockwise direction and configured to cooperate with the circumferential, rotation, blocking surface of the locking tab to urge the closure anchor radially inwardly toward the annular side wall of the vial if the closure is rotated in the counterclockwise direction without disengaging the locking tab from the closure anchor so that the closure anchor is retained beneath an anchor-motion blocker to block unintentional removal of the closure from the vial.

Each closure anchor 422 is formed generally in the shape of a cube as shown in FIGS. 56 and 69, although other suitable shapes or structures may also be used in other embodiments. Each closure anchor 422 is shaped to cooperate with the locking tab 428 to avoid unintentional unlocking of closure 414. Each closure anchor 422 includes a clockwise or first circumferential side 490 and a counterclockwise or second circumferential side 492. The first circumferential side 490 is arranged to lie at a right angle relative to a point of tangency 491 on side wall 438 radially outward from the first circumferential side 490 of the respective closure anchor 422. The second circumferential side 492 is arranged to lie an acute angle relative to a point of tangency 493 on side wall 438 radially outward from the second circumferential side 492 of the respective closure anchor 422. In this way, the second circumferential side 492 is arranged to extend along a plane 494 in the counterclockwise direction.

Rotation-blocking surface 472 of locking tab 428 is similarly arranged to extend along a plane 495 that is generally parallel with plane 494 when second circumferential side 492 directly contacts rotation-blocking surface 472. Rotation of closure 414 in the counterclockwise direction without moving the locking tab 428 out of the path of closure anchor 422 will cause the closure anchor to deflect radially inwardly toward side wall 430 of vial 412. The closure anchor 422 is retained beneath the retainer motion blocker 460 due to the deflection of the closure anchor 422 by the rotation-blocking surface 472.

The illustrated and described arrangement of vial 412 with closure retainers 434 may minimize complexity in tooling when manufacturing package 410 and/or vial 412. Closure retainers 434 provide a downward sealing force when a clockwise rotation is applied to the closure 414. However, closure retainers 434 may be simpler to mold than threads which extend annularly around a vial. A tool and/or mold to manufacture a vial having threads may require several actions, movements, or splits within the mold to manufacture the vial. For example, such a tool may employ a rotating action or an additional split. This can complicate the tool and can increase the cost of manufacture. The vial 412 of the present disclosure may be formed by a two-piece cavity and core tool and/or mold for manufacture. This may minimize complication of the tool and may reduce manufacturing costs while providing a vial 412 with closure retainers 434 to retain closure 414 on vial 412.

The invention claimed is:

1. A child-resistant package comprises a vial including a side wall, a floor coupled to the side wall and cooperating with the side wall to define a product-storage chamber, and a plurality of closure retainers coupled to an outer surface of the side wall outside of the product-storage chamber, the plurality of closure retainers spaced circumferentially from one another about an axis of rotation, a closure including a top wall, a side wall being arranged to extend downwardly away from an outer perimeter of the top wall, and a plurality of closure anchors coupled to an inside surface of the side wall of the closure and spaced circumferentially from one another about the axis of rotation, the closure configured to mount on the vial to assume an installed position closing a mouth formed in the vial when rotated relative to the vial about the axis of rotation in a closure-installation direction until each of the closure retainers overlies a corresponding closure anchor to block separation of the closure from the vial along the axis of rotation, a closure-release control mechanism including a movable release element mounted on the outer surface of the side wall of the vial for movement relative to the vial, and a locking tab coupled to the movable release element and arranged to engage one of the closure anchors to block rotation of the closure about the axis of rotation in a closure-removal direction when the closure is in the installed position on the vial, and a retainer motion blocker coupled to the side wall of the closure and located above and aligned circumferentially with the one of the plurality of closure anchors engaged with the locking tab when the closure is in the installed position to block vertical movement of the one of the plurality of closure anchors relative to the locking tab, wherein the retainer motion blocker has a circumferential length that is less than a circumferential length of each of the plurality of closure retainers.

2. The child-resistant package of claim 1, wherein each of the plurality of closure retainers includes a closure-displacement ramp surface that engages one of the plurality of closure anchors as the closure is rotated in the closure-installation direction toward the installed position and a closure-retainer surface that engages one of the plurality of closure anchors in the installed position.

3. The child-resistant package of claim 2, wherein at least one of the plurality of closure retainers further includes a rotation-blocking stop that extends downwardly from the closure-retainer surface and is configured to engage one of the closure anchors in the installed position to block rotation of the closure in the closure-installation direction.

4. The child-resistant package of claim 2, wherein the closure-displacement ramp surface transitions directly to the closure-retainer surface such that a lower end of the closure-displacement ramp surface is located at a same height from the mouth of the vial as at least a portion of the closure-retainer surface.

5. The child-resistant package of claim 1, wherein the retainer motion blocker has a radial thickness that is about equal to a radial thickness of each of the plurality of closure retainers.

6. The child-resistant package of claim 1, wherein, in the installed position, an upper surface of the side wall of the vial and each of the closure retainers engages the closure to block vertical movement of the closure downwardly toward the vial.

7. The child-resistant package of claim 1, wherein the top wall and the side wall of the closure cooperate to define an interior region and the closure has no interior threads on the inside surface of the side wall of the closure within the interior region.

8. The child-resistant package of claim 1, wherein the movable release element comprises a pair of support arms and an actuator pad, the pair of support arms extending radially outward from the side wall of the vial and spaced apart from one another circumferentially about the axis of rotation and the actuator pad extending between and interconnecting the pair of support arms, and wherein the closure-release control mechanism further comprises a first travel limiter coupled to the actuator pad between the pair of support arms and extending radially inward toward the side wall of the vial.

9. The child-resistant package of claim 8, wherein the closure-release control mechanism further comprises a second travel limiter coupled to the side wall of the vial between the pair of support arms and extending radially outward toward the actuator pad, the first travel limiter and the second travel limiter being spaced apart circumferentially relative to the axis of rotation.

10. The child-resistant package of claim 9, wherein the closure-release control mechanism further includes a first companion travel-limiter wall coupled to and extending radially outward from the side wall of the vial and a second companion travel-limiter wall coupled to and extending radially inward from the actuator pad, the first companion travel-limiter wall being circumferentially aligned with the first travel limiter and the second companion travel-limiter wall being circumferentially aligned with the second travel limiter.

11. The child-resistant package of claim 9, wherein the locking tab is coupled to the first travel limiter and extends away from the second travel limiter.

12. The child-resistant package of claim 1, wherein each of the closure retainers is spaced apart partially from the side wall of the vial such that a hollow space is formed between an outer surface of each closure retainer and the side wall of the vial, and wherein each closure retainer includes a support rib that extends outward away from the side wall of the vial through the hollow space.

13. A canister comprising a container including a body formed to include a product-storage chamber and a mouth arranged to open into the product-storage chamber and a plurality of closure retainers coupled to an outer surface of the body outside of the product-storage chamber and located adjacent to the mouth, the plurality of closure retainers spaced circumferentially from one another about a vertical axis, a closure including a top wall, a side wall arranged to extend downwardly away from an outer perimeter of the top wall, and a plurality of closure anchors coupled to an inside surface of the side wall of the closure and spaced circumferentially from one another, the closure configured to mount on the container to assume an installed position closing the mouth formed in the container when rotated relative to the container about the vertical axis in a closure-installation direction until each of the closure anchors rests beneath a corresponding one of the closure retainers to block separation of the closure from the container along the vertical axis, a closure-release control mechanism comprising a movable release element mounted on the outer surface of the body for movement relative to the container, and a locking tab coupled to the movable release element and arranged to engage one of the closure anchors to block rotation of the closure about the vertical axis in a closure-removal direction when the closure is in the installed position on the container, and a retainer motion blocker coupled to the side wall of the closure and located above and aligned circumferentially with the one of the plurality of closure anchors engaged with the locking tab when the closure is in the installed position to block vertical movement of the one of the plurality of closure anchors relative to the locking tab, and the retainer motion blocker has a circumferential length that is less than a circumferential length of each of the plurality of closure retainers, wherein each of the closure retainers is spaced apart partially from a side wall of the container such that a hollow space is formed between an outer surface of each closure retainer and the side wall of the container, and wherein each closure retainer includes a support rib that extends outward away from the side wall of the container through the hollow space.

14. The canister of claim 13, wherein each of the plurality of closure retainers includes a closure-displacement ramp surface that engages one of the plurality of closure anchors as the closure is rotated in the closure-installation direction toward the installed position and a closure-retainer surface that engages one of the plurality of closure anchors in the installed position.

15. The canister of claim 14, wherein at least one of the plurality of closure retainers further includes a rotation-blocking stop that extends downwardly from the closure-retainer surface and is configured to engage one of the closure anchors in the installed position to block rotation of the closure in the closure-installation direction.

16. The canister of claim 13, wherein the retainer motion blocker has a radial thickness that is about equal to a radial thickness of each of the plurality of closure retainers.

17. A canister comprising a container including a body formed to include a product-storage chamber and a mouth arranged to open into the product-storage chamber and a plurality of closure retainers coupled to an outer surface of the body outside of the product-storage chamber and located adjacent to the mouth, the plurality of closure retainers spaced circumferentially from one another about a vertical axis, a closure including a top wall, a side wall arranged to extend downwardly away from an outer perimeter of the top wall, and a plurality of closure anchors coupled to an inside surface of the side wall of the closure and spaced circumferentially from one another, the closure configured to mount on the container to assume an installed position closing the mouth formed in the container when rotated relative to the container about the vertical axis in a closure-installation direction until each of the closure anchors rests beneath a corresponding one of the closure retainers to block separation of the closure from the container along the vertical axis, a closure-release control mechanism comprising a movable release element mounted on the outer surface of the body for movement relative to the container, and a locking tab coupled to the movable release element and arranged to engage one of the closure anchors to block rotation of the closure about the vertical axis in a closure-removal direction when the closure is in the installed position on the container, and a retainer motion blocker coupled to the side wall of the closure and located above and aligned circumferentially with the one of the plurality of closure anchors engaged with the locking tab when the closure is in the installed position to block vertical movement of the one of the plurality of closure anchors relative to the locking tab, wherein the retainer motion blocker has a circumferential length that is less than a circumferential length of each of the plurality of closure retainers.

* * * * *